United States Patent [19]

Neuhierl

[11] Patent Number: 4,493,669

[45] Date of Patent: Jan. 15, 1985

[54] MOTORIZED TOY

[76] Inventor: Hermann Neuhierl, Waldstrasse 36, D-8510 Fürth/Bayern, Fed. Rep. of Germany

[21] Appl. No.: 366,982

[22] Filed: Apr. 9, 1982

[30] Foreign Application Priority Data

| | | | |
|---|---|---|---|
| Apr. 11, 1981 | [DE] | Fed. Rep. of Germany | 3114838 |
| May 30, 1981 | [DE] | Fed. Rep. of Germany | 3121564 |
| May 30, 1981 | [DE] | Fed. Rep. of Germany | 3121568 |
| Aug. 17, 1981 | [DE] | Fed. Rep. of Germany | 3132299 |
| Sep. 18, 1981 | [DE] | Fed. Rep. of Germany | 3137208 |
| Dec. 19, 1981 | [DE] | Fed. Rep. of Germany | 3150466 |
| Dec. 24, 1981 | [DE] | Fed. Rep. of Germany | 3151459 |
| Feb. 3, 1982 | [DE] | Fed. Rep. of Germany | 3203627 |
| Feb. 3, 1982 | [DE] | Fed. Rep. of Germany | 3203574 |
| Mar. 9, 1982 | [DE] | Fed. Rep. of Germany | 3208338 |

[51] Int. Cl.[3] ..... A63H 18/00

[52] U.S. Cl. ..... 446/103; 446/441; 446/444; 272/31 R

[58] Field of Search ..... 46/202, 204, 206, 216, 46/217, 257-263; 446/103, 441, 442, 444, 446; 272/31 R

[56] References Cited

U.S. PATENT DOCUMENTS

| | | | |
|---|---|---|---|
| 3,562,950 | 4/1967 | Genin | 46/261 |
| 3,589,063 | 6/1971 | Genin | 46/216 |
| 3,698,130 | 10/1972 | Usami | 46/206 |
| 4,051,624 | 10/1977 | Ogawa | 46/202 |
| 4,312,149 | 1/1982 | Iwao | 46/202 X |

FOREIGN PATENT DOCUMENTS

| | | |
|---|---|---|
| 1603633 | 11/1966 | Fed. Rep. of Germany . |
| 1958938 | 11/1969 | Fed. Rep. of Germany . |
| 2051343 | 10/1970 | Fed. Rep. of Germany . |
| 2204912 | 2/1972 | Fed. Rep. of Germany . |
| 7636264 | 2/1972 | Fed. Rep. of Germany . |

*Primary Examiner*—F. Barry Shay

*Attorney, Agent, or Firm*—Wood, Dalton, Phillips, Mason & Rowe

[57] ABSTRACT

A motorized toy is described which consists of self-propelled toy vehicles, station sections which can be incorporated along the course of a track for the vehicle and toy objects with movable parts which can be coupled with the station sections. Each toy vehicle can be operated both in a forwards and a backwards travel direction and can be stopped in both travel directions in a defined position in order to drive the toy object at a station section. Alternative hand-operated drive means may be provided at the station sections, and the track of the station section includes a start member having a transverse slot relative to the track section, the start member being able to adopt two positions relative to the track. A stop pin on the vehicle in one position of the start member is capable of latching into the slot thereof, latching being prevented in the other position. The co-ordination of pin and driven wheels of the vehicle on the one hand, and slot and driving apparatus for the toy object on the other hand, corresponds to the defined position. Pins, for reversing the vehicle can be provided at least between forwards and backwards travel directions and are operable by devices in the station section. It is also possible to render the vehicle inoperative. Toy objects in manifold embodiments, such as merry-go-rounds, children's playground, filling station, toy clock, emergency call stand, gymnastic apparatus, etc., can be connected with the station section. Traffic signals and such like arrangements can also be used as toy objects, thereby achieving educational effects. Sounding means are disclosed.

59 Claims, 75 Drawing Figures

FIG. 2
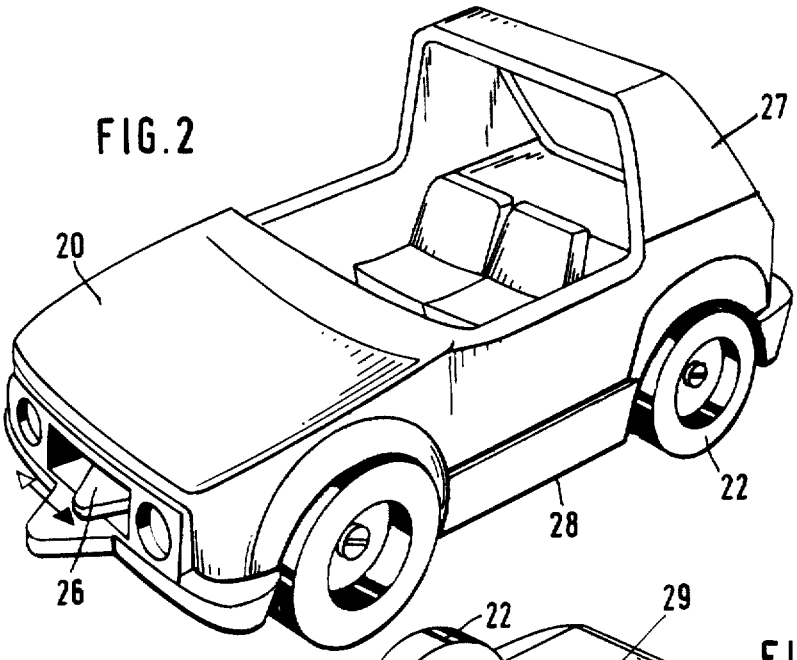
FIG. 3
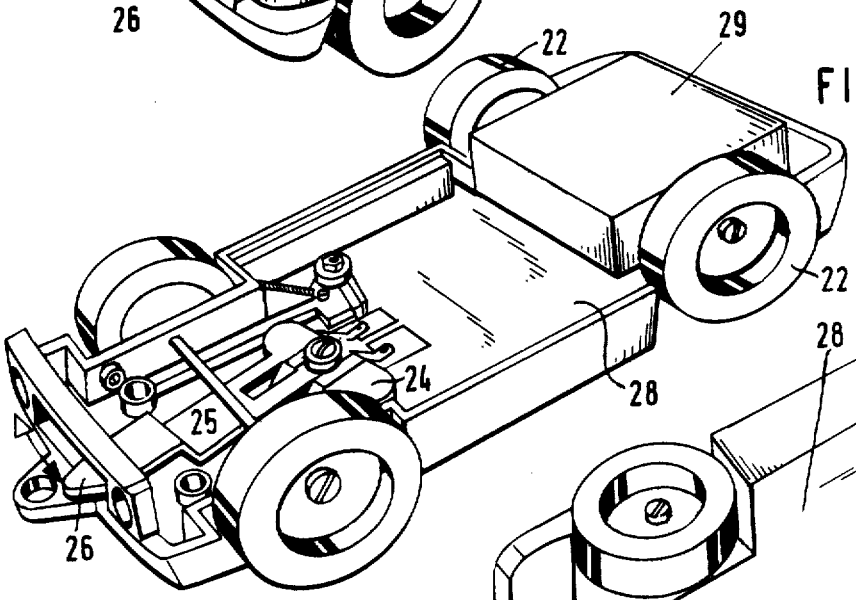
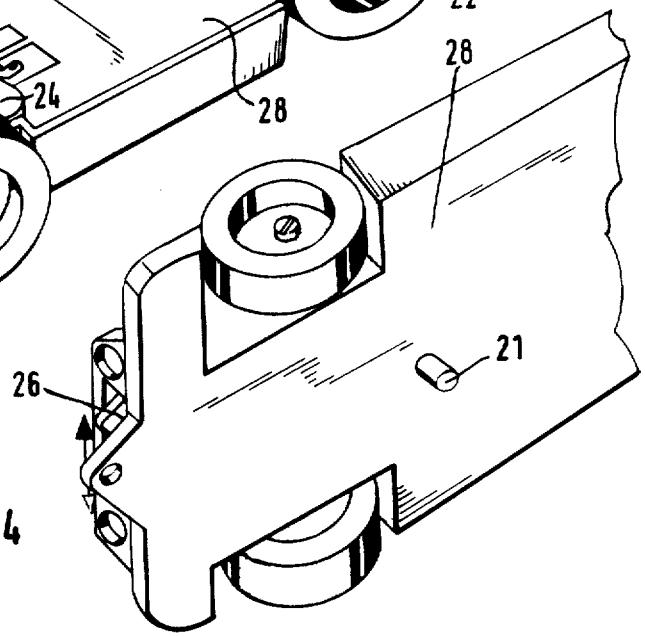
FIG. 4

FIG. 11
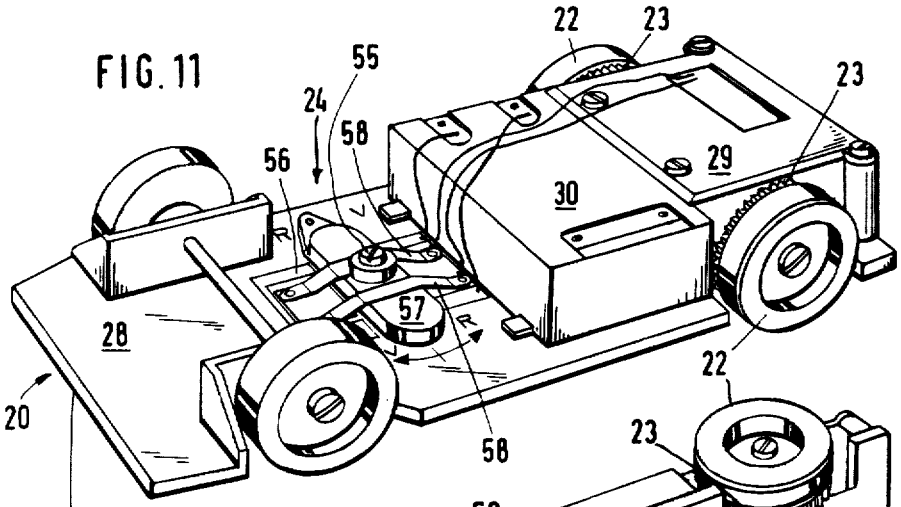
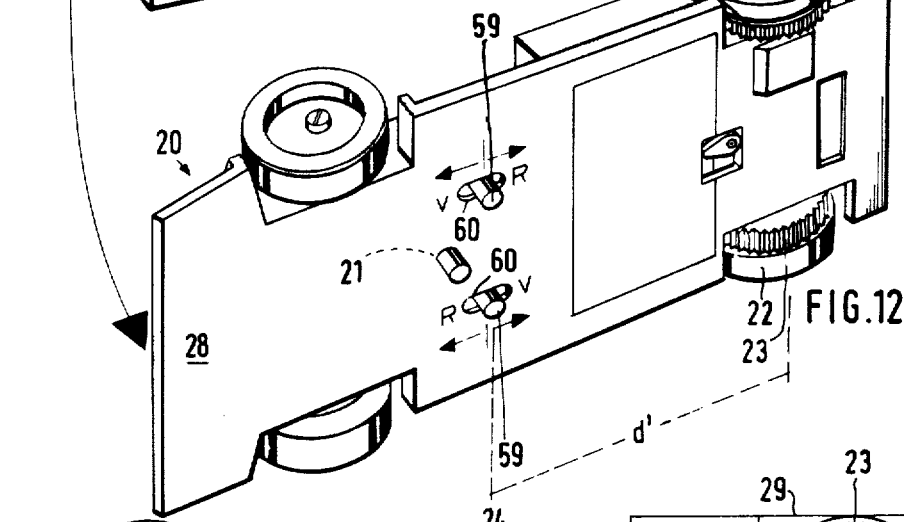
FIG. 12
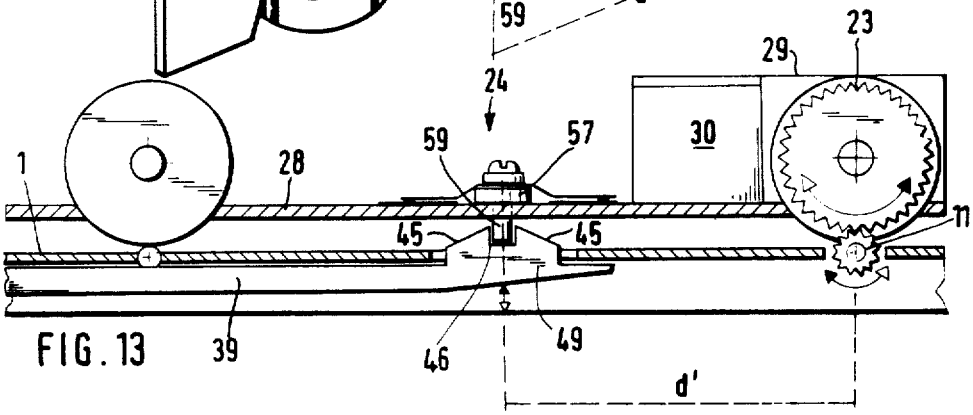
FIG. 13

FIG.14
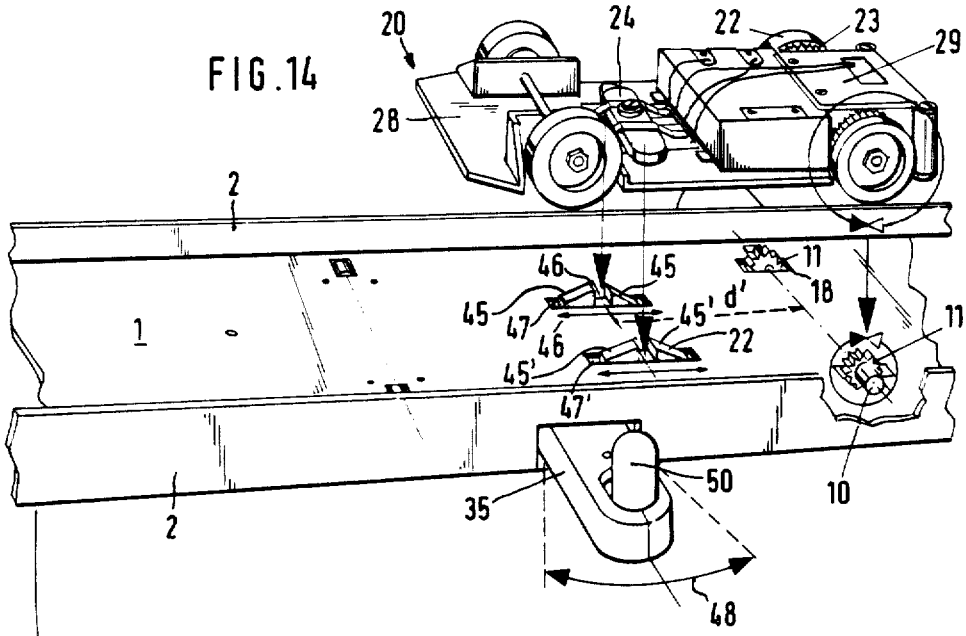
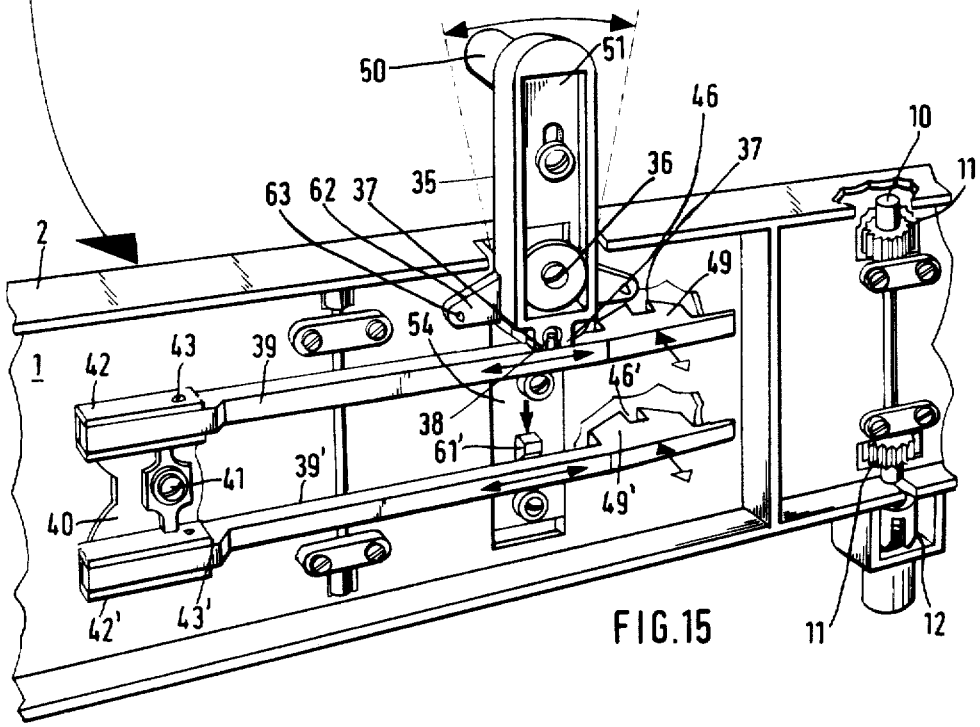
FIG.15

165
168
169
174
173
171
170
161
162
163
164
167
95
1
10
11
104
105
106
107
100
166
172
175

FIG. 65
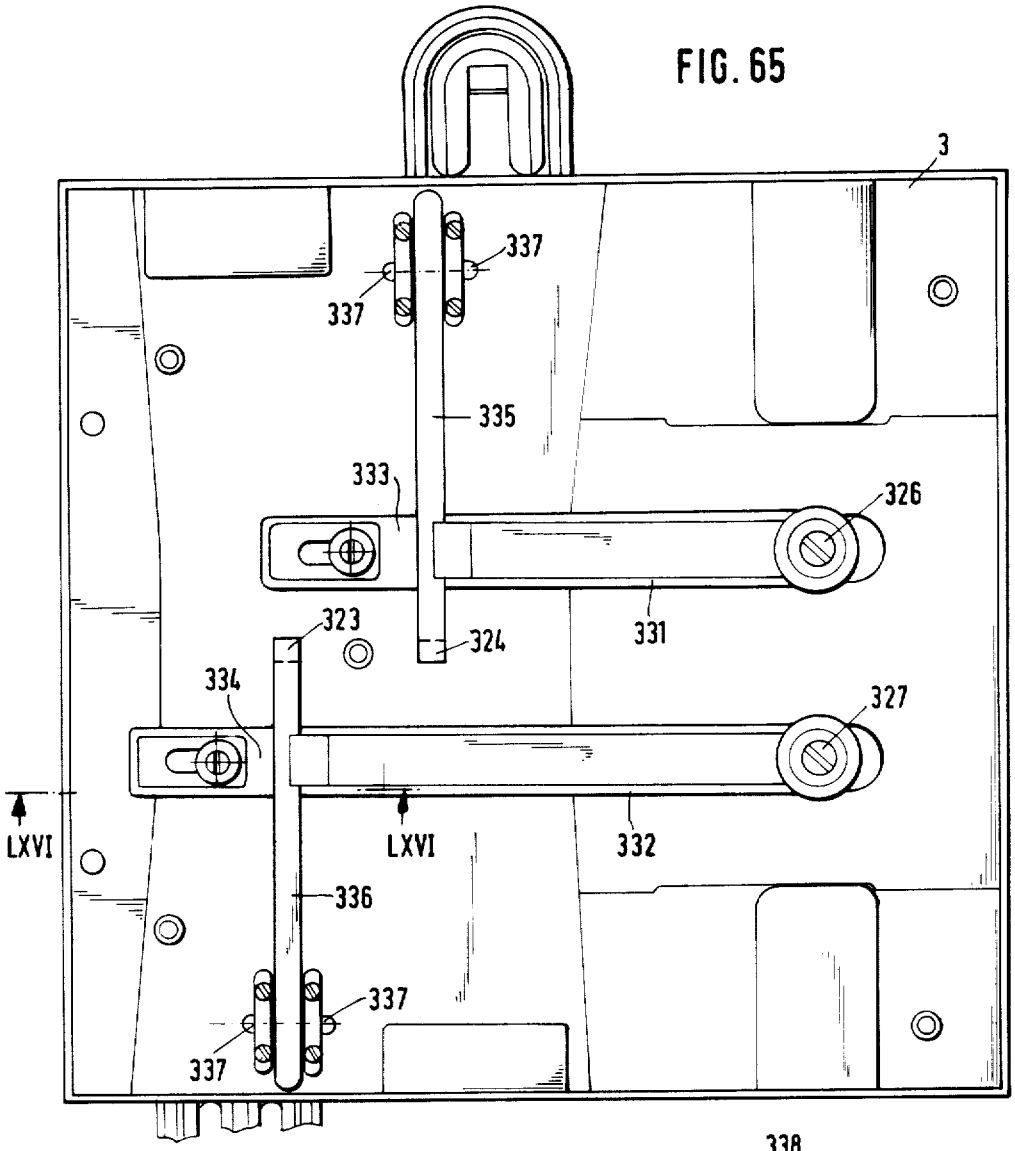
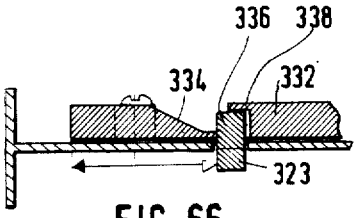
FIG. 66
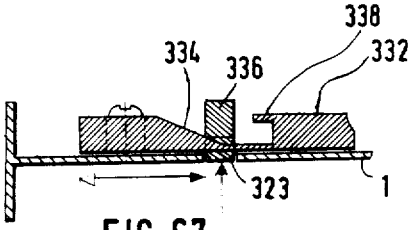
FIG. 67

MOTORIZED TOY

The present invention relates to a motorised toy with at least one toy self-propelled vehicle having a pin which projects from the vehicle and driving means which acts on at least one pair of wheels; at least one station section which can be installed in the course of a track having a stopping arrangement which can be moved by way of a lever between at least two positions and which can be brought into operative connection with the pin on the vehicle, causing it to stop in a defined position in the station section and having an axle arranged at right angles to the track and underneath the latter, with at least one rotary component which projects from the track and which can be rotated when the toy vehicle stops in the defined position by way of the latter's driven pair of wheels, there being an engagement component at one end of the axle; and at least one toy object which has movable parts and which can be connected with a station section in a fixed but detachable manner so that, by way of an engagement component, it is in contact with that of the station section whereby the movable parts can be moved by way of further engaging portions such as cog-wheels or the like via the engaging components when a toy vehicle has stopped in the station section in the defined position.

Motorised toys are known per se in which a toy vehicle stops in a station section in a defined position and acts in a defined position on an axle horizontally mounted in the station section in order to drive a toy object, such as a merry-go-round or similar, see for example German Offenlegungsschrifts Nos. 16 03 633 and 19 58 938.

These motorised toys have the disadvantage that a vehicle in the station section can only travel with forward motion in order that it can stop in the defined position. This means that the playing possibilities are severely restricted.

It is, of course, known per se that a toy vehicle can be designed so that its direction of travel can be reversed. Measures have already been indicated by means of which it is possible to reverse the direction of travel in a station section via a peg, which may be displaced transverse the direction of travel, provided on the underneath of a toy object in a station section (see German Offenlegungsschrift No. 20 51 343). In this motorised toy it is not possible to stop a vehicle in a defined position, even if the vehicle is disengaged, i.e. the contact-/gearing between the vehicle's drive device and the driven wheels is interrupted as the vehicle comes to a halt at different places according in each case to speed of travel, friction and other conditions. To overcome this problem it has been proposed (German Offenlegungsschrift No. 22 04 912) that a roof-like braking device be provided in the station section which then brakes the vehicle in a short distance when the stop position is set in the station section, i.e. the position in which the drive connection in the vehicle is broken. Even if further, additional measures are provided in order to stop the vehicle in an exactly defined position, the vehicle cannot be used to drive an external toy as this would only be possible when the drive connection is not broken. The difficulties occurring with the above-mentioned known motorised toys with connectable toy objects cannot be overcome by these means.

In the case of a further known motorised toy (German Gebrauchmuster No. 76 36 264), specially designed toy figures contained in the toy vehicle in a station section can be taken out of the toy vehicle by tilting the vehicle and placed into a toy object which can be driven from another station section by stopping the toy vehicle in a defined position. In this way, one of the toy figures leaves the toy object again and is put on to the driving toy vehicle. The toy vehicle is of a sprung construction so that when the toy figure is put into place, the top part of the toy vehicle is lowered and a projection on the toy vehicle is disengaged from a corresponding complementary projection on the toy object, whereupon the toy vehicle leaves the station section again. In the case of this known motorised toy, too, the toy vehicles may only be driven in one travel direction.

Therefore, the object of the invention is to construct a motorised toy in which numerous possibilities of playing with the toy and fitting the toy objects together are created for a child at play.

In particular, it should also be possible to operate the motorised toy with toy vehicles which have a reversible direction of travel.

Furthermore, it should also be possible to reverse the direction of travel in a station section.

Finally, toy objects should be provided which may be coupled in a motorised toy of this type.

The object is achieved according to the invention in the case of a motorised toy of the initially named type, in that the vehicle has a lever which may be moved between at least a forward and a backward travel position and which acts accordingly on the vehicle's drive means and in that the stopping arrangement of the station section comprises a check member, in the following start member having, transverse the extent of track, a slot corresponding to the dimensions of the pin on the vehicle, in which start member the pin of the vehicle engages in at least one of the positions of the lever of the stopping arrangement to stop the vehicle in the defined position, irrespective of the direction of travel, in which case in at least one other position of the lever of the stopping arrangement the pin on the vehicle and the slot in the start member are disengaged.

It is of further importance that a pin which is displaceable to reverse the direction of travel, can project from the vehicle, in which case, a corresponding constructed start member or a stop member can be used to displace the pin.

It is of further importance that toy objects of various design, preferably those which can be joined together in a series, can be connected to a station section, in which case the toy objects can be designed as a chair merry-go-round, children's playground, turntable, filling station, toy clock, tree merry-go-round, gymnastic apparatus, emergency call box, etc.

In a motorised toy according to the invention it is of particular advantage that freely selectable play possibilities to constantly stimulate the child's imagination and ways of combining the individual components are possible in a simple and sturdy manner so that the game is not boring for the child.

In this connection, it is of interest that the toy objects may also be driven in two rotational directions and, according to a special construction, may also be switched off even when the vehicle has stopped in the defined position on the station section, namely when the stop position is switched on, i.e. a position in which the drive connection between the drive means of the vehicle and the driven wheels is broken. In addition, it should be pointed out that an independent drive is also possible for at least of some of the toy obects. It should be mentioned in this connection that not only electrically driven toy vehicles, but also, for example, toy vehicles driven by spring power or similar.

It is an advantage that several children can play with a motorised toy according to the invention, in which case they can take part in the play independently of each other, for example operate the travel direction of the vehicle, the operation of the toy objects and such like.

When rotatable traffic signs are used, such as traffic lights or similar, particularly on crossing elements, educational effects can also be achieved, more particularly in respect of road safety education.

The present invention will now be described by way of example with reference to the accompanying drawings, in which:

FIGS. 2 to 4 show details of a toy vehicle;

FIGS. 11 to 13 show a special embodiment of a vehicle with changeable direction of travel;

FIGS. 14 to 22 show details of an embodiment of a combined arrangement for reversing the travel direction and stopping a vehicle;

FIGS. 40 to 55 show different embodiments of toy objects which may be used;

FIGS. 64 to 69 show an embodiment of the station section for a vehicle according to FIGS. 60 to 63.

In the various drawings, for the sake of clarity, the same reference numerals are used for those components which are the same as one another or act in the same way, even when their actual design makes different forms possible.

To begin with, the principle of the invention is described in more detail.

Quite generally, a motorised toy has in general an endless track composed of several sections of track along which a vehicle can run. The vehicle is advantageously self-propelled, i.e. has for example an electric motor or a spring power motor. The electric motor may be battery-driven, but, as is known per se, may also receive electrical power from current conductors laid along the track, this not being shown in the Figures.

As mentioned above, the track consists of different sections of track which can be connected together in constantly variable ways, for which purpose the individual track sections have complementary coupling elements (not shown). Essential for the invention is that a toy object may be additionally connected to at least one of the track sections, the toy object having movable parts which may be driven by the vehicle moving along the track when the vehicle stops at a determined point in the respective track section.

The danger in general with toys is that the play appeal is soon lost with familiarity. Therefore, a motorised toy according to the invention is designed so that new play possibilities of fitting the toy objects are constantly created, thereby exciting a child's imagination to a considerable degree. The invention is based on the knowledge that a reversal of rotational direction and/or travel direction already creates a new, constantly interesting toy for the child. For this purpose, it is necessary, as mentioned above, for the vehicle always to be capable of driving the toy objects irrespective of the travel direction (forwards or backwards).

Figure 1:
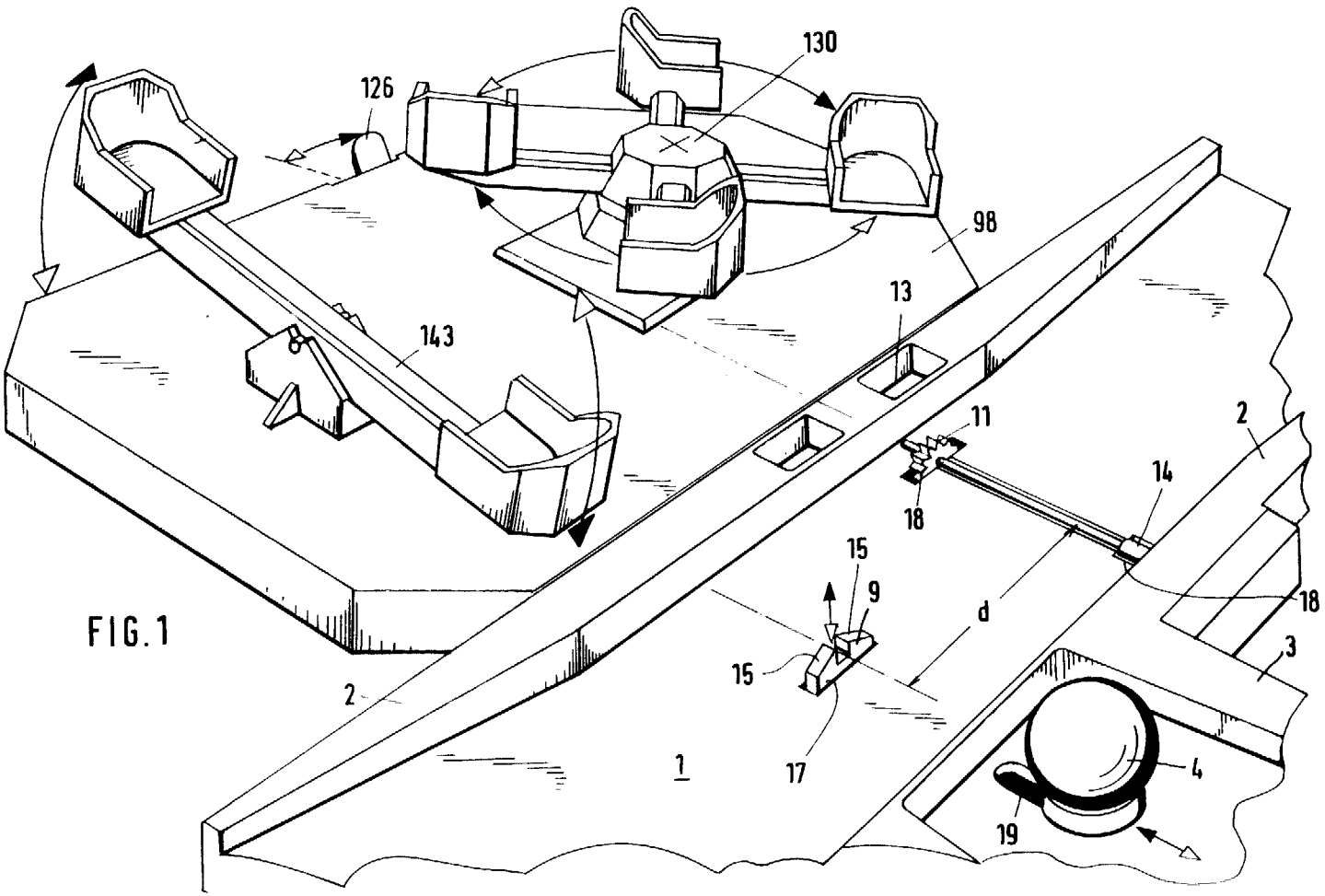
FIG. 1 shows diagrammatically and in perspective a section of part of an embodiment of a motorised toy according to the invention.

FIG. 1 shows in section an example of a motorised toy of this type designed in a special way, namely a station section with a stopping arrangement and with a connectable toy object, the appertaining vehicle being explained with reference to FIGS. 2 to 4 and the association between the vehicle and station section being explained with reference to FIGS. 5 and 6 and 7 and 8 respectively.

FIG. 1 shows the track 1 of a station section with side edges 2. Moulded on one side edge 2 is an extension 3 in which an operating knob 4 can be displaced in a guide slot 19 in the directions of the arrows. The operating knob 4 is used for actuating a stopping arrangement in the course of the track 1. On the underside of the station section, on the other side of the slot 19, the operating knob 4 is securely connected, for example by screws, to a slide bar 5 (FIG. 6) which is displaceable transverse the run of the track, for which purpose an additional guide, not described in detail, may be provided. On its section arranged roughly centrally in the track 1, the slide bar 5 has a sloping plane 6 which acts on a pivoted lever 7 which pivots in the direction of the run of the track on the underside of the station section. For this purpose, the pivoted lever 7 is hingedly attached at one end to the underside of the track via a bearing 8. At the other end, the pivoted lever has a start member 9 projecting up through a slot 17 in the track 1. The start member has two sloping inclinations 15 and also an approximately central slot 16. When the slide bar 5 is displaced by means of the operating knob 4 towards the track, the pivoted lever 7 is tilted downwards about the bearing 8 with the start member 9 so that the start member 9 is removed from the run of the track 1. When the slide bar 5 is displaced in the other direction, the start member 9 emerges upwards from the run of the track 1, as shown in detail in the figures. In the embodiment represented in FIG. 6, the pivoted lever 7 is under an initial stress so that when the slide bar 5 is moved upwards in FIG. 6, the start member 9 emerges from the track 1 on its top side. This can be achieved for example by a spring between the underside of the track and the pivoted lever 7 acting on the side of the pivoted lever 7 away from the slide bar 5. This can also be achieved by an inherent elasticity of the pivoted lever.

Obviously, the return action by spring power can also act so that the pivoted lever lowers the start member 9 from the run of track 1 as result of the spring power and that the start member is pushed upwards by means of a sloping plane on the slide bar 5, in which case obviously the sloping plane then has to act on the other side of the pivoted lever 7, i.e. from the bottom, this not being shown in detail.

Figure 9:
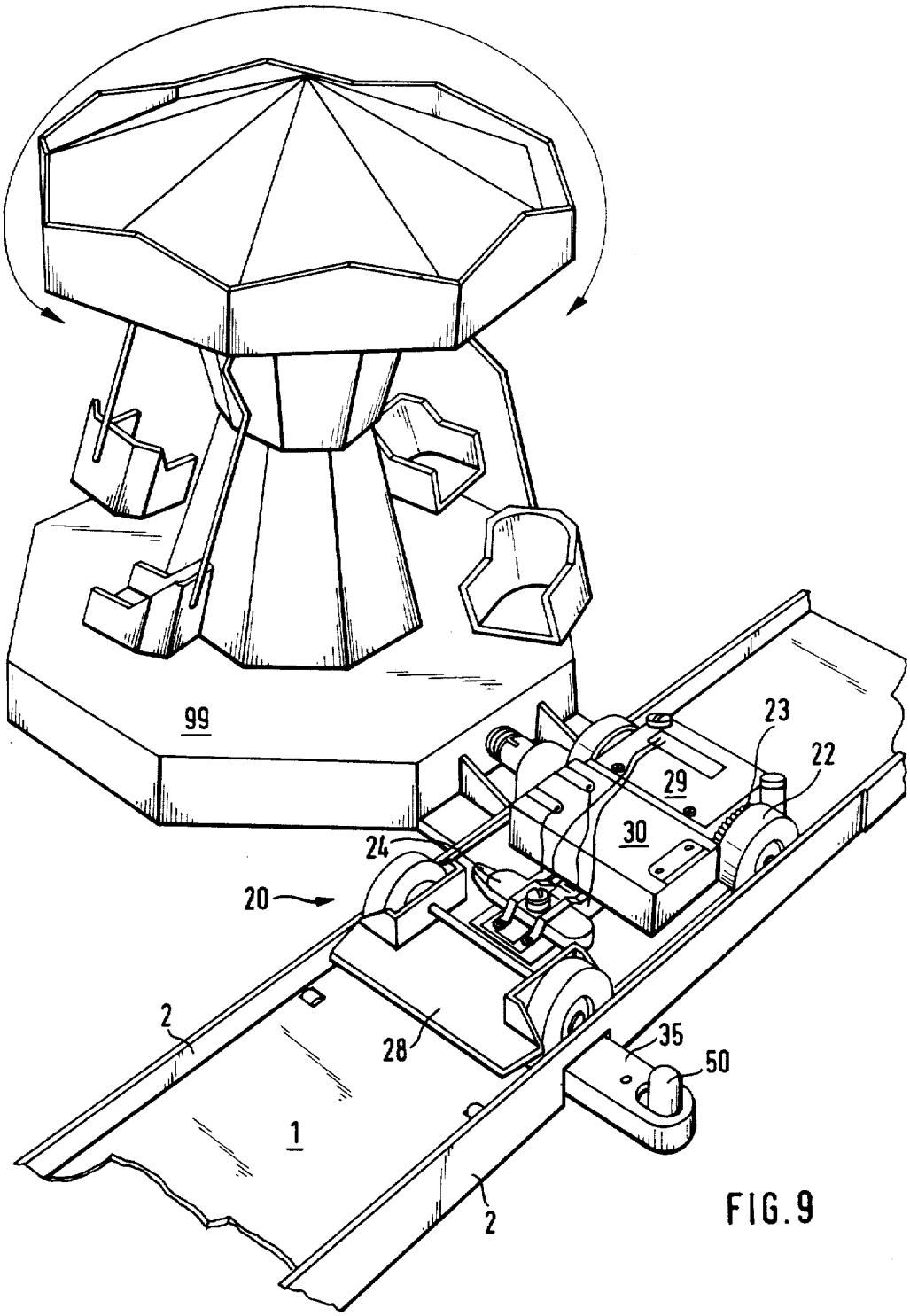
FIG. 9 shows diagrammatically part of another example of a motorised toy according to the invention.
Figure 10:
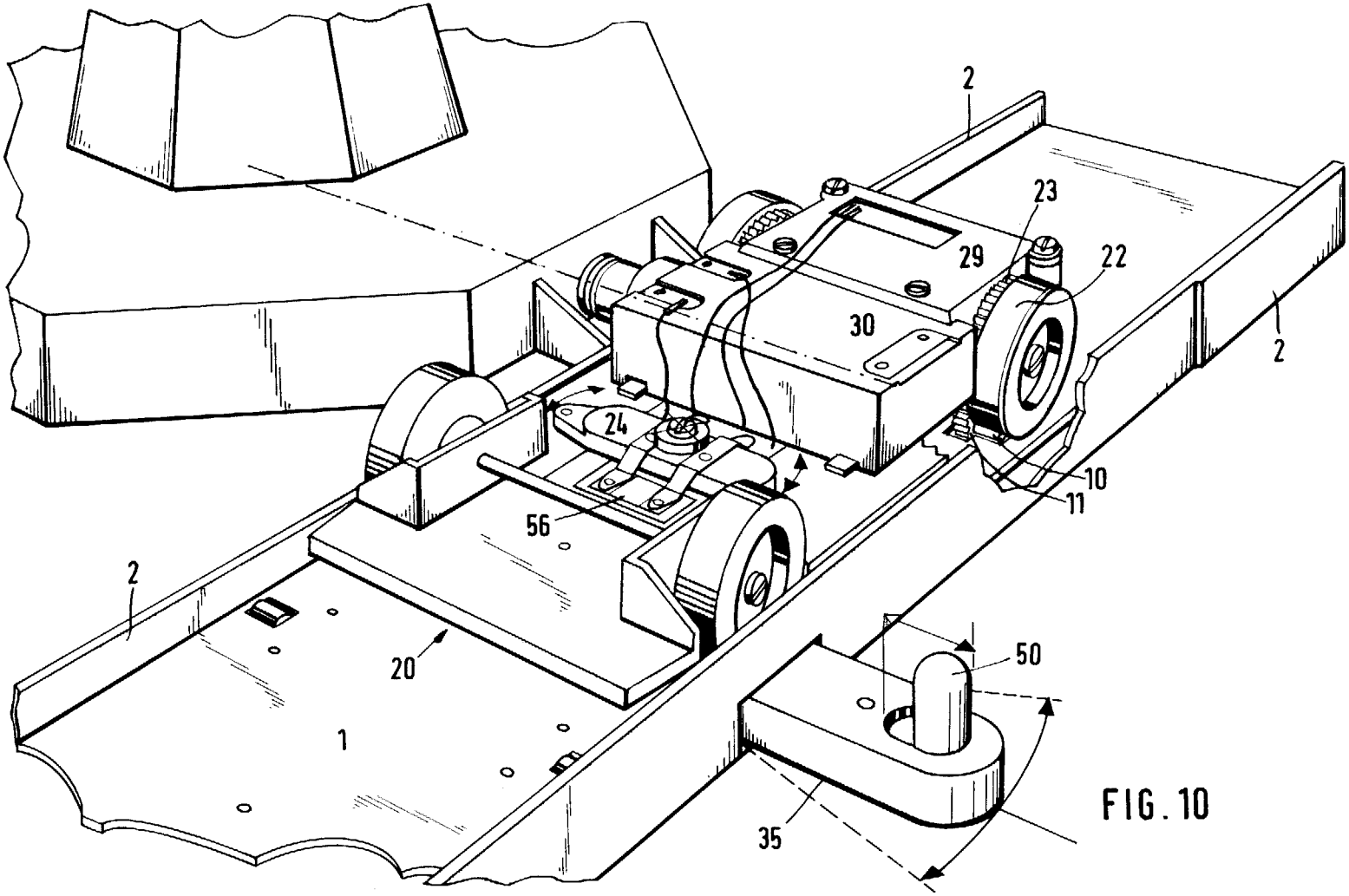
FIG. 10 shows details of the arrangement according to FIG. 9.

The stopping arrangement shown is used for stopping a vehicle 20 (FIGS. 2 to 4) in a defined position. The vehicle 20, which is shown in FIGS. 3 and 4 without a car body 27, has four wheels, of which rear wheels 22 serve as drive wheels. Within the area of the body 27 there are arranged on the chassis or underpart 28 an electric motor 29 with a battery holder 30 (FIGS. 7 and 9), and also in addition a reversal switch 24 on which a lever 25 engages, a handle 26 of which projects from the vehicle, in fact at the front end in the embodiment shown. In the embodiment shown, the reversal switch 24 may be switched over by means of handle 26 and lever 25 between at least two positions, namely a forwards position and a backwards position, in which the power emitted by the electric motor acts on the rear wheels 22 to move the vehicle 20 forwards and backwards respectively. Associated conducting components and conducting connections are not shown as these are known per se in various forms. It should be pointed out that, if necessary, a central, neutral position can also be set by means of the handle 26, in which position the reversal switch is connected so that no power is transmitted from the electric motor to the rear wheels 22 (stop position). Obviously, in addition, still more positions of the handle 26 are possible so that different drive speeds are possible for the different drive directions.

In addition, a pin 21, in the following called a stop pin, projects from the underside of the chassis 28, which stop pin has a prescribed position on the underside of the vehicle both in relation to the arrangement of the pin in the width direction of the vehicle 20 and also in respect of the distance from the rear wheels 22 of the vehicle 20. The stop pin 21 is in fact spaced from the rear wheels 22 in the vehicle direction by a prescribed, defined distance d, and this distance d may also be nil.

Furthermore, the stop pin 21 is arranged so that it engages in the slot 16, in the following called a stop slot, of the start member 9, when the start member 9 projects from the track 1. In this connection, the slot in the run of track and the pin 21 in the longitudinal direction of the vehicle 20 are of approximately the same dimensions.

Figure 5:
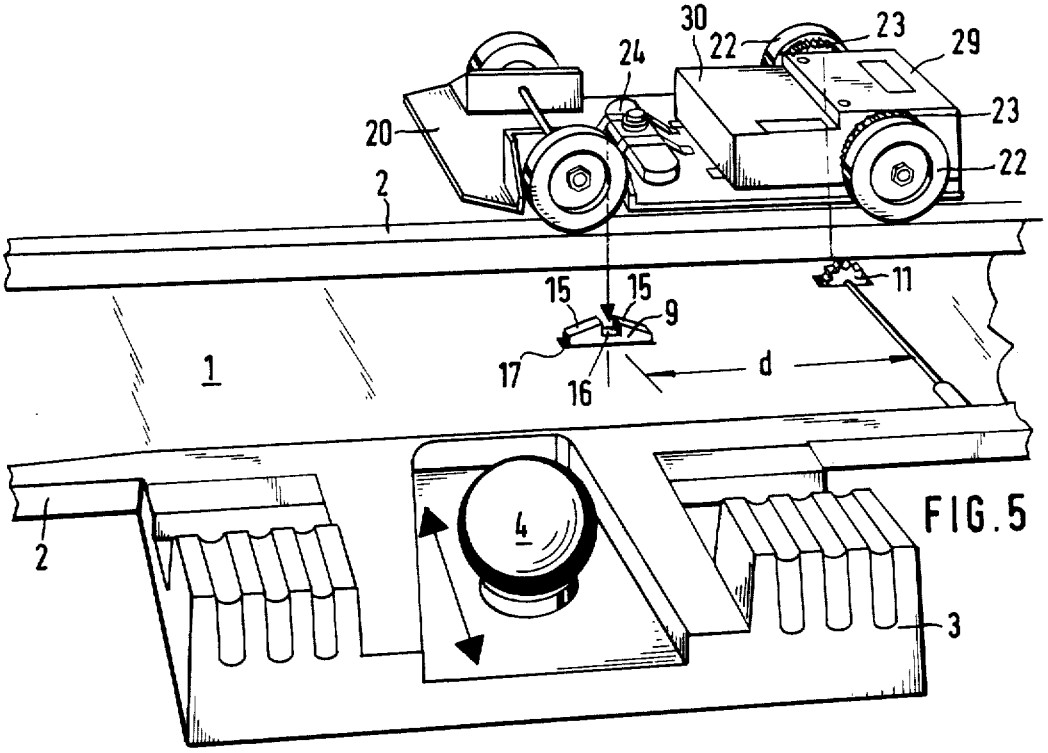
FIGS. 5 and 6 show a first embodiment of a stopping arrangement.

With the prescribed spacing, namely the same, defined, prescribed spacing d as the spacing of the stop pin 21 from the rear wheels 22 of the vehicle 20, an axle 10 is arranged spaced from the stop slot 16 in the start member 9 transverse the track and beneath this, whereby in one position corresponding to that of the rear wheels 22 on the vehicle 20 with the pin 21 engaged in the stop slot 16, a drive arrangement, namely toothed wheel(s) 11 and/or friction wheel(s) 14 projects from the track 1, through slot(s) 18 in the case of the toothed wheel(s) and through corresponding slot(s) 18 in the case of the friction wheel(s), so that it may engage with toothed wheels 23 arranged on the inside of the rear wheels and/or with the rear wheels 22 (FIG. 5).

On the end away from the extension 3 an engaging member 12 is additionally attached to the axle 10 and serves to engage in a corresponding engaging member of a connectable toy object, as is yet to be explained. On both sides of this engaging member 12, box openings 13 are provided which have an arrangement by means of which toy objects can be securely, but detachably, connected, as will also be explained in detail in the following.

The essence of the embodiment of the invention is to be seen in that when the vehicle 20 engages by means of its stop pin 21 in the stop slot 16 of the start member 9, the driving rear wheels 22 of the vehicle 20 are arranged in a defined position in which it is possible for the toothed wheel(s) 11 and/or the friction wheel(s) 14 to be driven, by means of which the engaging member 12 is turned which, in turn, can act on movable parts of a connected toy object in order to move it. If the operating knob 4 is now moved so that the start member 9 is withdrawn from the track 1, the vehicle 20 leaves the station section, whereupon the toy object ceases to move. This occurs irrespective of the travel direction of the vehicle 20, i.e. irrespective of whether the vehicle 20 enters the station section forwards or backwards, and this is still so if the distance d is chosen as nil.

Figure 6:
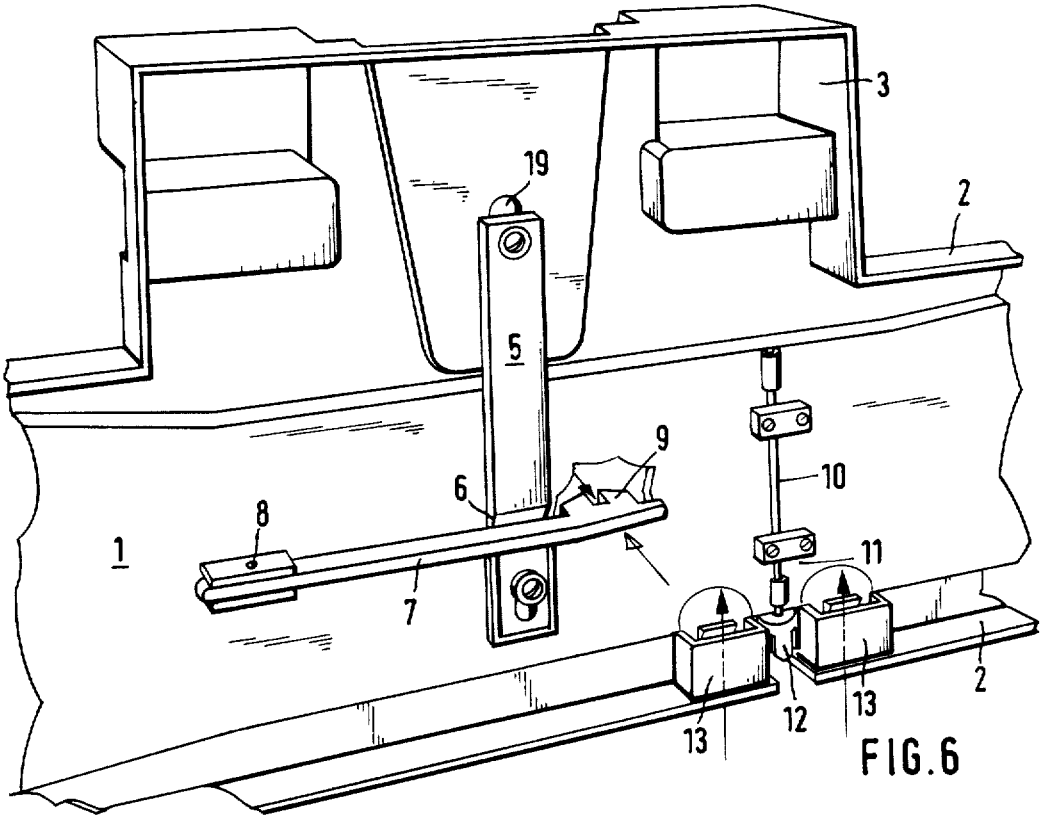
Figure 7:
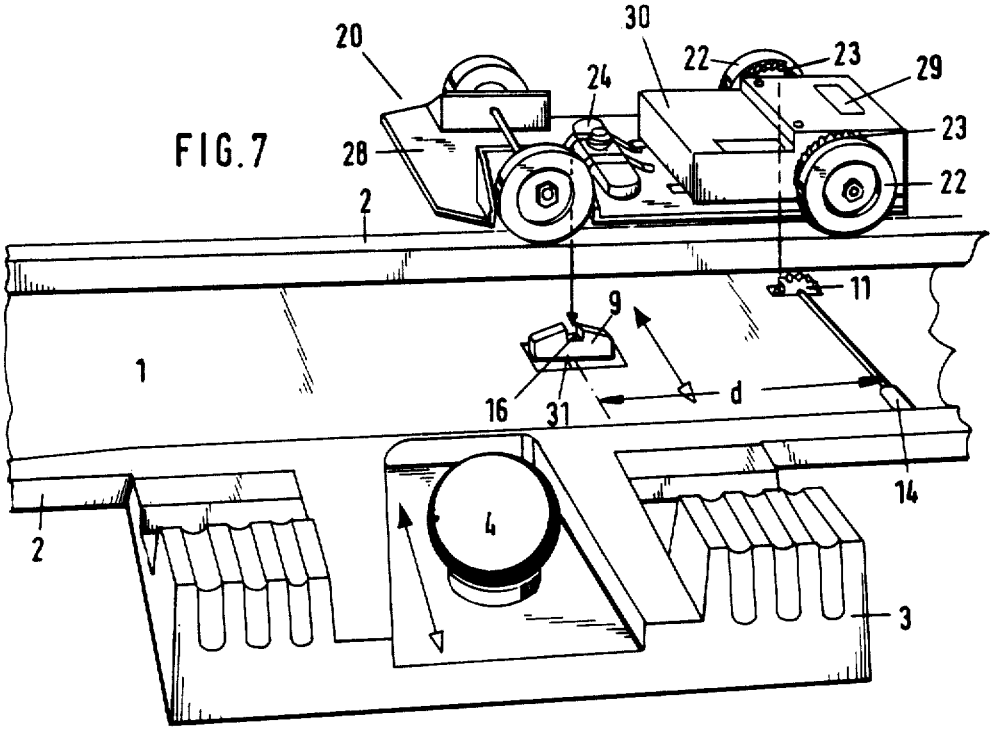
FIGS. 7 and 8 show a second embodiment of a stopping arrangement.
Figure 8:
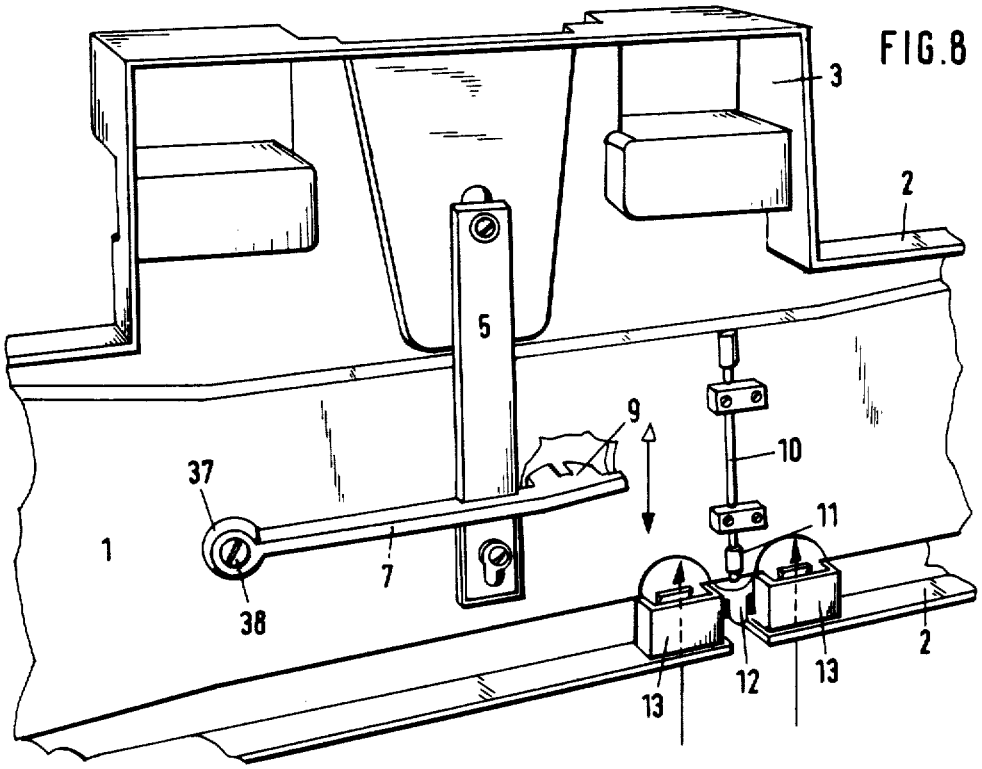

The embodiment according to FIGS. 7 and 8 differs from that according to FIGS. 5 and 6 essentially only in that the start member 9 is not tilted in and out of the track 1, but is displaced in the plane of the track 1 in the directions of the arrows. In one end position it is possible for the stop pin 21 to engage in the stop slot 16, while in the other end position it is not possible for the stop pin 21 and stop slot 16 to engage, or these disengage again respectively. In this connection, there may be two groups of vehicles, namely one group in which the stop pin 21 is designed to engage in one end position, while in the other group the stop pin 21 is arranged so that in the other end position of the start member 9 it locks in its stop slot 16. In this way a surprise effect can be achieved during play.

It can also be achieved by the stop pin 21 on the underside of the chassis 28 being displaceable between two such positions.

In order for the start member 9 attached to the pivoted lever 7 to be displaceable in the plane of the vehicle 1, this projects through a slot 31 in the track which, of necessity, must be wider then the width extent of the start member 9. The slide bar 5 engages on the pivoted lever 7 in both directions and therefore has no sloping plane or similar. The annular or fork-like end 37 of the pivoted lever 7 may be pivoted about a pin 38 on the underside of the track 1. For the rest, the station section can be designed like that according to FIGS. 5 and 6, and therefore it seems unnecessary to explain this again.

Next, an embodiment will be described in more detail, in which not only can the vehicle 20 be brought to a halt in a station section and a toy object be driven via the vehicle but in which it is also possible to reverse the travel position.

FIG. 9 again shows a station section with track 1 and edge sections 2 on which a vehicle 20 (shown without the bodywork) is arranged in a defined position, in order to drive a toy object, here a merry-go-round. Like in the above-described embodiments, a toothed wheel 23 on each rear wheel 22 of the vehicle 20 engages in the defined position in a corresponding toothed wheel 11 on an axle 10 transverse the track 1, by means of which the rear wheels 22 and the toothed wheels 23 are controlled by the drive arrangement of the vehicle 20, namely an electric motor 29 and a battery holder 30. As in the case of the above-described embodiments, a reversal switch 24 is provided which may be moved in order to change over between at least a forward travel position and a backward travel position.

The reversal switch 24 has a printed wiring board 56 located on the chassis 28 of the vehicle 20, and also a pivot part 57 which may be pivoted about a central pivot point 55, and to which contacts 58 are attached. The contacts 58 enable specific conductive connections of printed conductors on the printed wiring board 56 so that, according to the pivot position of the pivot part 57, forward or reverse drive is effected, if necessary even a neutral central position being enabled. In such a central position, the contacts 58 are positioned on at least one side on an insulating section of the printed wiring board so that the above-mentioned stop position is achieved.

In addition, the pivot part 57 has on the underside pins 59 projecting through slots 60, which pins are arranged approximately symmetrically to the pivot point 55. In this way, in the central position of the pins 59, a prescribed, defined distance d' to the rear wheels 22 and the toothed wheels 23 is guaranteed, corresponding to a prescribed distance of a corresponding engaging member in the track 1. It appears that because of the symmetrical arrangement in respect of the pivot point 55, the distance of each pin 59 from the associated rear wheel 22 is indeed different, but that their sum corresponds to double the defined distance d', by means of which the defined position for driving toy objects can be reached, as will be explained later.

As shown in FIG. 12, a stop pin 21 can also be provided on the underside of the chassis 28 as in the previously described embodiments, this stop pin then being suitable for station sections, as has been previously explained. The stop pin 21 may, however, also serve as a guide means to guide the vehicle 20 along a track, a corresponding groove then being provided in the track (not shown).

The station section is now designed so that on the one hand a reversal from for example a forwards travel direction to a backwards travel direction (V→R) can be achieved, while on the other hand it is possible to stop the vehicle 20 in the defined position (corresponding to the distance d').

Projecting out from the side wall 2 of the station section at the side there is an adjusting lever 35 which can be pivoted about a pivot axis 36 which is fixed in respect of the station section.

Figure 18:
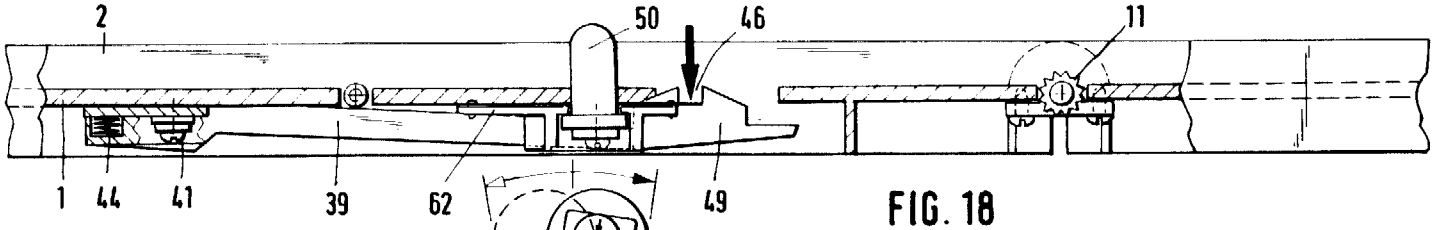

A fork-like extension 37, which engages in a lug 38 on a square bar 39, is provided on the end located inside the station section. Together with a parallel square bar 39', the square bar 39 is hingedly and rotatably mounted, on a pivoted bolster 40 which can pivot about a pivot point 41 in respect of the station section. The pivot points of the square bars 39 and 39' respectively are located on carriers 42 and 42' thereby enabling the carriers 42 and 42' to pivot in the vertical direction in FIG. 15 about pivot points 43 and 43'. As indicated in FIG. 18, a compression spring 44 is provided on the end opposite the gripping end of the lever 35 between the carrier 42 and the square bar 39 and the carrier 42' and the square bar 39', which spring constantly forces the square bars 39 and 39' to move about the pivot points 43 and 43' so that the other ends of the square bars 39 and 39' are always pressed upwards (FIG. 14). At the end opposite the carriers 42 and 42', each of the square bars 39 and 39' has a respective one of start members 49 and 49' each of which substantially corresponds to the start member 9 of the above-described embodiments. Each start member has start sloping portions 45 and a slot 46, in the following called a stop slot, transverse the track direction. The start members 49 and 49' penetrate openings 47 and 47' respectively in the track 1 and, as a result of the force of the spring 44, each projects upwards from the track 1, as shown in FIG. 14.

If a vehicle 20 with the pins 59 enters the station section according to FIGS. 11 and 12, the pins 59 engage in the corresponding slots 46 so that the vehicle is forced to come to a halt. As a result of the defined distance d' between the stop slots 46 and the axle 10 on the one hand, and also the pins 59 and the rear wheels 22 on the other hand, the defined position is reached in which the rear wheels 22 and the associated toothed wheels 23 can act on the axle 10, more particularly its toothed wheels 11, and turn the engaging member 12 which is used for driving movable parts in a connectable toy object, as explained later. By tilting the lever 35 according to the arrow 48, the square bars are pivoted about the pivot point 41, whereby they are guided in the slots 47 and 47' via the start members 49 and 49' so that the pins 59 may be mutually displaced in a complementary manner, whereupon the positions indicated in FIG. 12 for forwards travel position (V) and backwards travel position (R) or an intermediate neutral position can be set as selected. That is, the travel position can be adjusted via the lever 35, namely into a position in which the rear wheels act to drive a toy object, such that the direction of rotation of the toy object can also be reversed.

As in the previous embodiments, this is completely unaffected by whether the vehicle 20 enters the station section forwards or backwards. As already mentioned, it is also unaffected, when the defined distance d' is selected at zero, by the travel direction in which the vehicle is driven. The pins 59 travel over the start members 49 and 49' along the start sloping portions 45 and 45', that is counter to the spring force of the compression spring 44, the pins 59 then locking in the stop slots 46 and 46'.

In order to release the locking position, i.e. so that the vehicle 20 can travel further, the start members 49 and 49' must be lowered again as in the above-described embodiment. For this purpose, an adjusting knob 50 is additionally provided which acts on a slide 51 which acts via a forked engaging member 52 (FIGS. 20 to 22) on a flange 53 which is arranged on a slide 54 which may be displaced transverse the travel direction. On the slide 54, there are downwardly projecting sloping planes 61 and 61' which, in one position of the slide 51 and thus of the slide 54, press down the square bars 39 and 39' respectively so as to release the contact between the stop pins 59 and the stop slots 46 and 46', in a similar way as has already been described. In the other position, the sloping planes 61 and 61' are disengaged from the square bars 39 and 39' such that, as a result of the spring force of the compression spring 44, the start members 49 and 49' project up from the track 1 through the slots 47 and 47' and are thus ready to receive stop pins 59.

Figure 16:
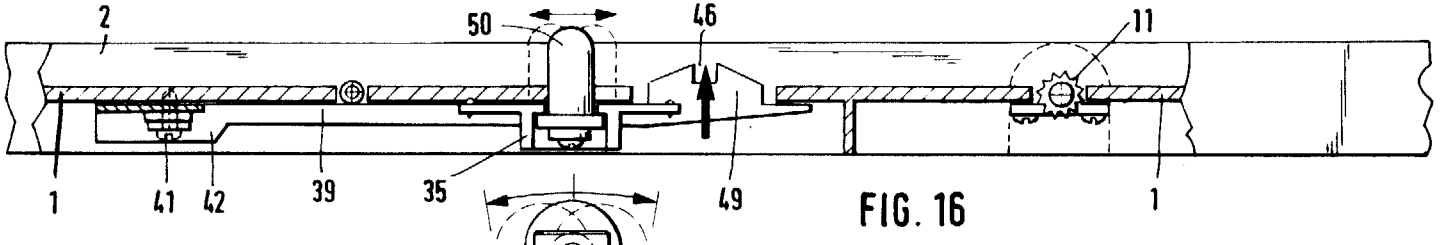
Figure 17:
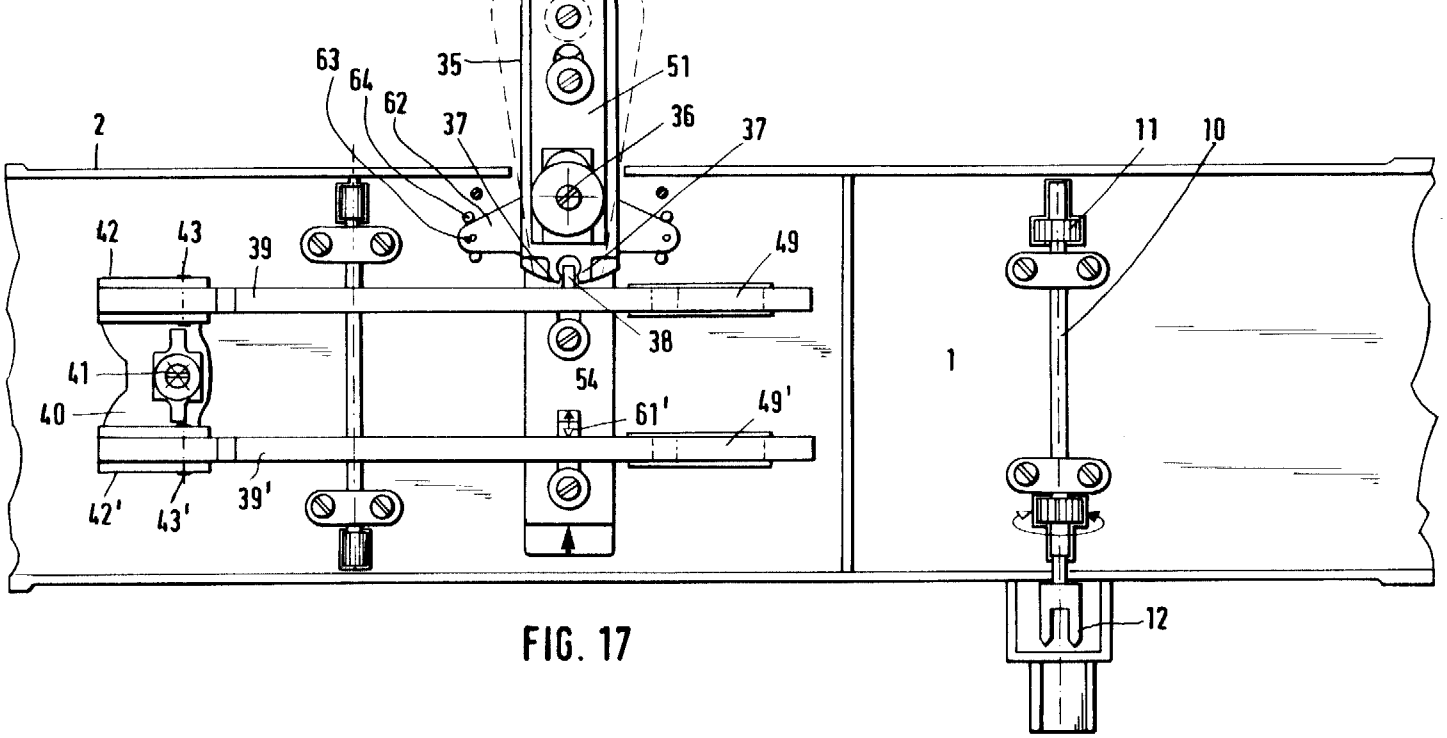
Figure 19:
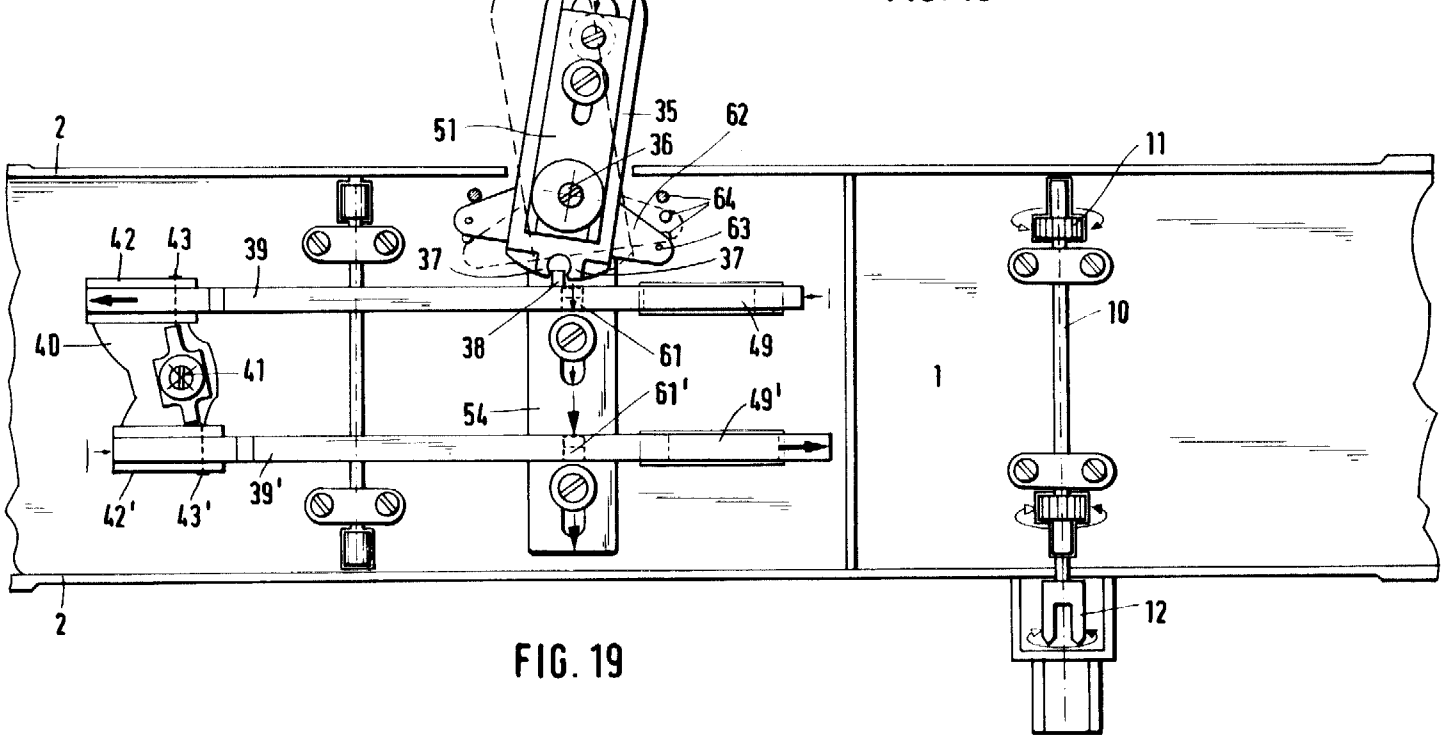
Figure 20:
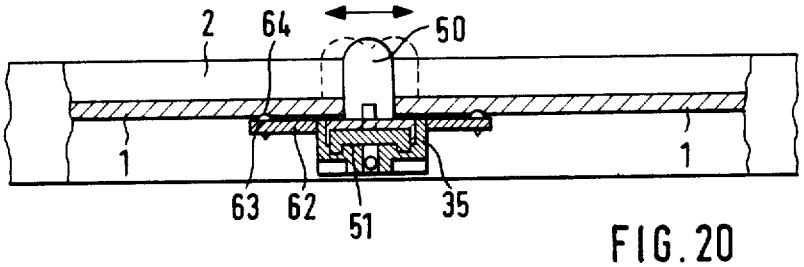
Figure 21:
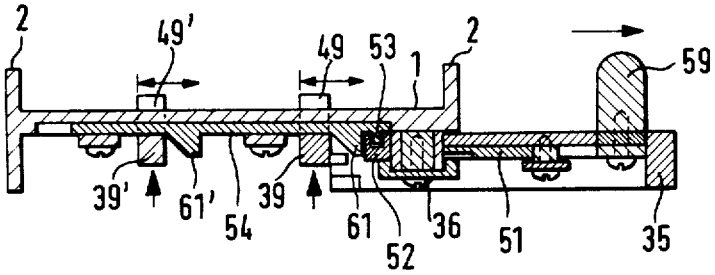
Figure 22:
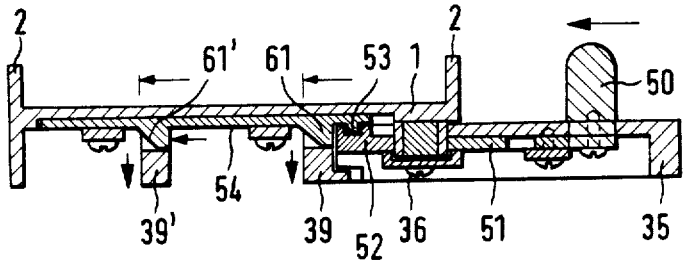
Figure 25:
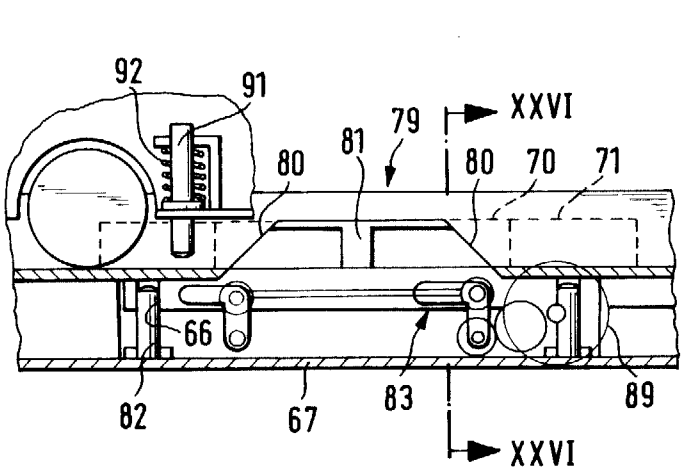
FIGS. 23 to 29 show another embodiment with combined control of the reversal of travel direction and stopping a vehicle.
Figure 26:
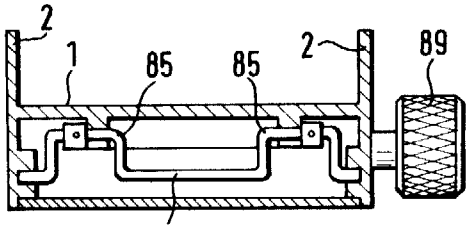
Figure 23:
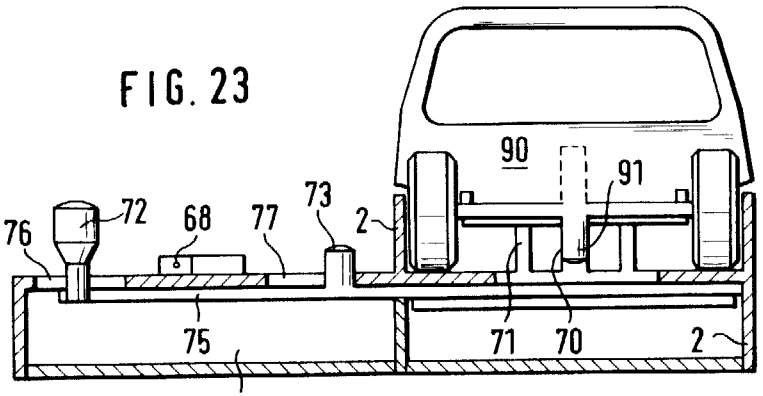
Figure 24:
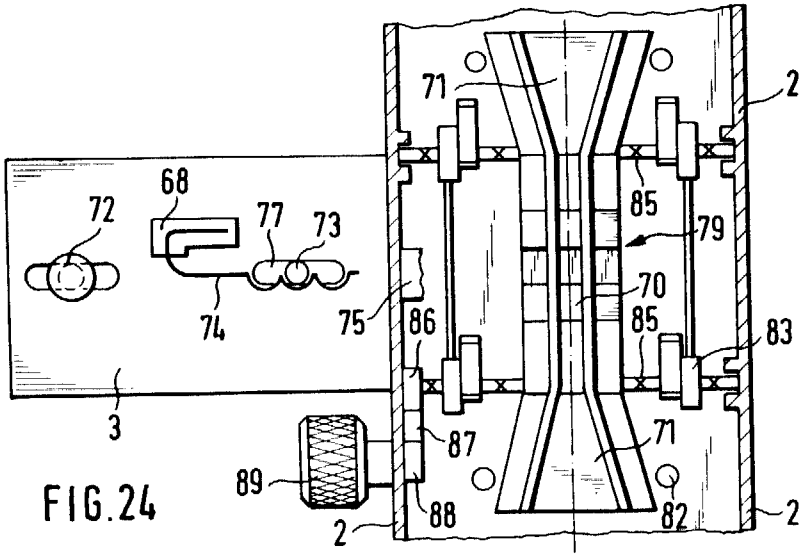

The different positions of the individually described components, more particularly the stop positions and the release positions of the start members are shown in detail in FIGS. 16 to 22, FIG. 16 being a side view with the side wall 2 removed and FIG. 17 a view from below of a position in which the start members 49 and 49' project out of the track 1 and a neutral position is reached for the slots, while according to FIGS. 18 and 19, which show similar views to those of FIGS. 16 and 17, the start members 49 49' are retracted from the track 1 on the one hand and on the other the travel position is reversed. FIG. 20 shows a section through the lever 35 and the slide 51, FIGS. 21 and 22 show cross-sections through the track and lever 35 and the slide arrangement respectively in positions corresponding to FIGS. 16 and 18 respectively. In addition, a further measure is represented by means of which locked-in positions can be achieved for the dfferent travel positions. For this purpose, the lever 35 has vaned projections 62 projecting up from which are pins 63 which are able to lock in corresponding recesses 64 in the underside of the track 1. These recesses 64 correspond to the positions to be assumed by the pins 59 for the various travel positions (forwards position, stop position, backwards position) in order to achieve a corresponding action on the drive (electric motor 29, battery holder 30) via the reversal switch 24.

A further embodiment of a station section in which it is possible both to reverse the travel directions of a vehicle 90 and also to bring the vehicle to a halt in the defined position will be explained in detail with reference to FIGS. 23 to 29. In this embodiment, the vehicle 90 has a single, downwardly projecting pin 91 which may be displaced transversely to the vehicle, i.e. approximately parallel to its axis, in at least two, preferably three, positions, namely a forwards travel position, a stop position and a backwards travel position. Moreover, the pin 91 also performs the function of the stop pin 21 of the previously explained vehicles, i.e. it is used to bring the vehicle 90 to a halt via a corresponding stop slot of a start member, as will be explained later. The pin 91 acts to cross-adjust a reversal switch, not shown in detail, in the vehicle 90 via which the drive arrangement for the drive wheels, more particularly the rear wheels, is achieved.

In the track 1 an opening 69 is provided projecting up through which is a guide rail 70 which is approximately U-shaped in cross section and has inlet funnels 71 at both ends. The spacing of the two side walls of the guide rail 70 corresponds in the middle region to the dimensions of the pin 91 on the vehicle 90. By means of an operating knob 72 provided on projection 3 of the station section, the guide rail 70 with its inlet funnels 71 can be displaced transversely to the stretch of track. The operating knob 72 is connected via a slide 75 (FIG. 23) to the guide rail 70 and the inlet funnels 71 respectively and guided in a slot 76 of the projection 3. A projection 73 projects up from the slide 75 through a further slot 77 in the projection 3, in which a further guide is achieved, and in addition via a suitably shaped leaf spring 74, the locked positions can be reached for the slide 75 and thus the guide rail 70. The leaf spring 74 is held in a block 68 which is provided on the top of the projection 3.

In an arriving vehicle 90, its pin 91 is set according to the position of the guide rail 70, in which case the preceding position may be optional, as the pin 91 is caught via the inlet funnels 71.

Approximately centrally in the guide rail 70 in the opening 69 a start member 79 is provided which has start sloping portions 80 and also an approximately central slot 81 extending transverse the travel direction, which slot is designed to receive the pin 91 of the vehicle 90, i.e. serves as a stop slot. The pin 91 may lock resiliently by means of a spring 92.

Figures 27, 28:
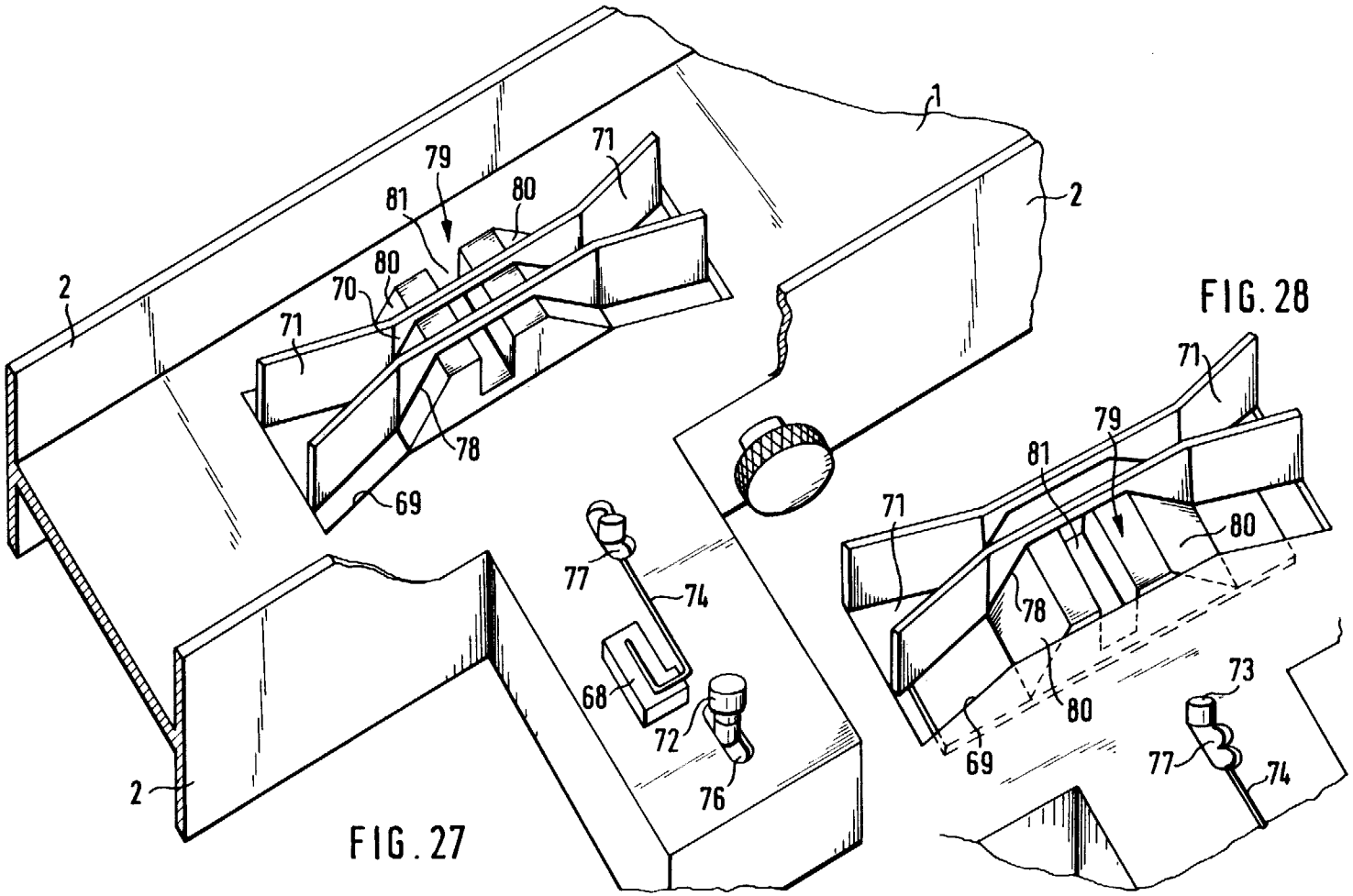
Figure 29:
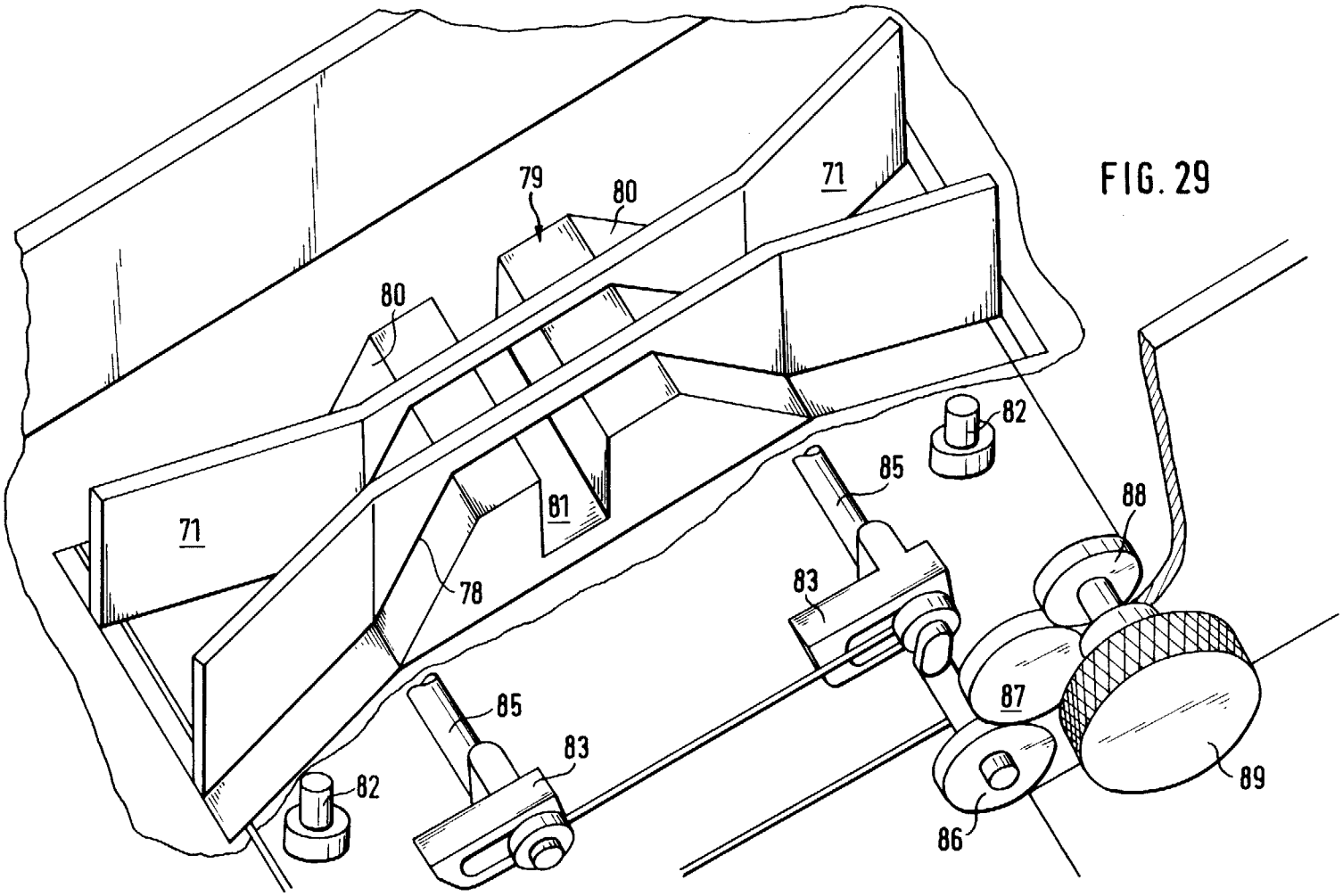

Irrespective of the position of the guide rail 70 at the time, the position of the start member 79 can be altered, that is it may be raised from the track 1 in one position (for example FIG. 27) and in the other position be lowered into the track, i.e. below the slot 69 (for example FIG. 28). Consequently, the start member 79, as shown particularly in FIG. 28, is provided in a notch 78 in the guide rail 70. In the vertical direction, guide pins 82 are provided in the station section, which pins engage in corresponding recesses 66 of the start member 79 and along which the start member 79 can be moved vertically. This movement can act in a manner known per se counter to the force of a spring which acts between the track 1 or the base surface 67 of the station section and the start member 79, the start member 79 being adjustable by means of a lever. An embodiment of this type is not shown in detail.

An embodiment is shown, however, with a control knob 89 which projects out of one of the side edges 2, preferably that edge on which the projection 3 also projects out, and which may be turned between two positions. Via mating toothed wheels 88, 87 and 86, the control knob 89 acts on a first crank 85 bent at right angles twice whose central U-shaped section 84 acts on the start member 79 from below and, according in each case to the control position of the control knob 89, pushes it upwards out from the track 1 or keeps it lowered in the lower position so that the start member 79 does not project from the track 1 (see FIG. 28). A further crank 85, likewise of a double right-angled design, can be adjusted via a link control 83 which is known per se, the crank acting in the same way on the other end of the start member 79 so as to ensure a reliable raising and lowering of the start member 79 along the guide pins 82.

It is evident that it is also possible to have a single lever control such that a single lever is provided in the extension 3 which is rotatable and tiltable on the one hand and thus acts to raise and lower the start member 79 and on the other hand is displaceable transversely to the run of the track and thus achieves the displacement of the guide rail 70.

Even though it has not been shown in the above embodiment, the track 1 obviously has an axle 10 and toothed wheels 11 which are at the prescribed, defined distance from the stop slot 81 of the start member 79, this distance corresponding to the distance of the stop pin 91 of the vehicle 90 from its driven wheels.

A detailed description now follows of toy objects which may be connected to the station section and may be driven by a vehicle at a halt in the station section. The description makes reference to a station section such as that described in detail with reference in particular to FIG. 1, although, of course, the other embodiments of station sections may also be used.

Figure 30:
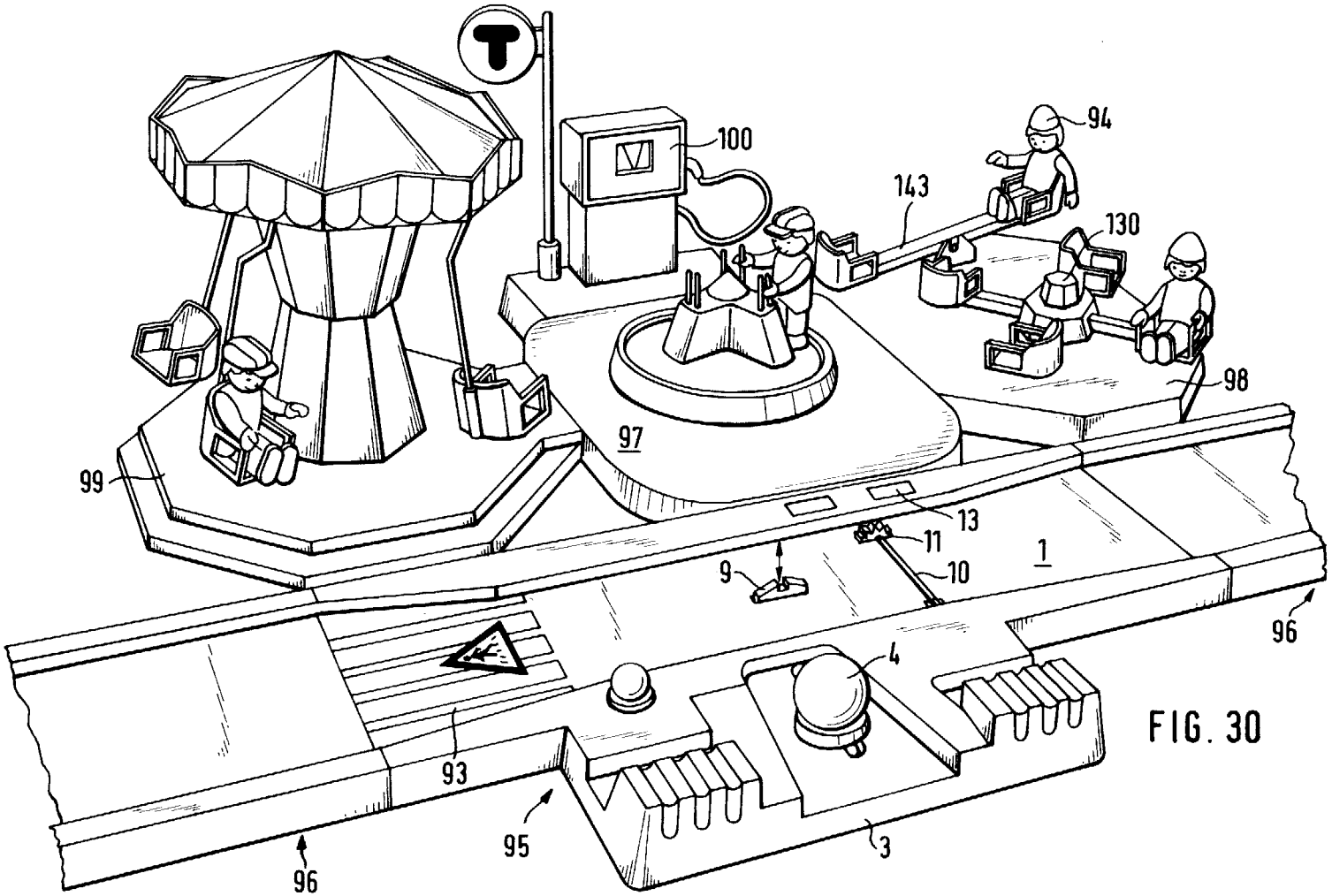
FIG. 30 shows a diagrammatic representation of the association of different toy objects with a station section.
Figure 31:
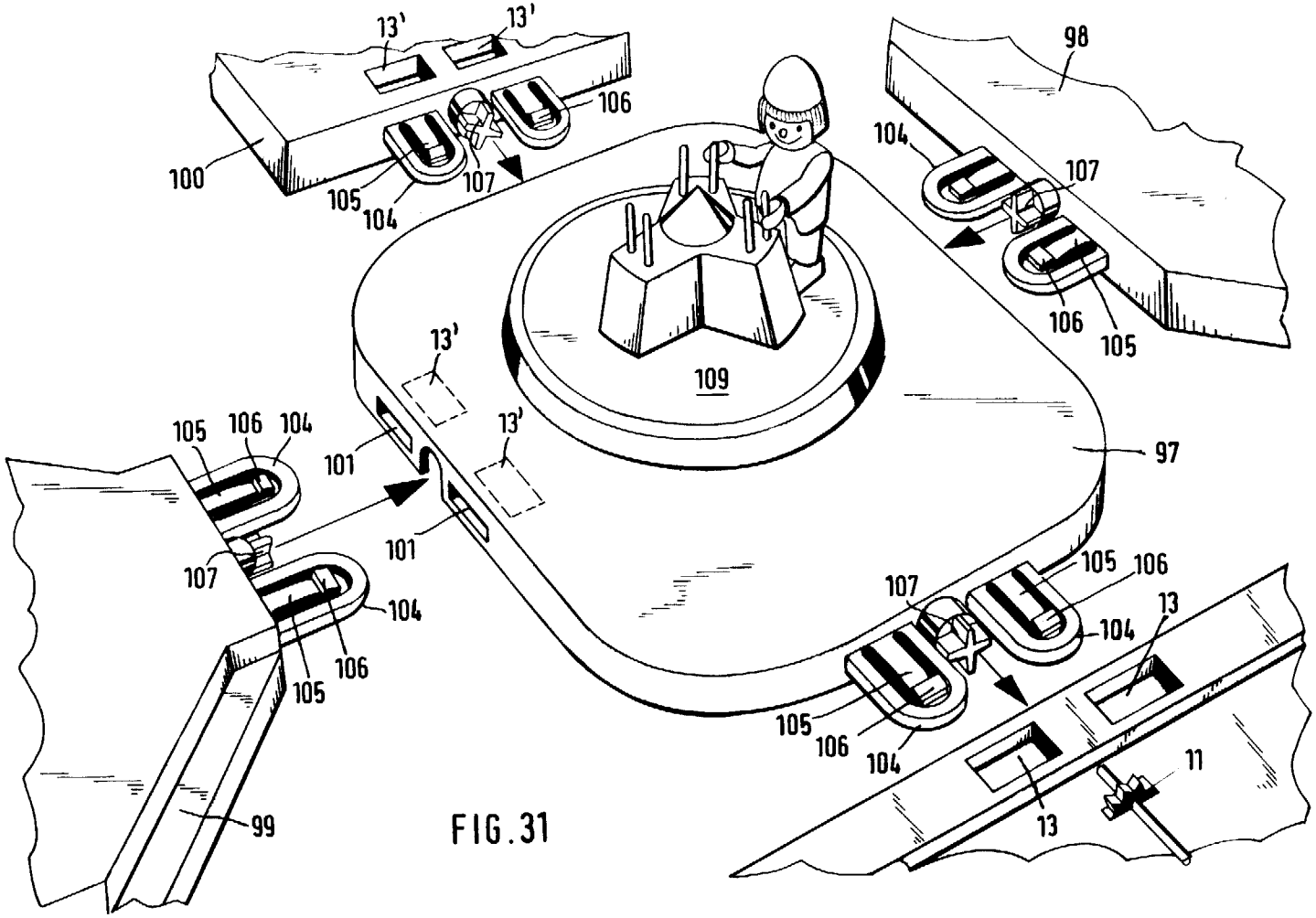
FIGS. 31 and 32 show details of the arrangement according to FIG. 30.
Figure 32:
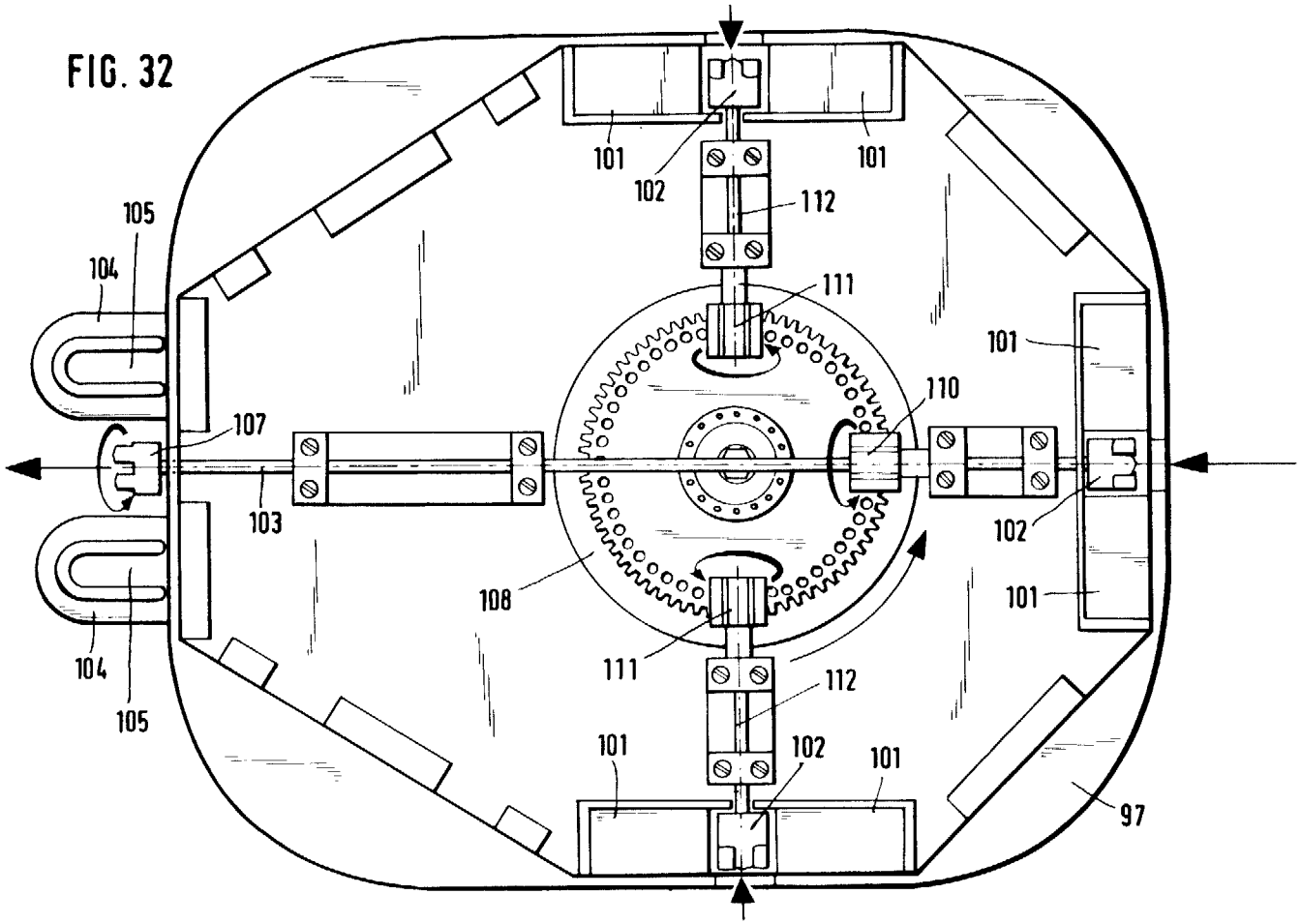

FIG. 30 shows part of a motorised toy with sections of track 96 joined together in a line, a station section 95 of a special design being additionally arranged between two sections of track 96. There is no detailed representation of the coupling of these sections of track, which may be effected in any of the usual ways and is not therefore described in more detail. The station section 95 is of substantially the same design as that shown in FIG. 1. It merely has the additional markings 93 which indicate a pedestrian crossing. As will be explained later in more detail, a toy object designed as a turntable 97 is connected to the station section 95 in the region of the box openings 13, i.e. in the region of the axle 10 and the toothed wheels 11, and other toy objects, such as a children's playground toy 98, a chair merry-go-round toy 99 and a filling station toy 100, may also be connected to the turntable toy object 97 serving as a central distributor element. In addition, toy figures are shown which can be arranged in the toy objects. The toy figures can be fixed permanently, or they may be removable and therefore the child can play at putting the figures on and off.

Obviously, other toy objects can also be connected and can be connected individually to a station section or can themselves form a central toy object acting as a distibutor. Also, an element may be provided the sole function of which is as a distributor, but which is also advantageously designed as a toy object, especially as it contains inside movable parts. The turntable toy 97, which acts as a distributor, may also have on at least one of its sides box openings 13', corresponding to the box openings 13 of the station section 95. In any case it has coupling openings 101 and also engaging members 102, these engaging members 102 corresponding to the engaging member 12 of the station section 95 which is connected with the axle 10. Points on the toy objects 97 designed in this way can be designated as outputs for rotary movement. Each toy object 97 to 100 also has another input for rotary movement. There, mechanical coupling members are provided on the one hand for engaging in the coupling openings 101 and engaging members are provided on the other hand for the rotary movement, which members may be brought to engage rotationally with the rotatable engaging members 102 and 12 respectively, and are connected with an axle, such as the axle 103 in the toy object 97.

Figure 39:
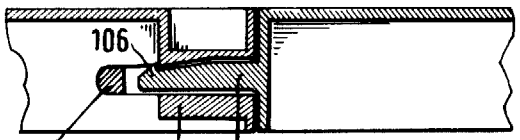

The mechanical coupling members are formed by U-shaped pegs 104 and also tongue-like projections 105 with hooks 106, which members may be inserted into the coupling openings 101 and locked there by means of the hooks 106, as shown for example in FIG. 39.

The axle 103, which is mounted on the underside of the base 104 of the toy object 97 in a manner known per se and therefore not explained in more detail, carries, in the region between the mechanical coupling members 104 to 106, the complementary engaging member 107 for the engaging members 12.

In the embodiments shown, engaging member 12 on the one hand and engaging member 107 on the other are designed so that they mesh together at their end faces, one of them, namely the engaging member 12, being of a cage-like design and cross-pieces on the complementary engaging member 107 can engage in the cage slots.

Figures 35, 36:
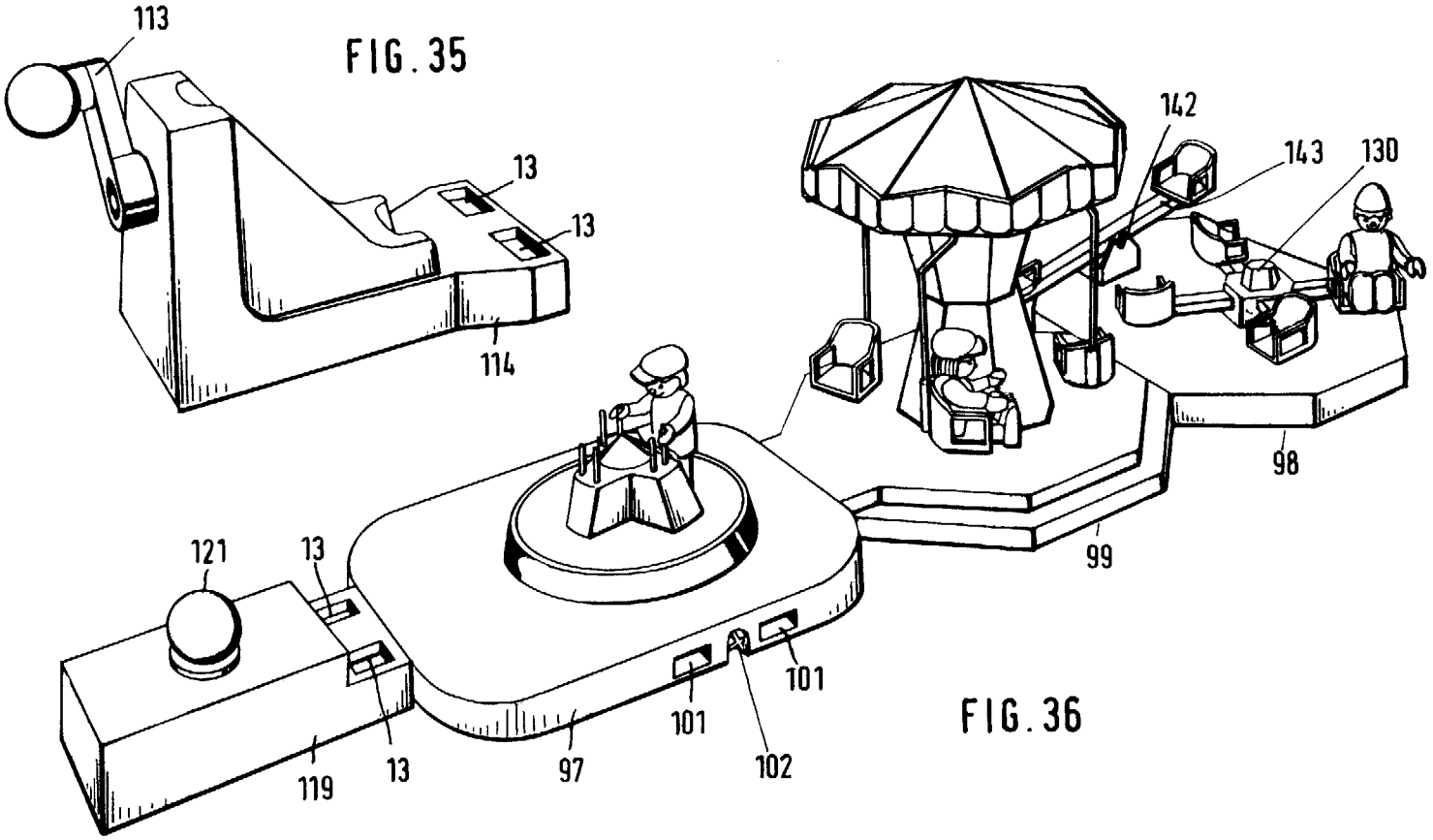
Figure 37:
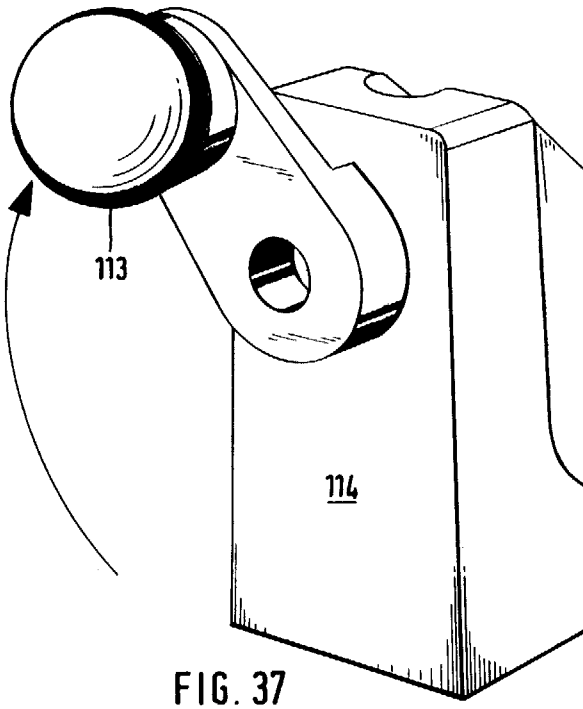

The toy object 97 carries approximately in its centre a crown wheel 108 rotatable about a vertical axis, which wheel is in operative connection with the turntable 109 on the visible side of the toy 97. The axle 103 carries a pinion 110 which meshes with the crown wheel 108, whereupon, by the turning of the engaging member 107 as a result of the engagement in engaging member 12, which is itself turning, in the station section 95, the crown wheel 108 and thus the turntable 109 are turned. Also, further pinions 111 mesh with the crown wheel 108, which pinions are connected with axles 112 mounted on the base 104 of the toy object 97 in a manner known per se and which are themselves connected at the other end with engaging members 102, each of which by engaging with a corresponding complementary engaging member 107 of another toy object, can drive this toy object. Also, in the toy object 97, the axle 103 is extended out via the pinion 110 and is mounted in the base 104, and also carries an engaging member 102 at the other end, to which another toy object can be coupled. This type of basic design of the toy objects also enables the toy objects, such as that shown in FIG. 37, to be driven independently of a station section 95. For this purpose, either a crank handle (FIG. 35) or an electric motor (FIG. 34) can be used to drive at least one toy object.

Figures 33, 34:
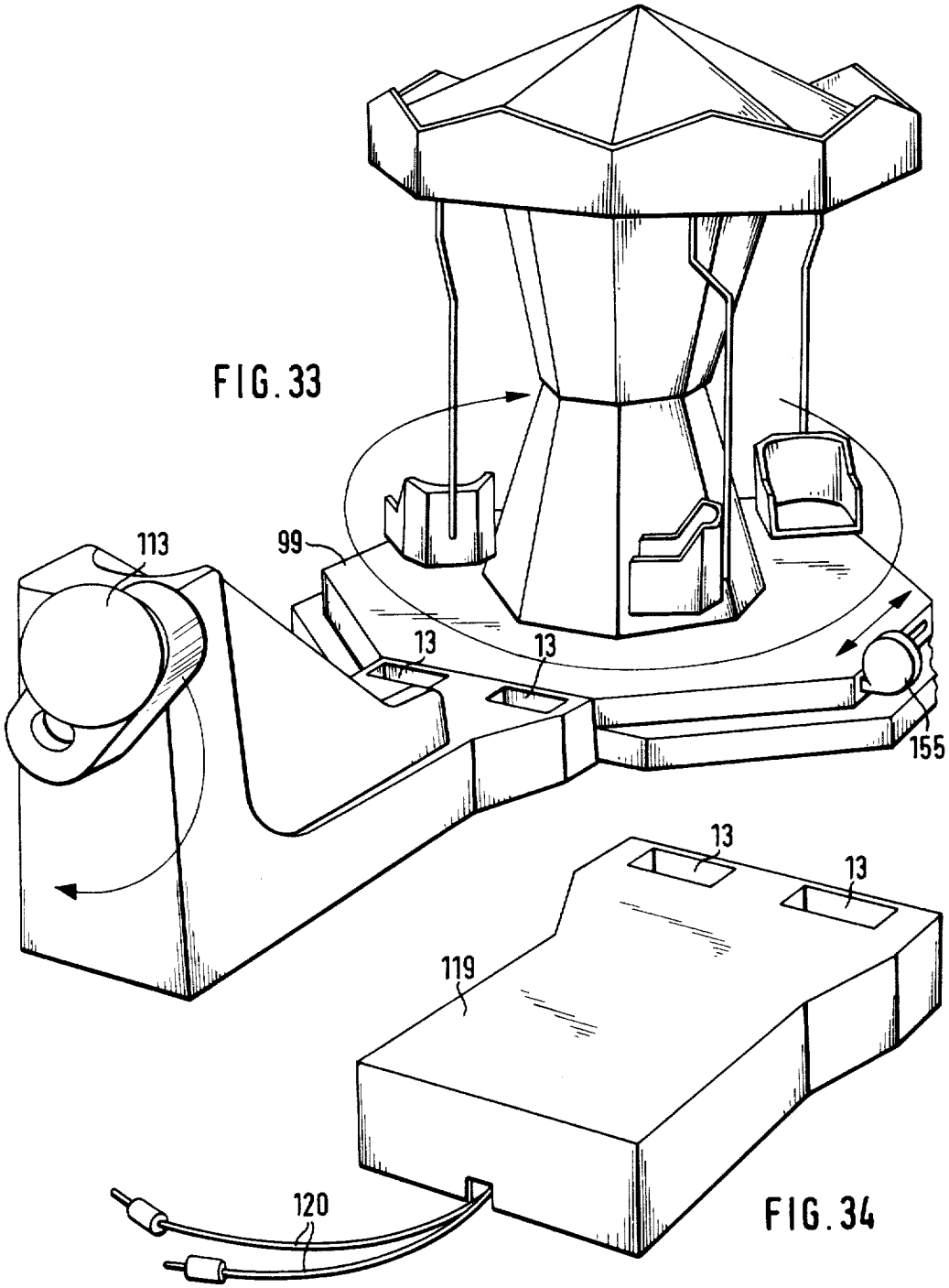
FIGS. 33 to 39 show embodiments for the alternative operation of the toy objects.
Figure 38:
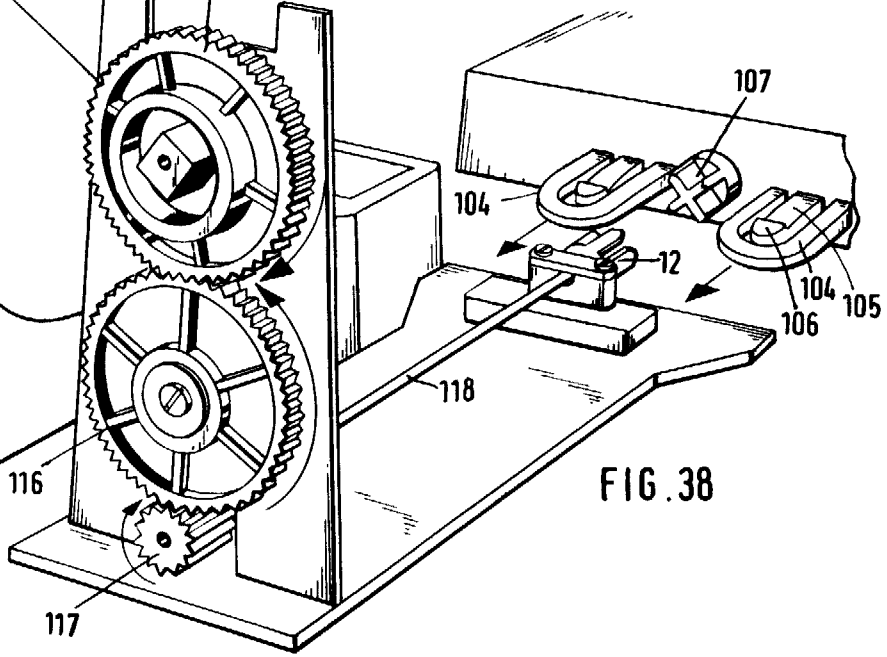

According to FIG. 33, the merry-go-round toy object 99 can be driven by a crank handle 113. The crank handle 113 acts via an axle passing through a housing 114 on a first toothed wheel 115 which meshes with a second toothed wheel 116 which in turn meshes with a pinion 117 located on an axle 118 which has mounted on its other end an engaging member 12 which is accessible at the other end of the housing between the box openings 13 and is used for engaging an engaging member 107 of a toy object (see FIG. 38). When the crank handle 113 is turned, the toy object also turns.

Inside an electrical drive unit 119 is an electric motor which may be connected via wires 120 with a suitable supply. The electric motor acts on a corresponding engaging member 12 in order to drive toy objects, by engaging with a complementary engaging member 107, as represented for example in FIG. 36. In this connection, the drive unit 119 can be provided with a switch knob 121, but may also be put into operation via the connection with the wires 120 without this type of switch knob having to be provided. Fianlly, the drive unit may also be designed so that it receives batteries which turn the engaging member 12 via a drive.

FIG. 36 shows again that the individual toy objects can be connected one after the other in the manner explained with reference to the toy object 97 when each toy object has an axle corresponding to the axle 103 connecting with the engaging member 107 on one end and the engaging member 102 on the other.

Various embodiments of toy objects are now described in detail in the following.

Figure 40:
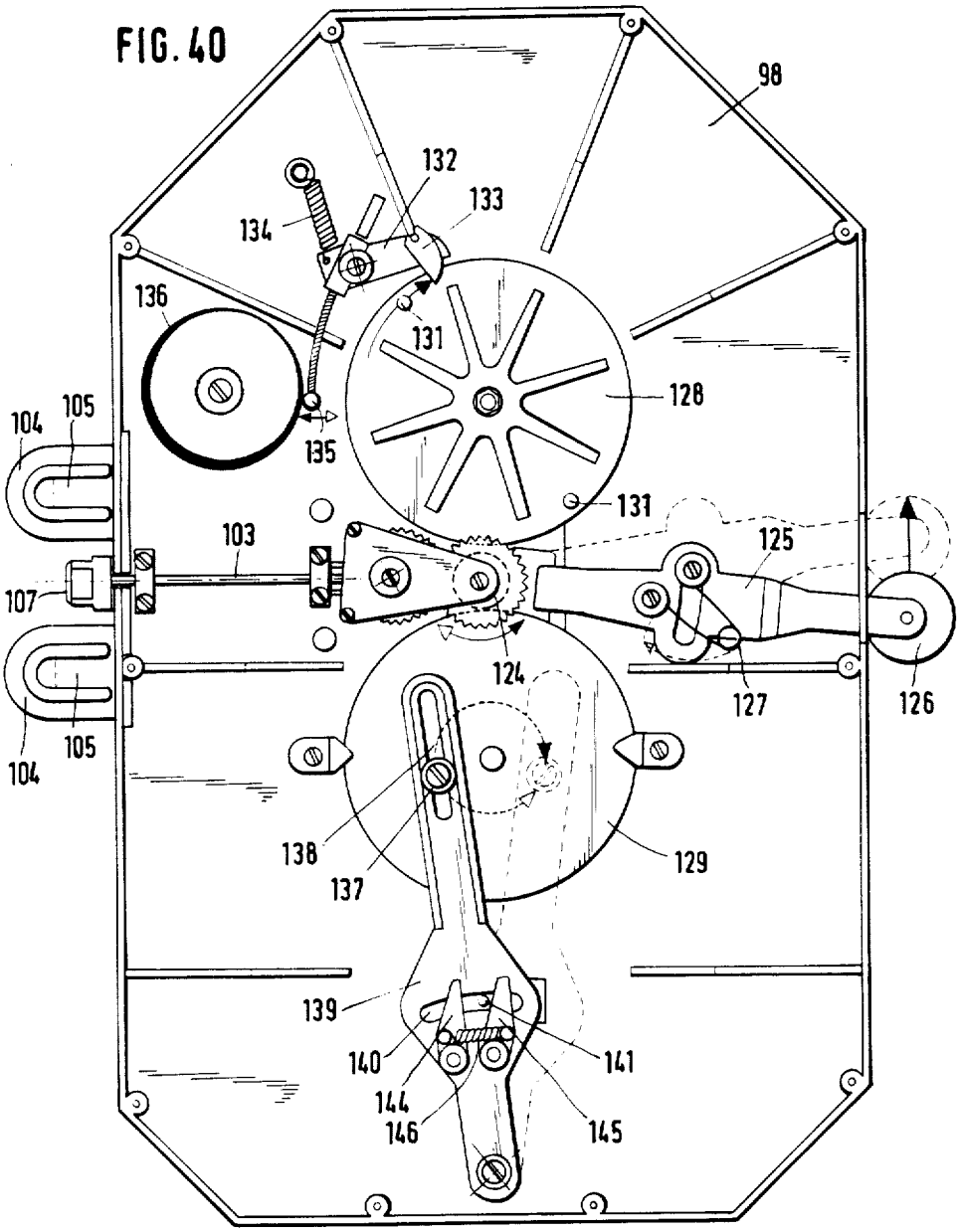

FIG. 40 shows the underside of the children's playground toy object 98 (see also FIG. 1). The rotational movement is transmitted to a friction wheel 124 via the engaging member 107 and the axle 103 and also via a bevel gear wheel and toothed wheels. The bevel wheel and the toothed wheel are covered by a carrying element and therefore do not have reference numerals. The friction wheel 124 can be swung to the left or to the right via a lever 125, with an outwardly projecting handle 126, which is pivoted on the underside of the toy object 98. A stable end position during the pivoting is ensured by a fastener spring 127 such that the friction wheel 124 either abuts a first wheel 129 which is rotatable about a vertical axis or a second wheel 128 arranged in the same manner and rotatable about a vertical axis, and drives the respective wheel 128 or 129. The wheel 128 serves the purpose of turning a small merry-go-round 130 on the visible side of the toy object 98. Also, pegs 131 are provided on the underside of the wheel 128, which pegs act on a double lever 132, 133 when the wheel 128 is turned, namely to tension a helical spring 134 (when the wheel 128 is turned in the clockwise direction in FIG. 40) by means of which a clapper 135 is deflected and strikes a bell 136 when the spring 134 relaxes, so that the bell sounds regularly when the small merry-go-round is turned. By a suitable construction it is possible for the bell 136 to sound both when the wheel 128 is turned in the clockwise direction and also when it is turned in an anticlockwise direction, for example by a one-piece lever instead of a double lever 132, 133.

It should be pointed out that in an embodiment without a lever 125, the two wheels 128 and 129 can be turned simultaneously when the associated friction wheel 124 and a correspondingly designed toothed wheel turn both wheels 128, 129 when the axle 103 is turned by means of the engaging member 107.

The wheel 129 has a projection 137 which engages in a longitudinal opening 138 of a lever 139 hinged at the other end. Approximately in the middle the lever has a slot 140 in the pivot direction in which a pin 141 engages, which pin is permanently connected with the horizontal pivot axle 142 of a seesaw 143 on the visible side of the toy object 98. Along the path of movement of the pin 141 in the slot 140 there are two stops 144 and 145 which are hinged on the lever 139 and are connected together via a helical spring 146. This ensures that the pin 141 cannot break off when the seesaw is secured. This achieves the seesaw motion of the seesaw 143 by turning the wheel 129.

Figure 41:
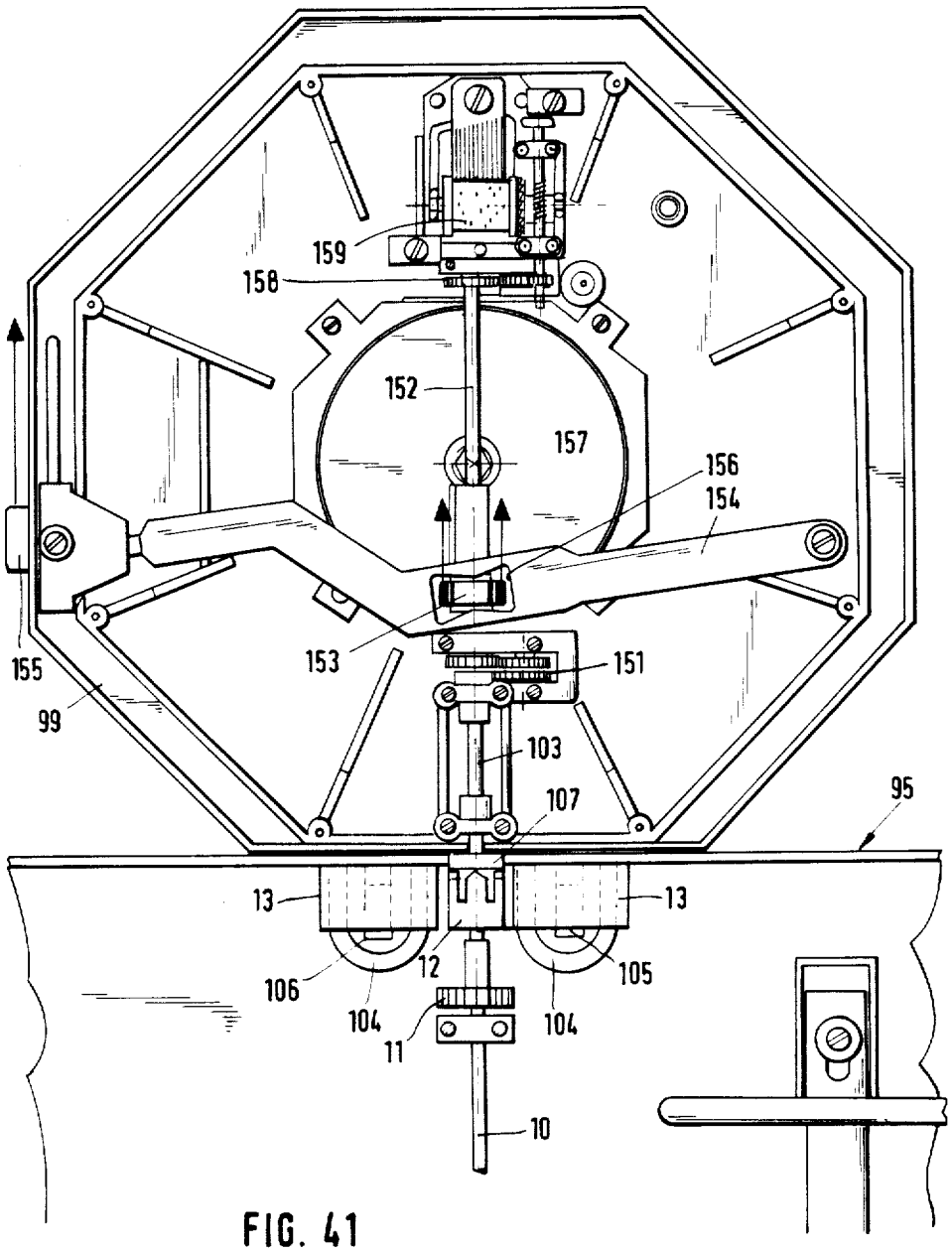

FIG. 41 shows the underside of a chair merry-go-round toy object 99 for one embodiment. The mechanical coupling and the coupling transmitting the turning movement with the station section 95 are made in the manner already described above.

The axle 103 connected with the engaging member 107 and mounted on the underside of the toy object 99 acts on the input side on a gear mechanism 151 which acts on the output side on an axle 152 on which a friction wheel 153 is displaceably arranged in the direction of the axle 152. For displacing the friction wheel 153, a lever 154 is pivoted at one end on the underside of the toy object 99, the other end of the lever 154 projecting out of the toy object 99 and there carrying a handle 155. In the region of the friction wheel 153, the lever 154 has a recess 156 shaped so that in each position of the lever 154 the friction wheel 153 can turn freely on the axle 152, but so that the friction wheel 153 is displaceable along the axle 152 by displacing the lever 154 by means of the handle 155. The friction wheel 153 acts on a disc 157 which is rotatable about a vertical axis and which carries the chair merry-go-round structure on the visible side of the toy object 99.

The weight of the disc 157 with its structure constantly produces an operative connection between the disc 157 and the friction wheel 153. By adjusting the knob 155 and hence the friction wheel 153 relative to the disc 157, it is possible to alter the rotational speed of the merry-go-round. The axle 152 carries on its end which is remote from the gears a toothed wheel 158 which acts on a mechanical musical instrument 159 having a construction which is known per se. The musical mechanism is thereby driven at a constant speed, irrespective of the rotational speed of the merry-go-round selected by setting the knob 155.

Figures 42, 43:
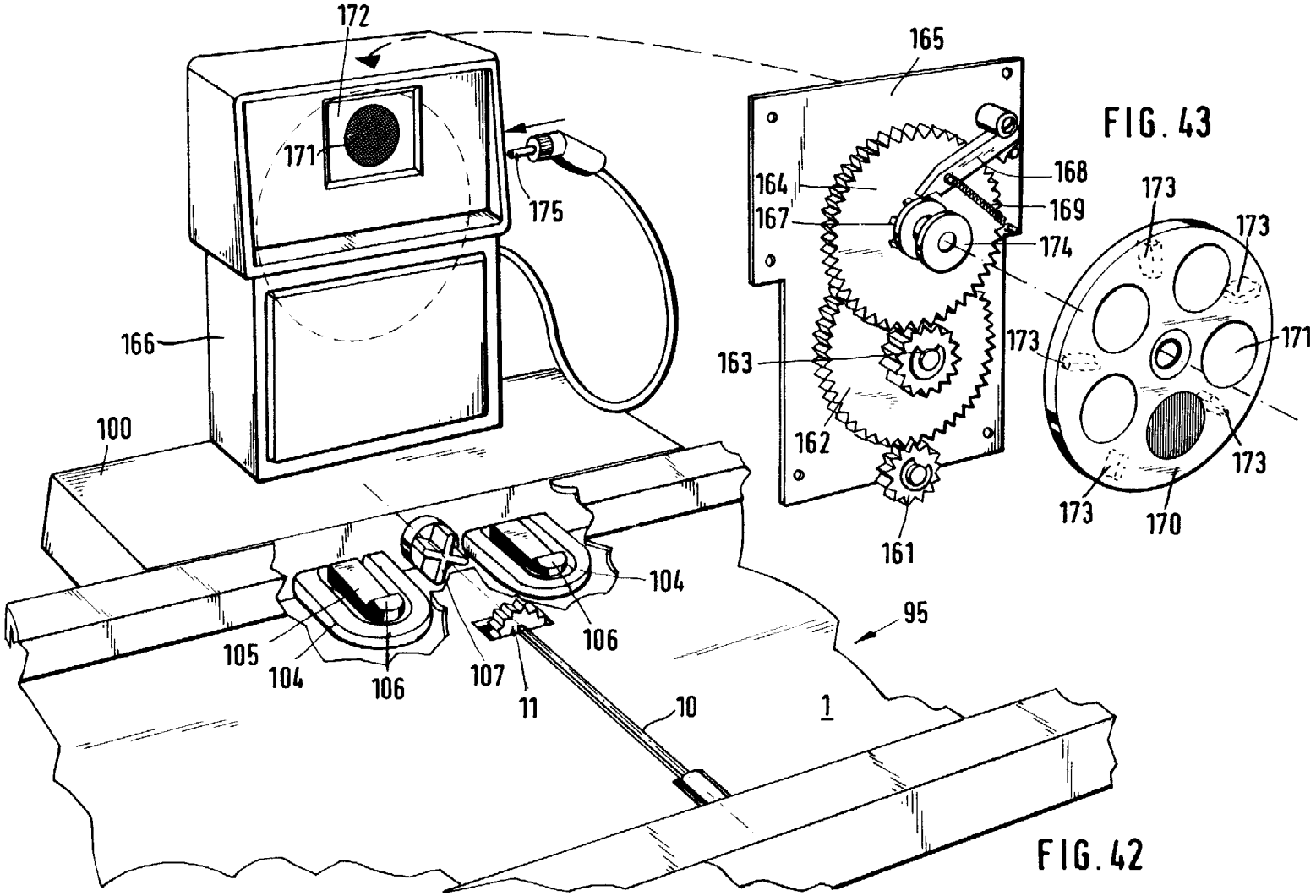

The filling station toy object 100 is described in greater detail with reference to FIGS. 42 and 43.

The coupling with the station section 95 of another toy object takes place in the manner already described by way of the coupling members 104 to 106 and also by way of the engaging member 107 which acts on an axle (103) (not shown here). The axle carries at the other end a toothed wheel (not shown) which meshes with a toothed wheel 161 which, in turn, is operatively connected with a further toothed wheel 164 by way of toothed wheels 162, 163. The toothed wheels 161 to 164 are supported on back wall 165 of a filling station housing 166. The axle of rotation of the toothed wheel 164 also carries latching elements 167 with which a latch 168 which is hinged on the back wall 165 comes into contact by way of prestressing by means of a spring 169 so that when the toothed wheel 164 turns, a typical clicking noise, similar to that of a real petrol pump, is produced. Turning the toothed wheel 164 turns a disc 170 having fields of vision, for example brightly coloured circles 171, one of which is discernible in a display window on the front side of the filling station housing 166. On the back side, approximately in the area between the fields of vision 171, flanges 173 project away from the disc 170. The transfer of the rotational movement from the toothed wheel 164 to the disc 170 takes place by way of a friction coupling 174. The petrol pump also has a hose nozzle 175 which is connected to the petrol pump by way of a hose and which can be inserted into a side opening in the filling station housing 166, namely in the area between two flanges 173 on the rear side of the disc 170. In this way, by inserting the hose nozzle 175 (delivery gun) into this opening (not shown), rotation of the disc 170 can be interrupted, that is, in terms of playing, the delivery process can be terminated, whereas when the hose nozzle 175 is taken out, the disc 170 can rotate, that is, the delivery process begins.

Figure 45:
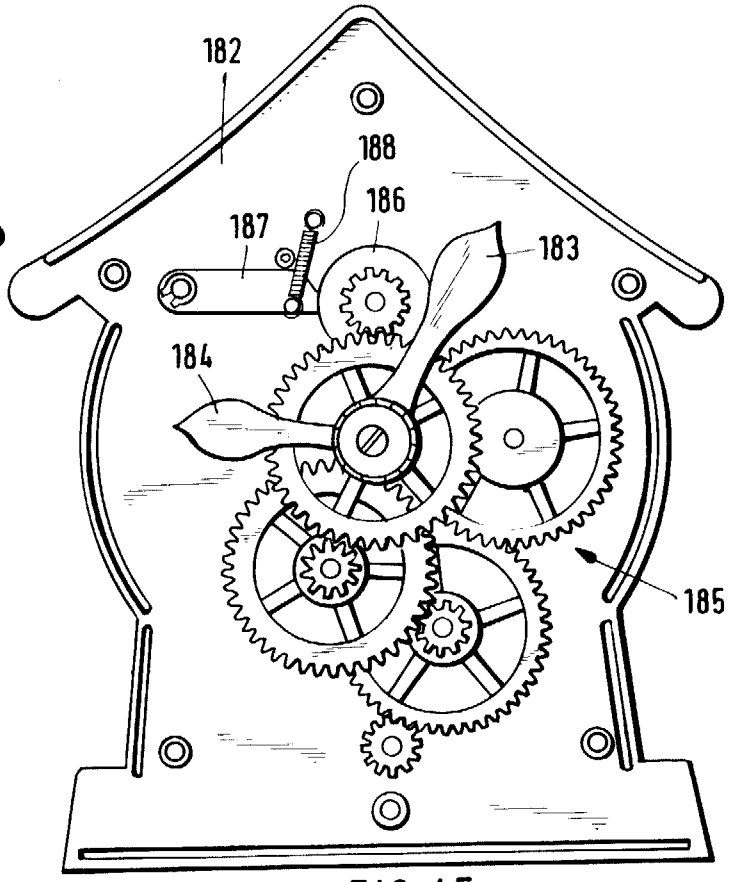
Figure 44:
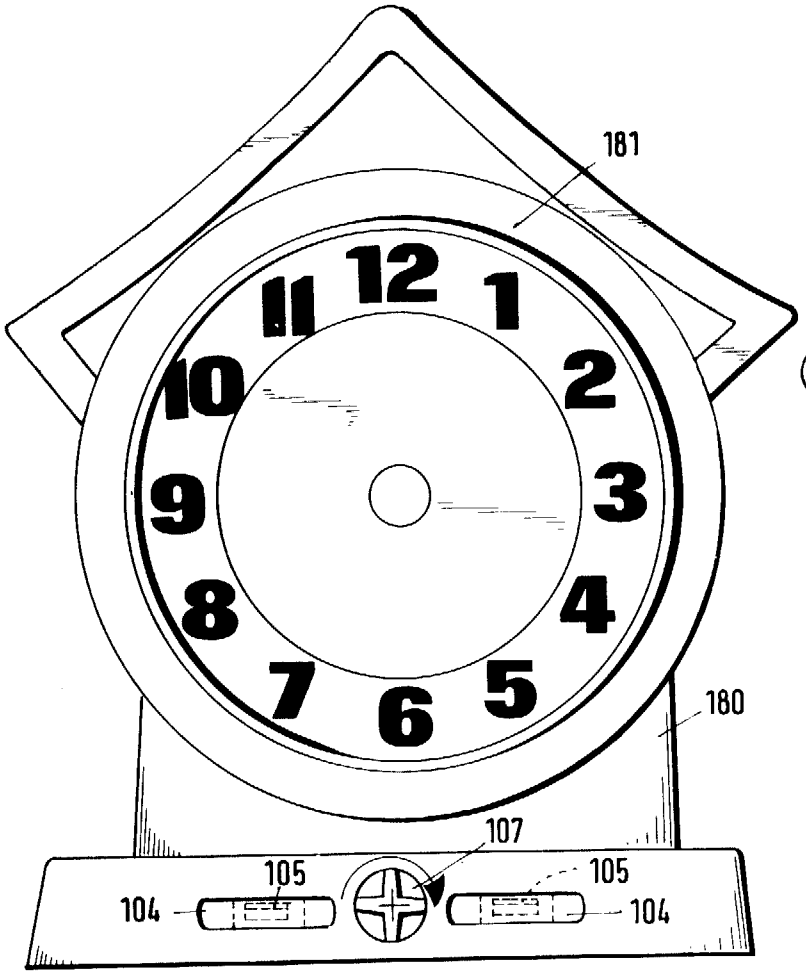

FIGS. 44 and 45 show a further toy object, namely a musical clock toy object 180. This toy object 180 can be connected with the station section 95 or with another toy object in the manner already described by way of the coupling members 104 and 106 on the one hand and with the engaging member 107 on the other hand. The toy object 180 has on the front side a dial 181 and also on the other side a rear wall 182 on which are supported the toothed wheels which serve to drive big hand 183 and little hand 184. The toothed wheels are adjusted in respect of each other in such a way that with one rotation of the big hand 183 there is a twelfth rotation of the small hand 184. The toothed wheel arrangement 185 is driven by way of a toothed wheel (not shown) which is arranged on the axle 103 (also not shown) which is connected to the engaging member 107. The toothed wheel arrangement 185 acts on a further wheel 186 having wheel studs with which there comes into contact a latching element 187 by way of spring prestressing by means of a helical spring 188, whereby, when the toothed wheel 186 is turned, a "tick-tack" noise is produced. The latch 187 pivots at the other end on the rear wall 182.

A further toy object, denoted in the following as a tree merry-go-round toy object 190, is described in greater detail in the following with reference to FIGS. 46 to 49. Basically, this merry-go-round toy object 190 has a base part 191 upon which parts can be stacked one on top of the other in a manner to be described later, on which play figures 94 can be mounted.

Figures 46, 47:
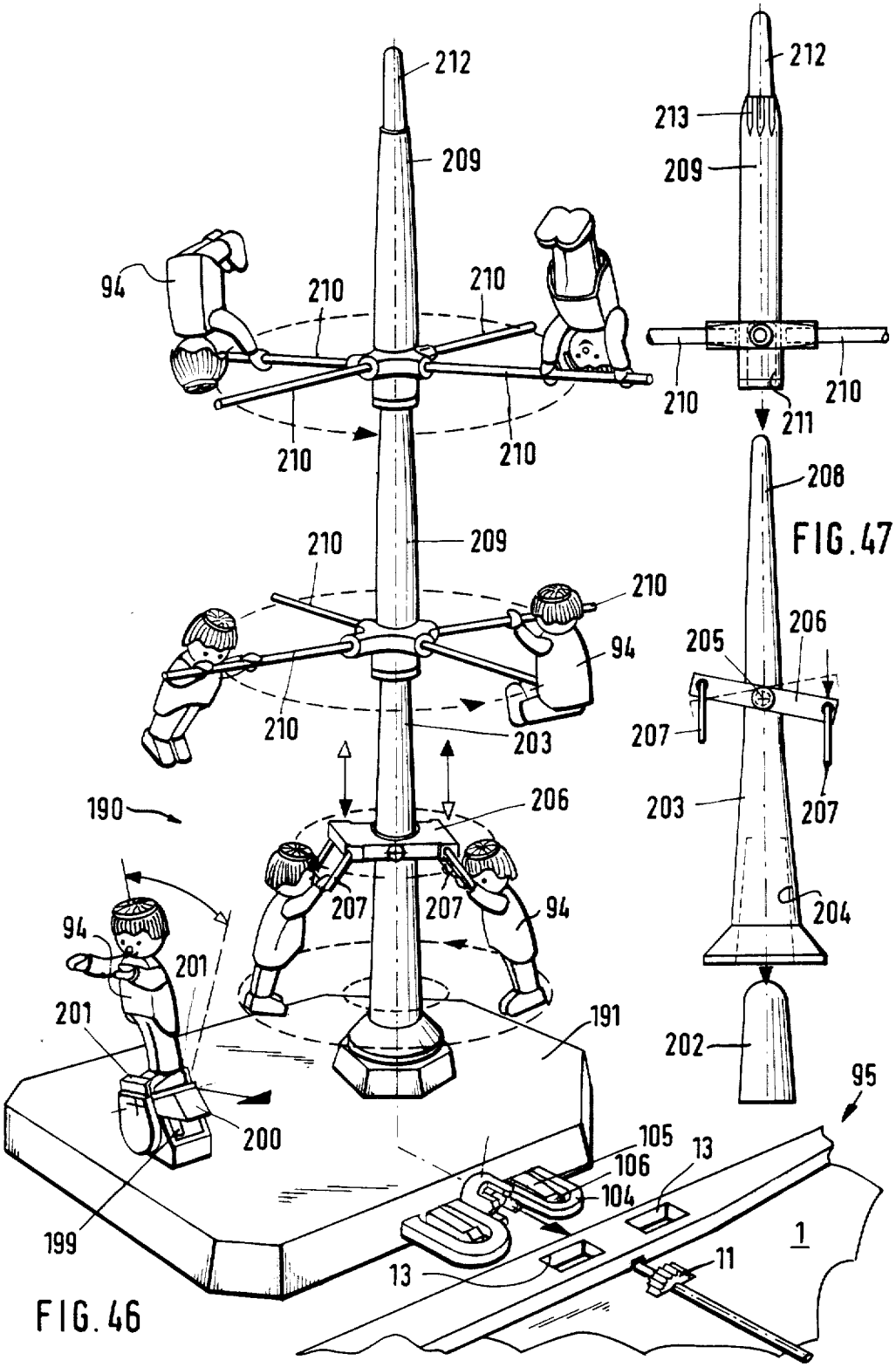
Figure 48:
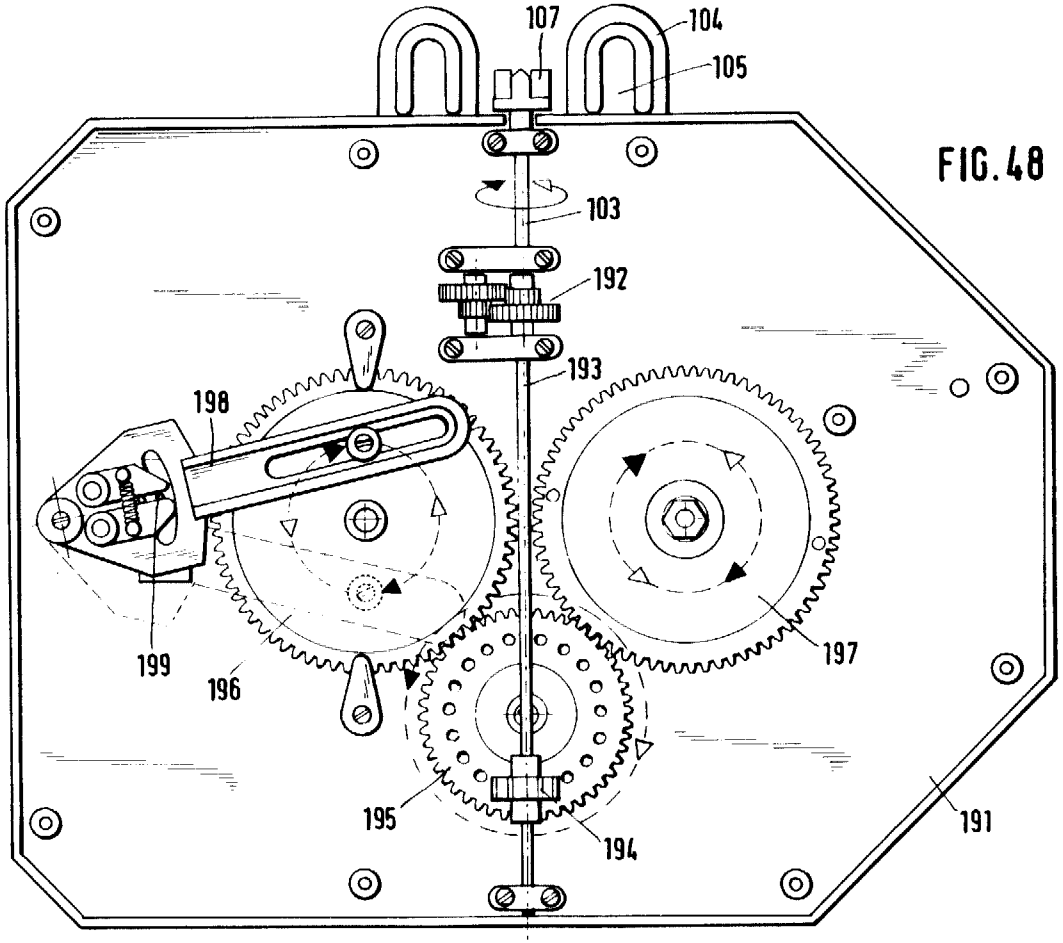

The base part 191 can be coupled in the manner already described with a station section 95 or with another toy object by way of the mechanical coupling members 104 to 106 and the engaging element 107 with axle 103. The axle 103 drives by way of gears 192 a spindle 193 on which there is seated a pinion 194 which acts on a crown wheel 195 which is rotatably arranged with a vertical spindle on the underneath of the base part 191. The crown wheel 195 has external teeth which mesh with toothed wheels 196 and 197 respectively. The toothed wheel 196 with a vertical axis of rotation acts in a manner already described with reference to FIG. 40 on a lever 198 which acts on a pin 199 which is fixedly connected to a rocker 200 arranged on the upper side of the base part 191 and capable of being tilted about a horizontal axis. In this way, when the toothed wheel 196 turns, there is a rocking movement of the rocker 200. On the upper side of the rocker 200 there is a groove 201 into which a play figure 94 can be inserted with its feet, whereby the latter executes a rocking movement. The toothed wheel 197, likewise rotatable about a vertical axis, is connected in a rotationally secure manner with a peg 202 which projects beyond the base part 191. A first tree like peg part 203 can be connected in a form-locked manner with the peg 202 by way of a recess 204 provided at one end. The peg part 203 has an approximately horizontal transverse shaft 205 which receives a board-like, pivoting part 206. A trapeze 207 pivots in each case at the end sides of the board-like part 206. There can be mounted, for example pressed, on the trapeze 207, as shown in FIG. 46, a play figure 94. A second peg part 209 can be pushed on to the conically extending end 208 opposite the end housing the recess 204 from which said peg part there project approximately horizontally arranged rods 210 in the form of a cross. Play figures 94 can also be mounted on the rods 210. In order to place the second peg part on to the conical end 208 of the first peg part 203, the second peg part has a corresponding recess 211. At the end of the second peg part 209 opposite the end having the recess 211 the former likewise has a conical end 212 which is the same design as the end 208 of the first peg part 203. In this way, further second peg parts 209 can be stacked one on top of the other, as shown in FIG. 46. The second peg part 209 has in the area of the conical end 212 a milled edge 213, whereby a peg part placed thereon can be better carried along.

By arranging the play figures 94 in a corresponding number and at a corresponding distance from the axis of rotation, provision can be made for a good state of equilibrium and an alternatively low or high inertia movement. Mounting the play figures 94 in corresponding, gymnastic positions and operating the whole system creates a certain play appeal.

Due to the in each case relatively small bearing distance between recess and peg part, for example recess 211 and cone end 208, the respective peg part 209 with the rods 210 is set in rotation comparatively slower than the respective peg part 209 or 203 arranged below. When the toy object 190 is actuated, then, as already mentioned, the direction of rotation of the rotational movement can be altered. Although the peg 202 and also the first peg part 203 follows the new rotational movement immediately, the peg parts 209 with the rods 210 placed thereon only with corresponding inertia and therefore with time lag. Therefore, after the change in direction of rotation, an opposite rotational movement always results, after a certain time there again being conformation of the angular velocities. This effect is particularly evident if several second peg parts 209 are arranged above each other. The peg parts 209 located further up now follow the rotation prescribed by the peg 202 with increasing delay so that if any rhythmic or any arythmic change is made in the direction of rotation, there can be different directions of rotation and rotational speeds at the whole toy object.

Figure 49:
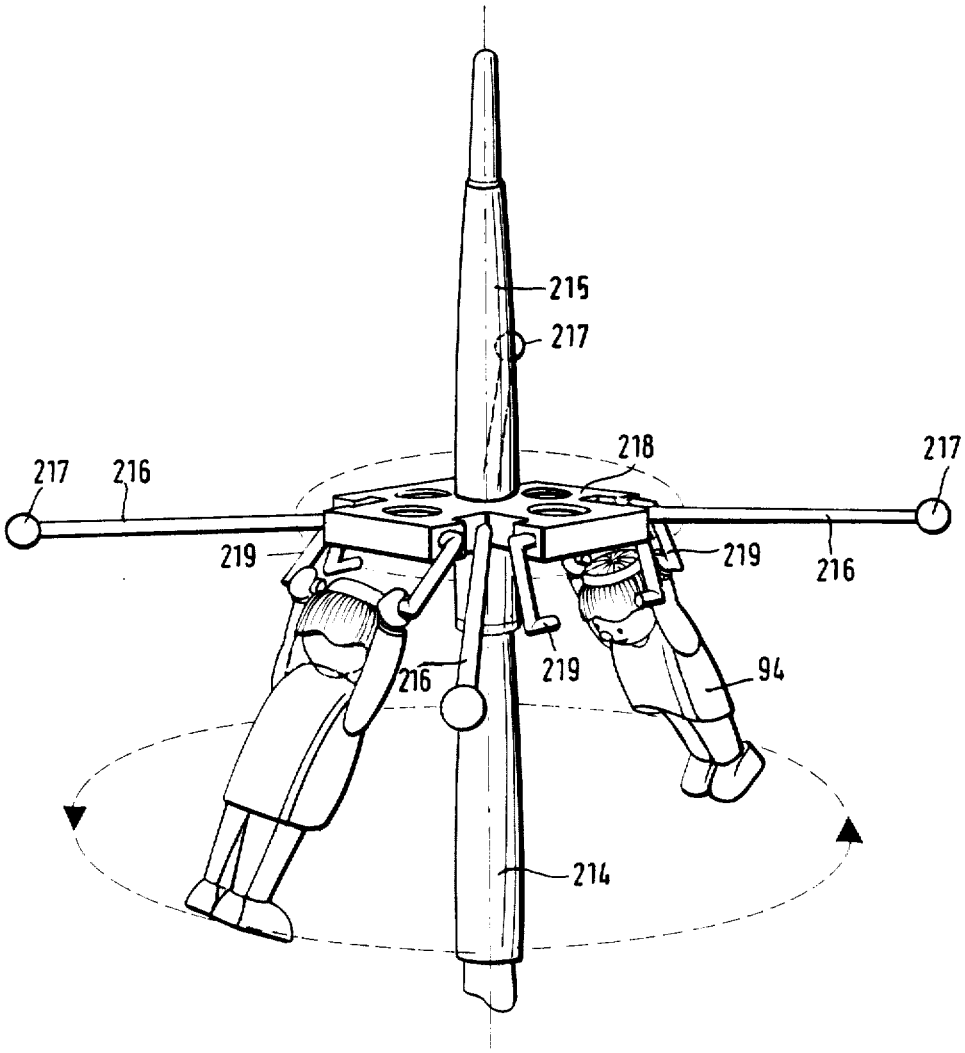

FIG. 49 shows a further, third peg part 214 which has neither rods nor board nor the like and therefore serves as an intermediate piece or spacer, and also a fourth peg part 215 pushed thereon which is very similar to the peg part 209 as it has four projecting rods 216 which are approximately horizontally arranged in the form of a cross having balls 217 provided at the ends thereof. This peg part 215 also has a board-like part 218 constructed in the form of a cross and arranged in the area of the point of intersection of the rods 216, said part likewise having trapezes mounted thereon on to which, in turn, play figures 94 can be mounted. The trapezes 207, 219 preferably pivot in the associated parts 206 and 218 respectively, whereby it is possible for the play figures to swing out of the rest position subject to centrifugal force. The player can thereby, with reference to the oblique position of the play figures 94, receive an impression of the rotational speed of the peg part 215. A milled edge (not shown) is preferably also provided here in order to improve the rotationally secure contact.

A further toy object is described in greater detail with the aid of FIGS. 50 to 53, namely a gymnastic toy object 220 including a horizontal bar. The base part 221 has two posts 222 and 223.

Figure 50:
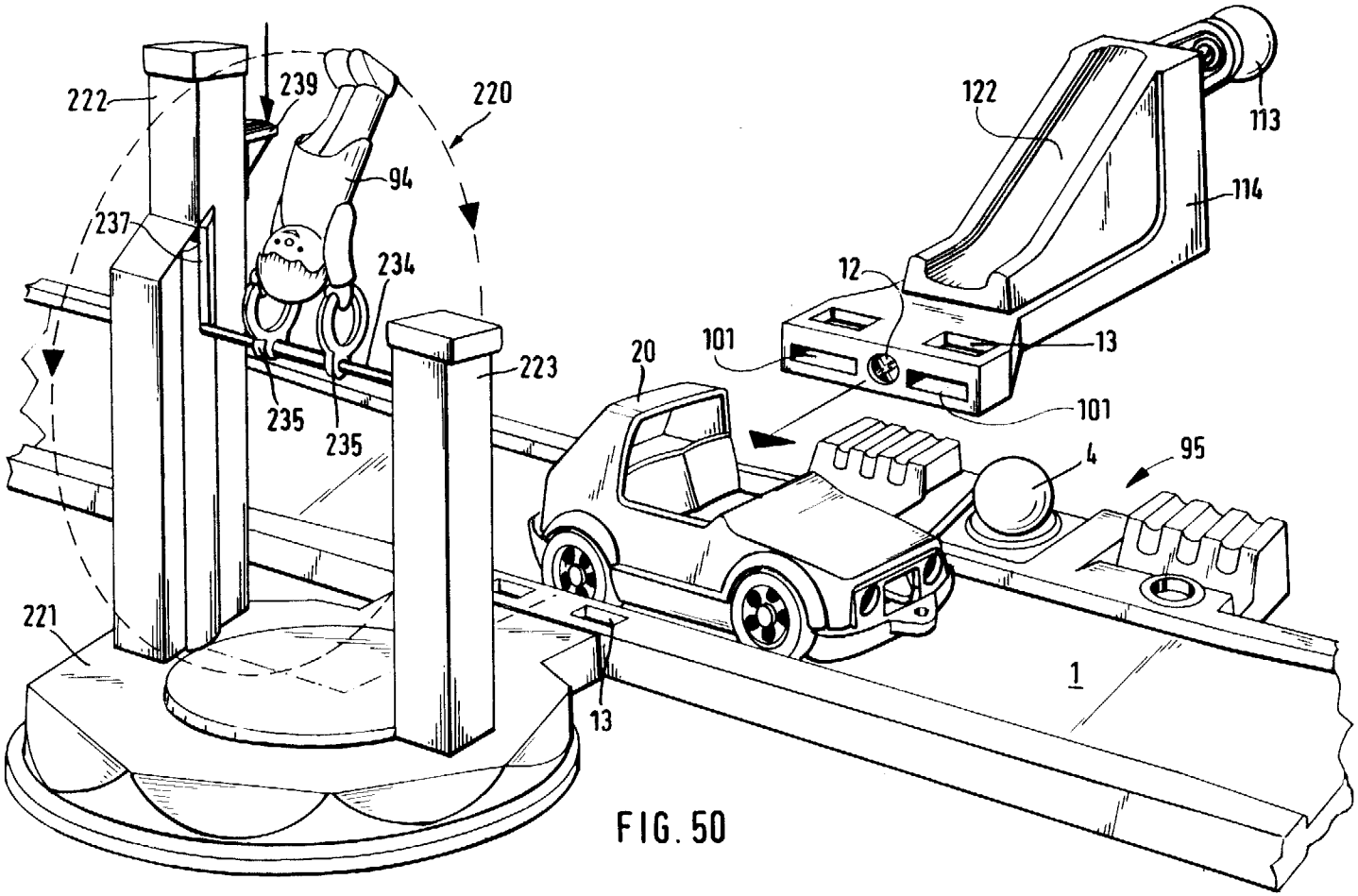
Figure 51:
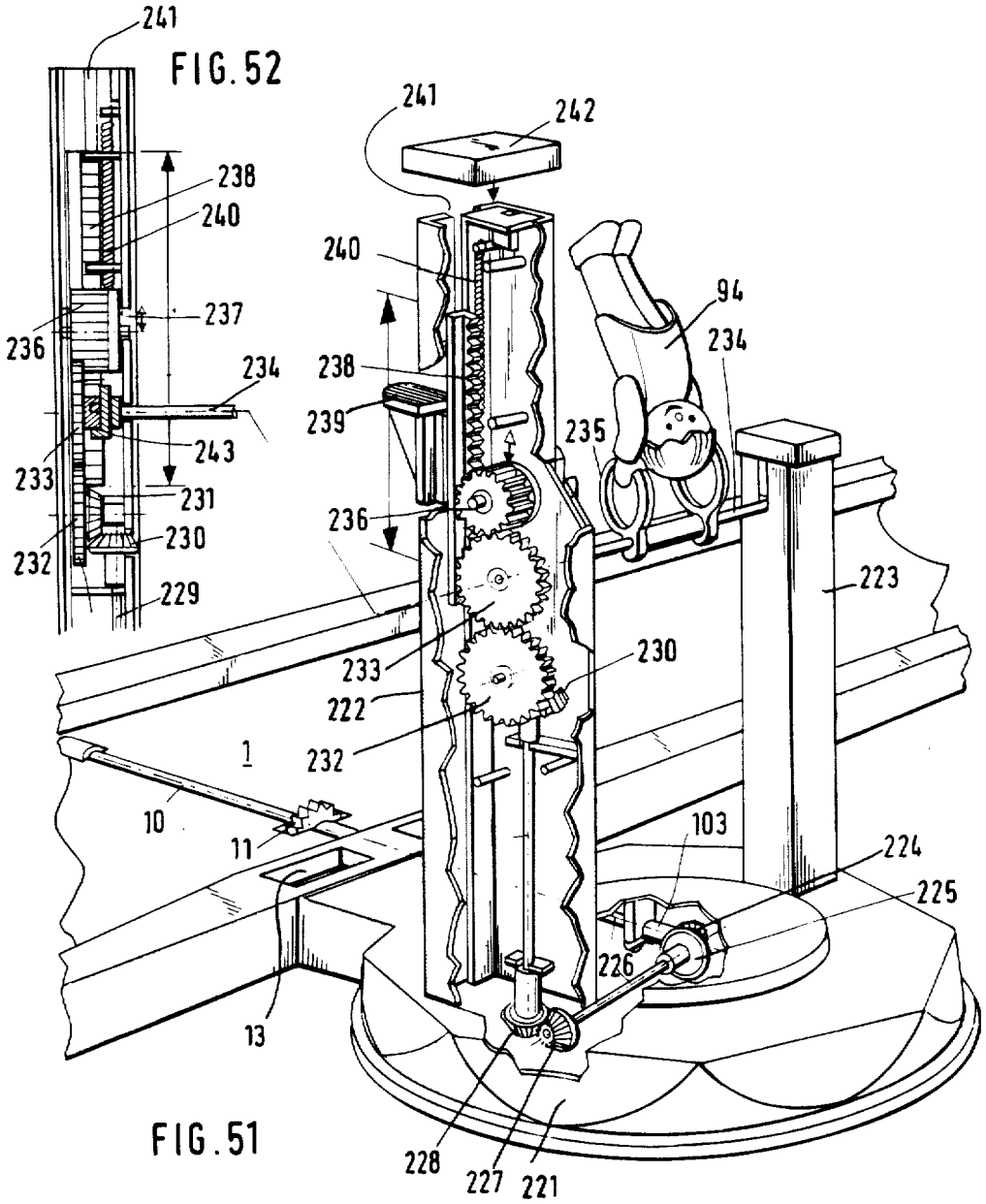
Figure 53:
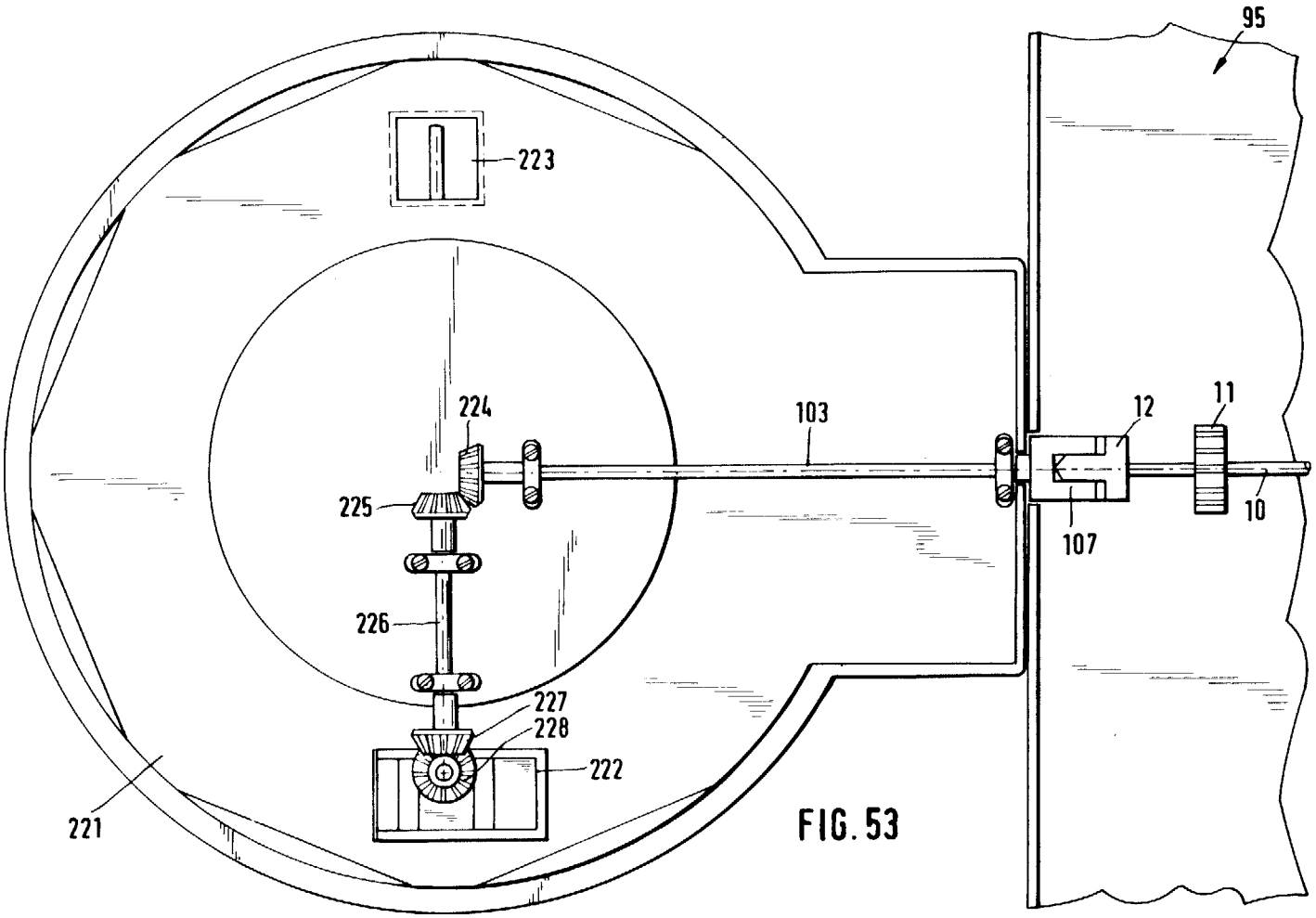

The coupling of the toy object 220 with a station section 95 or with another toy object takes place in the manner already described, the engaging member 107 also engaging with the engaging member 12. The engaging member 107 drives by way of its axle 103 a bevel wheel 224 which in turn drives a bevel wheel 228 which sits on one end of a shaft 229 which extends vertically inside the post 222. At the other end of this spindle 229 is a bevel wheel 230 which meshes with a bevel whee' 231 which sits on the same spindle as a toothed wheel 232. A further toothed wheel 233 meshes with this and drives by way of a friction coupling 243 the horizontal bar 234 which also pivots in the other post 223. The horizontal bar 234 holds rings 235 on which a play figure 94 can be mounted. If appropriate, the play figure 94 can even be mounted, without rings 235, directly on the horizontal bar 234. If a vehicle 20 has driven into the station section 95 and has stopped there, then it drives by way of its rear wheels the axle 10, whereby the horizontal bar 234 with the play figure 94 turns by way of the coupling engagement between the engaging members 12 and 107 and also the bevel gear toothed wheel and coupling engagements described, and namely in a manner which is dependent upon the direction of rotation of the toothed wheel 11, that is, upon the travel direction of the vehicle 20. In addition, as already mentioned above, the toy object 220 can also be driven by means of a crank handle 113, as indicated in FIG. 50. FIG. 50 also shows that the housing 114 can have a slide-like recess 122 down which the play figures 94 can slide down in the manner of a slide, whereby the housing 114 can also be used as a toy object, irrespective of whether or not it serves to drive other toy objects.

A further driving possibility is achieved by a push button 239 on the post 222, which is integral with a toothed rack 238 and which is displaceable in respect of height along a slot 241 in the side adjacent the station section 95. The toothed rack 238 acts on a toothed wheel 236 of which the spindle bears in a vertical, elongate hole. The toothed rack 238 and the push button 239 are forcibly movable into an upper end position by means of a tension spring 240. When the push button 239 is moved downwards by finger pressure, the tension spring 240 is stretched and the toothed wheel 236 engages with the toothed wheel 233 and on the other hand is rotated, whereby the horizontal bar 234 is rotated by way of the toothed wheel 233. With release of pressure on the push button 239, this, together with the toothed rack 238, is pulled by the tension spring 240 into the upper end position, the toothed wheel 236 disengaging from the toothed wheel 233 and being guided along the elongate hole (237). Actuating the push button 239, that is, pressing it downwards, allows the horizontal bar 234 to rotate in only one direction. The friction coupling 243 ensures that with driving by the engaging member 107 no damage can occur when the push button 239 is pressed at the same time. The upper end of the post 222 (in the same way as the post 223) is closed by a cap 242. It should also be mentioned that the horizontal bar 234 can be extended on the other side of at least one of the posts and can carry there a trapeze or another holding device for a play figure 94.

A further toy object, denoted in the following by emergency call stand 250, is described in greater detail with reference to FIGS. 54 and 55. The emergency call stand toy object 250 has a base part 249 and a housing 247 with slots 248. On the housing 247 sits a blue-coloured, transparent blue light casing 246. In addition, there is provided on a side section of the housing 247 an operating push button 251 for operating a siren.

Figure 54:
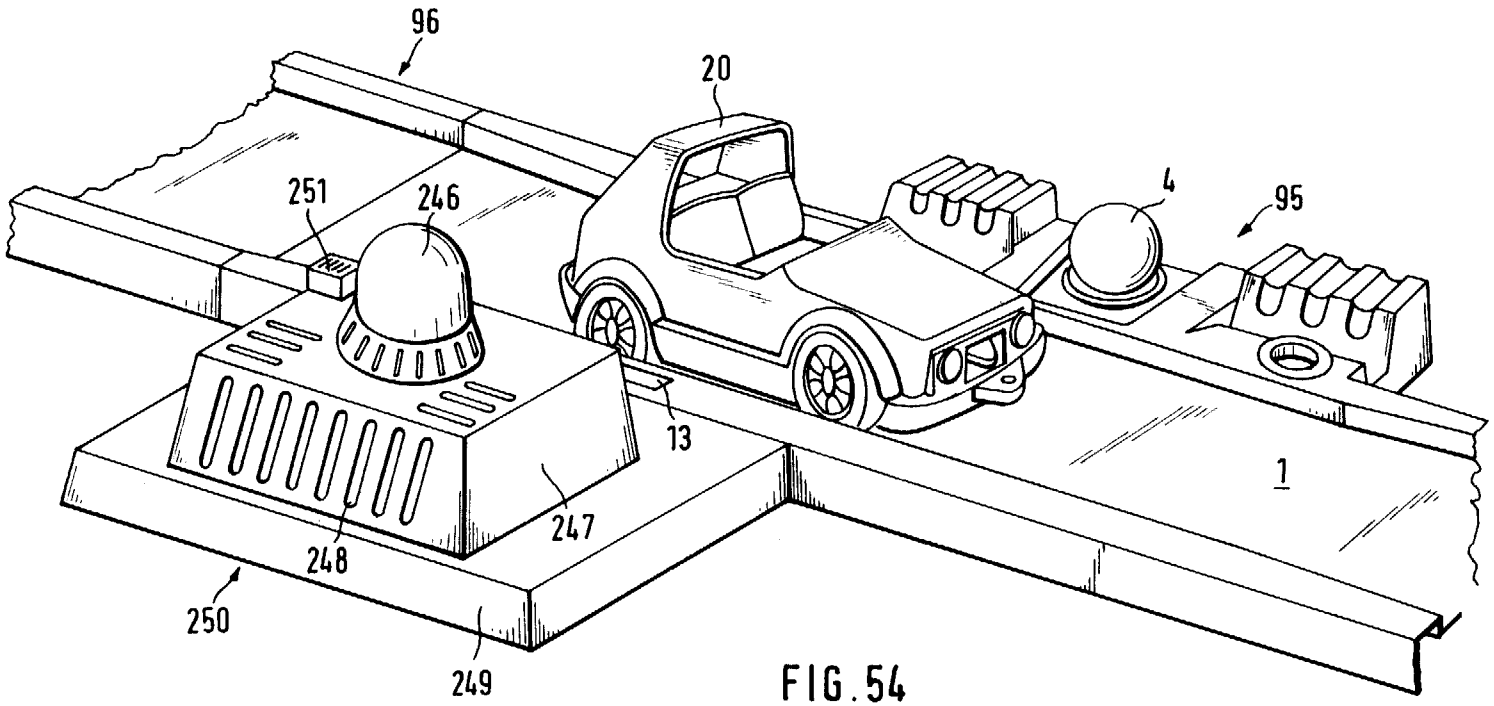

FIG. 54 shows a vehicle 20 which has driven into the station section 95 in the defined position in which the rear wheels drive the toothed wheels 11 (not shown here), whereby an engaging member 12 (likewise not shown here) is rotated. Rotation of one engaging member 12 causes the corresponding engaging member 107 of the toy object 250 which is coupled therewith in a manner already described to rotate, whereby, on the one hand, a blue light seems to rotate and on the other hand, at least after the push button 251 has been pressed, siren noises can be produced.

Figure 55:
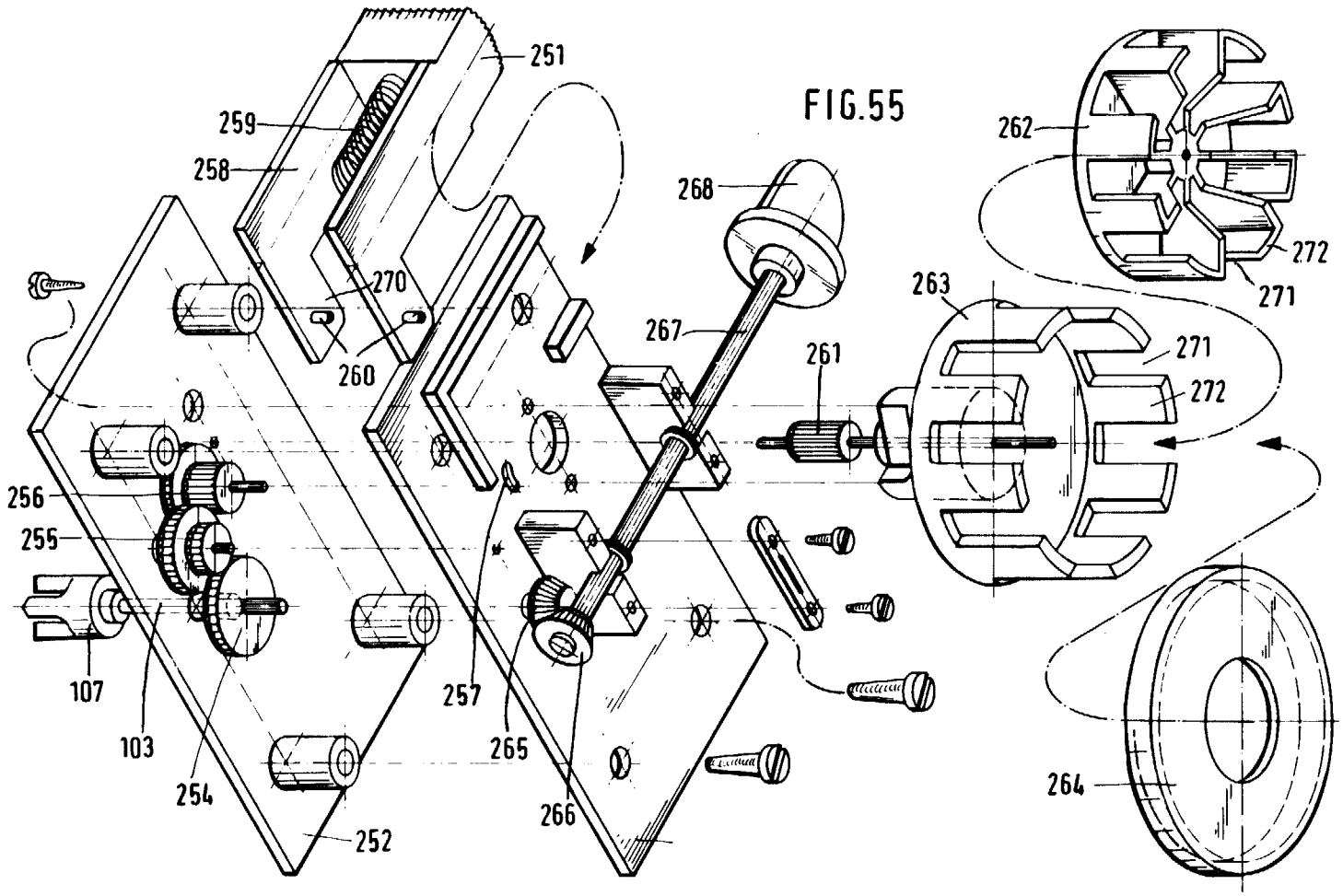
Figure 56:
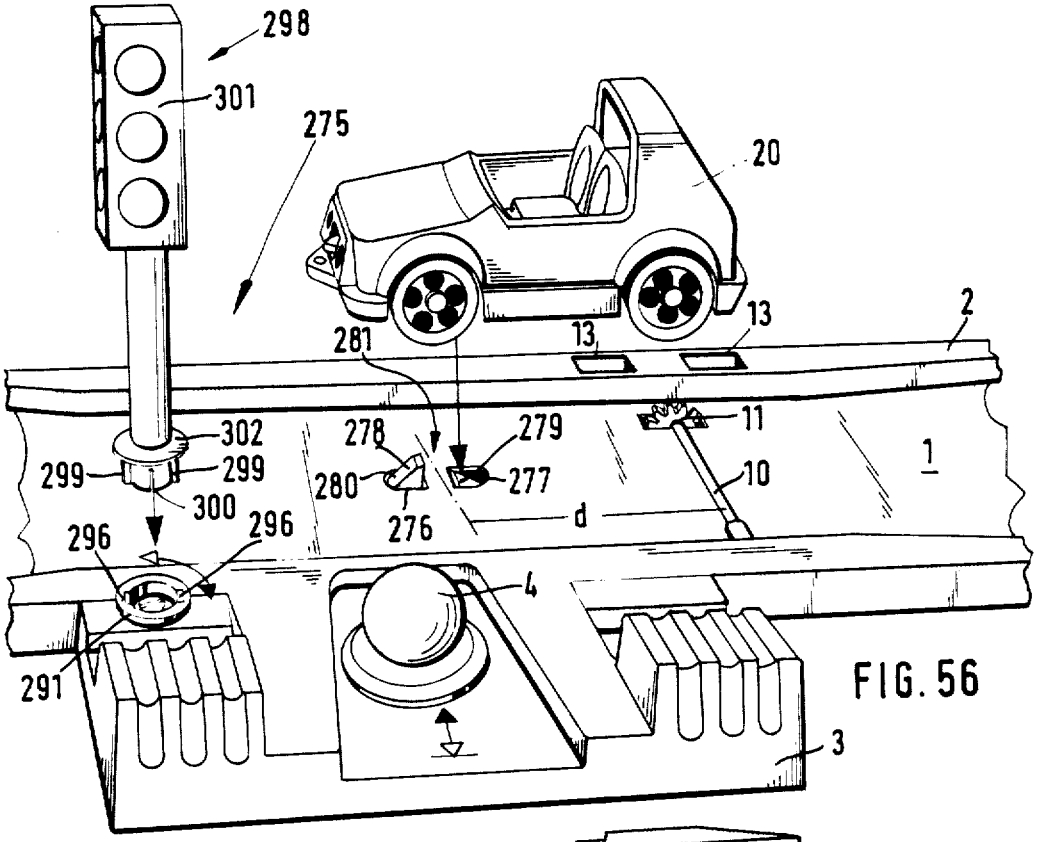
FIGS. 56 to 59 shows another embodiment of the invention with an operatable toy object.
Figure 57:
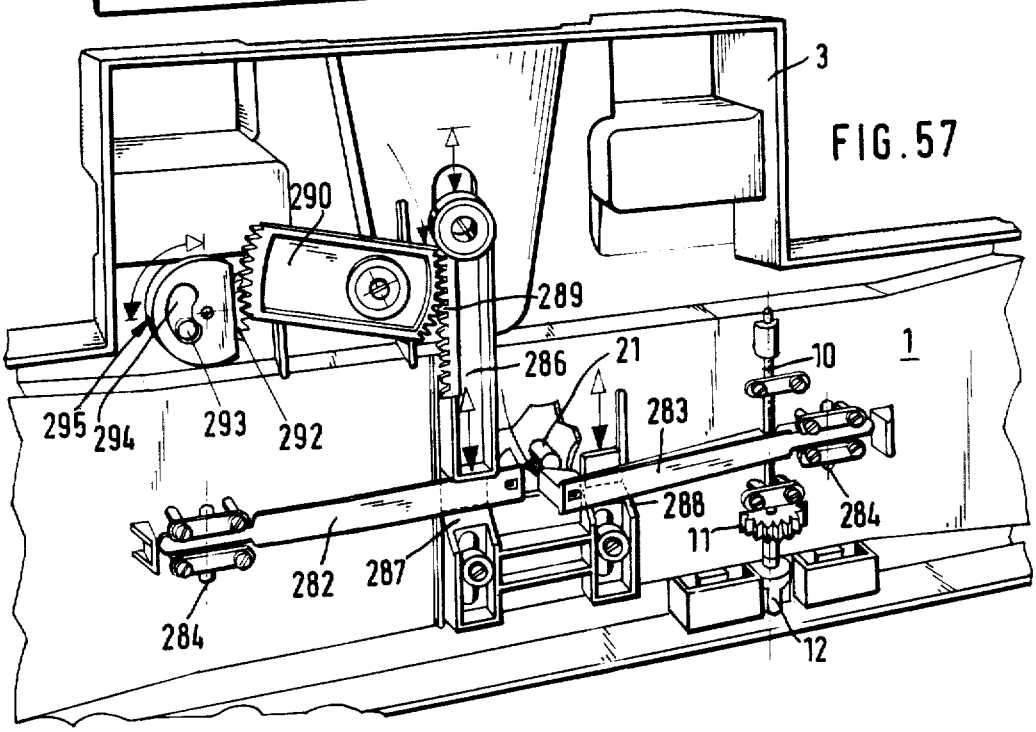

FIG. 55 shows an exploded view of the inside of the housing 247 and of the blue light casing 246 respectively.

The engaging member 107 again acts on the axle 103 which carries at the other end a toothed wheel 254 which engages with a double toothed wheel 255. Both the double toothed wheel 255 and the toothed wheel 254 with the axle 103 are fixedly mounted between two side plates 252 and 253. The toothed wheel 255 meshes with a further double toothed wheel 256 which can be moved into elongate holes 257 in the side plates 252 and 253.

A slide 258, which supports the operating push button 251, can also be moved into the side plates 252 and 253. By a helical spring 259 between operating push button 251 and an abutment, which can be formed by a peg 269 the operating push button 251 is constantly pushed upwards by force. The slide 258 has two projections 270 with elongate holes 260. When displaced, that is, when the operating push button 251 is pressed, the elongate holes 260 act to displace the double toothed wheel 256 in the elongate holes 257, thereby producing a switching on and off process. When the operating push button 251 is pressed, the double toothed wheel 256 acts together with the double toothed wheel 255 and a pinion 261, thereby setting a siren rotor 262 in a rotational motion. The siren rotor 262 is disposed inside a stator 263 with a cover 264 placed thereof. On the axle 103 also sits a bevel wheel 265 which engages with a bevel wheel 266 on an approximately horizontal shaft 267 which carries at its other end an approximately vertical mirror 268 which is rotatable inside the blue light cover 246. Stator and rotor 263 and 262 respectively have in a manner known per se alternate slots and projections 271 and 272 respectively, thereby producing a siren-like wailing tone with their mutual rotation.

The playing process now begins with the vehicle 20 stopping in the defined position on the basis of a corresponding position of the operating knob 4 in the station section 95. With the aid of the vehicle 20, the axle 103 is driven so that the mirror 268 is rotated by way of the engagement of the bevel wheels 256, 266. This offers the impression of a rotating blue light. The operating push button 251 can now also be pressed. The displacement of the double toothed wheel 256 causes the siren rotor 262 to rotate relative to the stator 263, thereby producing the siren-like tone. The rotational speed determines the level of the tone. If the operating push button 251 is released again, the rotational connection between axle 103 and pinion 261 is broken so that the siren rotor 262 slows down according to its own inertia, whereby the tone slowly becomes lower. By alternately pressing and re-releasing the operating push button 215, a rising and falling siren tone can therefore be produced.

Of course, the toy object 250 can also be designed so that when the coupling member 107 is rotated, not only the mirror 268, but also the siren rotor 262 is rotated, whereby by pressing the operating push button 251, pinion 261 and double toothed wheel 256 disengage.

Described in the following is another embodiment of a station section, namely a station section 275 which differs from the station section described above by two essential features, although it is designed in the same way to stop a vehicle 20 in the defined position, namely at the distance d from the axle 10 with the toothed wheel 11 and the engaging member 12.

Whereas in the station sections described above the stop pin 21 on the vehicle 20 latches into a transverse slot of a one-piece start member which has two sloping portions, this stopping arrangement is designed in a different manner in the station section 275. Instead of a one-piece start member, a two-piece construction is chosen here. This has the advantage that when the vehicle 20 drives in to the station section 275, its stop pin runs over one of the sloping portions and presses the associated part downwards, while the other one remains unchanged, and the pin comes to rest against this and is thereby arrested. This is irrespective of from which side the vehicle drives into the station section, hence irrespective of whether the vehicle is in the forwards or backwards travel direction.

There project out of the track 1 two separate projections 278 and 279 respectively, having on the sides which are remote from each other sloping portions 280. When the stop projections 278 and 279 are in the position of standing out of the track 1, the opposite sides form together with the track 1 a slot 281 which corresponds to the transverse slot 16 of the start member 9 and of which the dimension corresponds to the pin 21 on the vehicle 20. The stop projection 278 is mounted on a lever 282, while the other stop projection is mounted on a lever 283. Both levers 282 and 283 are held in the same way to one end remote from the respective stop projection 278, 279 on the underside of the track 1. In fact the levers 282, 283 in each case pivot about a spindle 284, a spring 285 between the underside of the track 1 and the side of this end section which is adjacent thereto acting on the side of the spindle 284 which is opposite the stop projection in order to ensure forcible rotation of the lever with the projection about the spindle 284 so that both stop projections 278 and 279 normally project upwardly out of the track through the slots 276, 277. When a vehicle 20 with stop pin 21 drives into a station section 275 thus constructed, it drives over only one of the stop slopes, the latter being pushed downwards into the slot 277 by the stop pin 21 against the force of the spring 285, while the other stop projection continues to project out of its slot and serves as a stop for the stop pin 21 of the vehicle 20. The stop projection which is pressed down in the first instance is pressed up again by the helical spring 285 after it has been driven over. This mode of operation is the same for both directions of travel, forwards and backwards. The vehicle 20 is therefore arrested in the defined position, and energy can be released by way of the toothed wheel 11 and the engaging member 12 to attached toy objects.

If it is not desired, or no longer desired to stop the vehicle 20, then both stop projections must be pressed down out of the track. This takes place by means of a slide arrangement which has already been described in principle, whereby, in the present embodiment the slide arrangement must be constructed so that it acts simultaneously on both levers. In the embodiment represented, there is provided an L-shaped slide 286 which is displaceable by the operating knob 4 in the projection 3 of the station section 275 transversely relative to the extent of track. The slide 286 has two inclined planes 287 and 288, one of which is constructed and arranged to act on the lever 282 and the other of which is constructed and arranged to act on the other lever 283 so that when the slide 286 moves in the direction of the arrow designated black, the inclined planes 287 and 288 do not act upon the lever 282 and 283, while when the slide 286 moves in the direction of the arrow designated white, the inclined planes 287 and 288 act on the lever 282 and on the lever 283 respectively so that each together with its respective one of stop projections 278 and 279 is pressed down out of the track. In this way, the stop pin 21 and hence the vehicle 20 is released, whereby it can then move on the track 1 again.

The slide 286 has at its end adjacent the operating knob 4 on the section on the driving direction side a toothed rack or, as shown, a toothed section 289 which meshes with a carrier 290 similar to a toothed wheel section which is mounted in the projection 3. The toothed carrier 290 acts on a coupling part which has external toothing which is designed to mesh with the toothing of the carrier 290. The coupling part 291 has on the underside a pin 293 which can be moved in slotted member 294 which is formed in a circular recess 295 in the projection 3.

The coupling part 291 has on the inside keyways 296 and also a centrally screwed spring and bow-shaped strap part 297. A toy object 298 can be fixedly, yet detachably, inserted in the keyways 296 and in the spring and strap part 297 by way of carrier projections 299 which can be pushed into the keyways 296, and carrier slots 300 which can be inserted by way of the spring and strap part. The toy object 298 is constructed here as traffic lights 301 with different coloured faces, red, yellow and green, which can be inserted into the coupling part 291 by way of the connecting projection 302 in the manner explained. In fact, the coloured faces of the traffic lights 301 are arranged so that in one position of the operating knob 4, in which the vehicle comes to stop in the slot 281, a red coloured face is turned towards the vehicle 20, while when the operating knob 4 is brought into the other position, the traffic lights 301 are rotated by means of the pin 293 in the member 294 and by means of the engagement between toothed section 298, carrier 290 and toothing 292 so that a green face is turned towards the vehicle.

Traffic control can therefore be played at. This station section 275 is therefore also suitable for construction as an intersection section. In such a case, by means of a single operating knob 4 it is possible for the vehicle to stop in one branch of the intersection and to drive on in the other branch of the intersection with a corresponding position of the traffic lights 301 being guaranteed. An embodiment of this type is not described in any greater detail, nevertheless it equally lies within the scope of the invention.

It also follows that the vehicle can also be released by rotating the toy object 298, and thus the elements 290–302 define a rotary driver which will effect shifting of the slide 286 by selective rotation of the toy object. As will be obvious to those skilled in the art, the toy object does not necessarily have to be a set of traffic lights 301, but can also be designed as a knurled-head screw or the like which can be inserted in the coupling part 291 by way of a coupling projection in the manner described. In this way, operation is possible not only be means of sliding the operating knob 4, but also by rotating on toy object 298.

The advantage of this embodiment of a station section is explained in the following. With the station section constructed with a one-piece start member, the vehicle can move only relatively slowly. The start member is pushed down against a spring by the vehicle and therefore requires a certain amount of time before it is guided up to latch the stop pin in the stop slot. If the spring tension for pushing the start member up is increased, then it can happen that, when the vehicle is moving relatively rapidly, it jumps off along the sloping portion over the start member without it being stopped as, due to inertia, the vehicle cannot fall down quickly enough. This disadvantage is avoided in the station section 275 first described.

At relatively high speeds, it can be advantageous to provide a spring intermediate member for damping so that the vehicle can be cushioned gently. This intermediate member can be provided in the region of the lever which carries the start member or alternatively can be housed in the region of the vehicle on a corresponding intermediate member. Both measures can also be combined, thereby allowing even gentler cushioning of the vehicle. This ensures that the vehicle is stopped in the defined position.

FIGS. 60 to 63 show a vehicle 20 where the reversal of travel direction can take place in a manner which differs from the vehicle embodiments already described. The vehicle 20 again has a car body 27 placed on a chassis 28 and contains inside an electric motor 29 and a battery box, the motive energy being released to the rear wheels 22 and the toothed wheels 23 from the electric motor. The reversal of travel direction can also take place through a lever or handle projecting at the front end of the vehicle.

However, the vehicle of this embodiment is different from the previous embodiments in that there project on the underside from slots 305 and 306 respectively pins 307 and 308 respectively which can be moved in the slots 305 and 306 respectively. One pin 307 serves to actuate the reversal switch inside the vehicle in order to reverse the travel direction. The other pin 308 serves for switching on and off. In addition, as with the vehicles described above, there is provided a stop pin 21.

The pins 307 and 308 can also be actuated by impeding means or engaging elements from the side of the track, as will be described later.

Figures 60, 61, 62, 63:
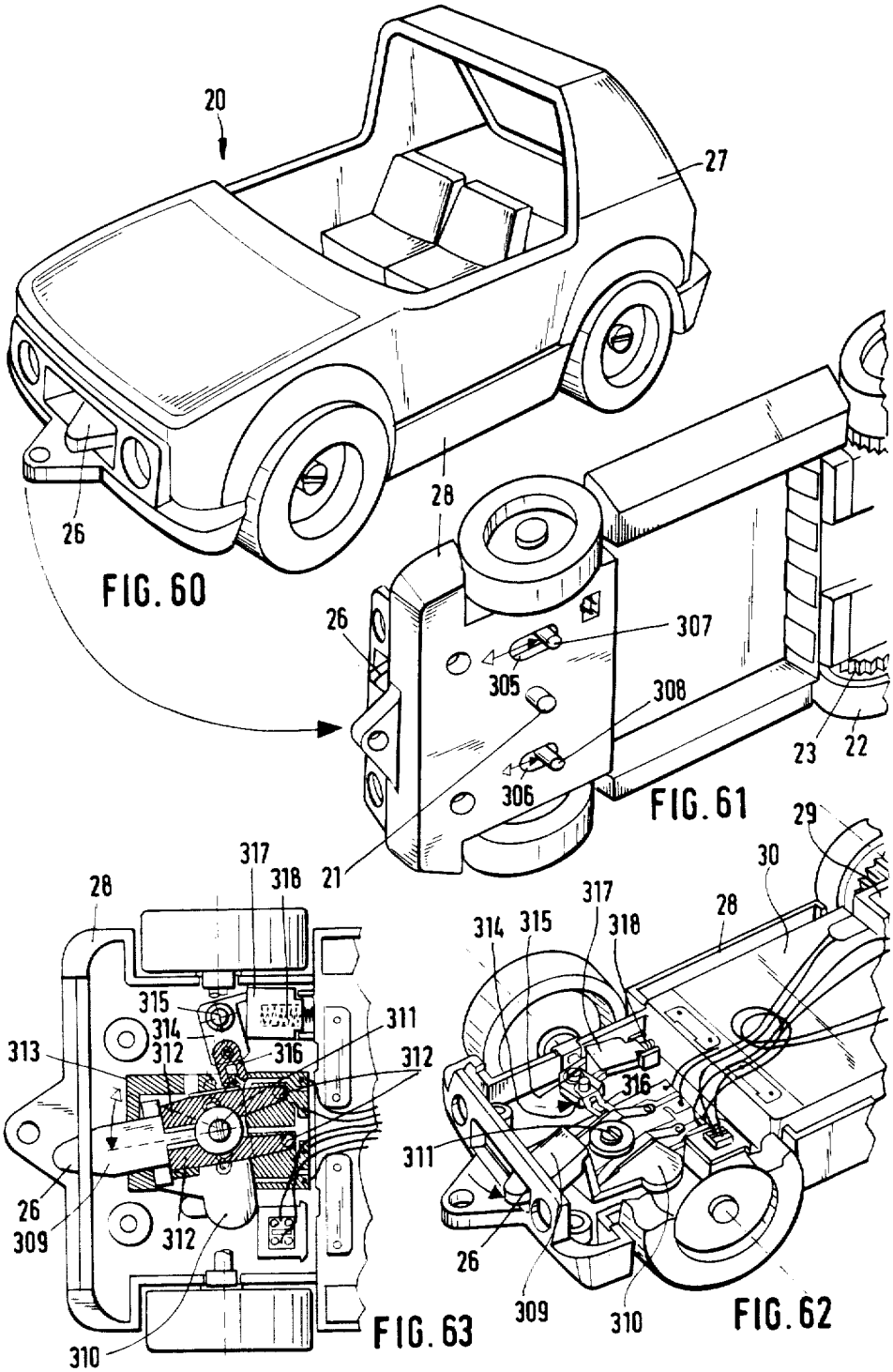
FIGS. 60 to 63 show a vehicle according to another embodiment.
Figure 64:
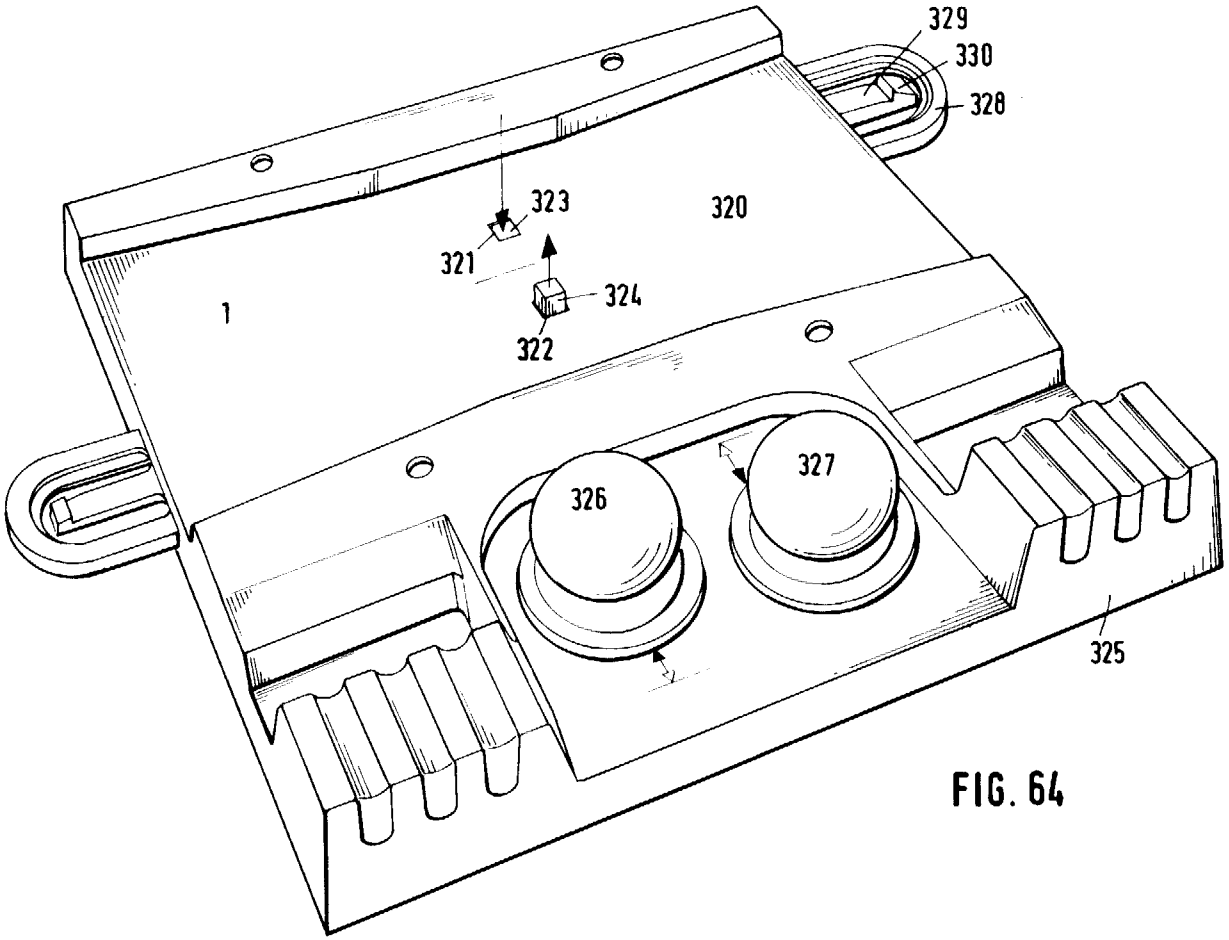

The reversal switch and the off and on switch are described in greater detail with reference to FIGS. 62 and 63. The handle 26 is extended by a lever 309 which is integral with a pivoting bolster 310 which can pivot centrally about a point of rotation such as a screw 311. The pivoting bolster 310, which acts at the same time as contact carrier, consists of non-conductive material and bears contacts 312 which can pivot over a printed wiring board 313 which is connected by way of wiring to the current source, that is, to the box 30 and to the drive, normally the electric motor 29. The contacts 312 effect in a centre position the standstill or stopping and in each end position running of the electric motor 29 in a clockwise or anti-clockwise direction, hence the forwards or the backwards travel direction of the vehicle 20. The on-off switch which is acted upon by the pin 308 consists of a lever 314 which pivots at a point of rotation 315. The lever 314 carries a contact 316 with two contact springs which produce the off position or the on position on the printed wiring board 313. The zero position, that is, the central position of the lever 314, is ensured by a slide 317 which is displaceable in the chassis 28 and is pressed against the lever 314 by a helical spring 318. In this way, the central position of the lever 314 is constantly ensured. In this position, the contacts 316 make possible the flow of current. The lever 314 can now be swung in both directions by means of the pin 308, compressing the spring 318 and interrupting the flow of current again, whereby the vehicle necessarily comes to a stop.

The pins 307 and 308 are moved by the vehicle with the respective pin running up against an impeding means which is arranged in the vehicle. For the on/off pin 308 this is irrespective of the direction from which the vehicle runs up against the impeding means as the vehicle is arrested irrespective of the direction of swing.

FIGS. 64 to 67 show a station section 320 with which it is possible for the pins 307 and 308 of the vehicle 20 to be selectively acted upon according to FIGS. 60 to 63.

The station section 320 has in its track 1 two openings 321 and 322 wherein stop members 323 and 324 respectively can be moved up and down. The station section 320 has a lateral projection 325 wherein two operating knobs 326 and 327 respectively are displaceably arranged. One serves to move the stop member 323 up and down, and the other serves to move the other stop member 324 up and down.

The way in which the station sections can be coupled with other track sections 96 or other station sections to form a track is also shown. In fact, there is shown an embodiment wherein the coupling elements correspond to those with which the toy objects can be coupled with the station sections, namely with a bow-shaped peg 328 and a tongue-like projection 329 having a hook 330 at the front end.

Figure 58:
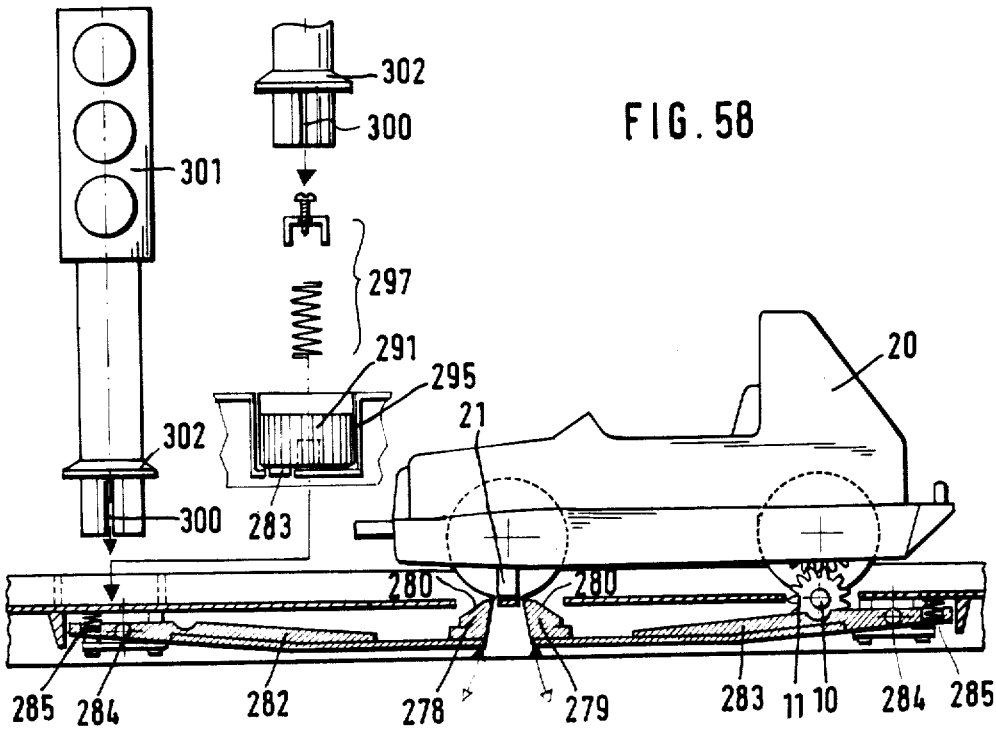
Figure 59:
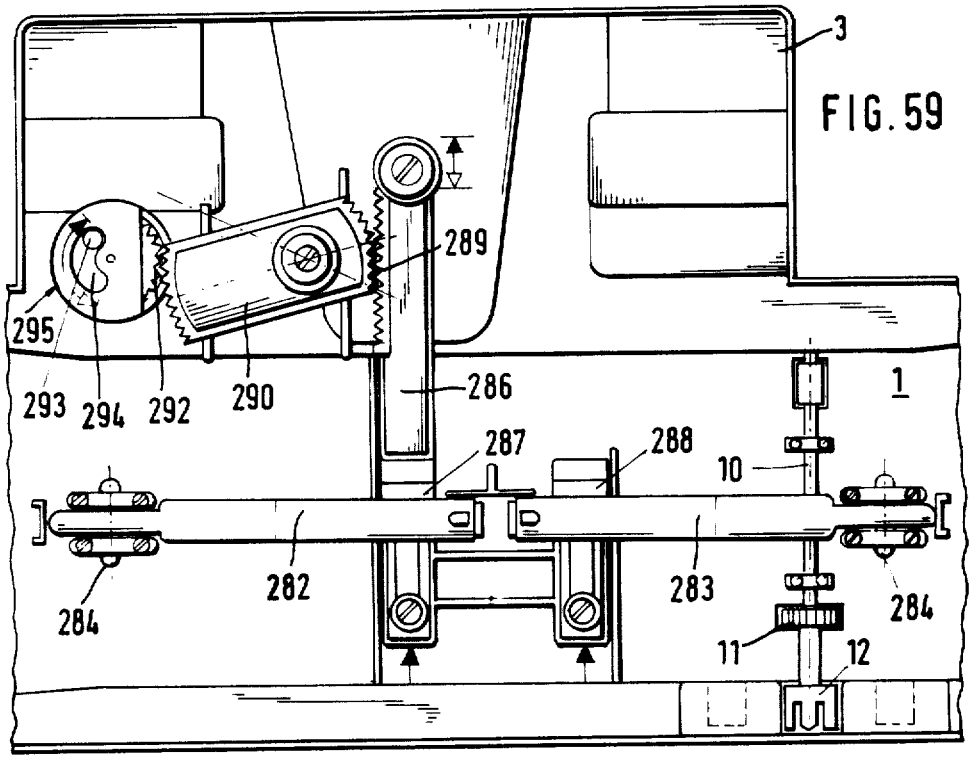

The two operating knobs 326 and 327 are connected with slides 331 and 332 respectively which are transversely displaceable relative to the track section. The slides 331 and 332 have inclined planes 333 and 334 respectively. The stop members 323 and 324 are similarly mounted on levers 335 and 336 respectively which can pivot about axes of rotation 337. There are arranged on the ends of levers 335 and 336 respectively which are opposite the stop members 323 and 324 respectively, thus on the other side of the axes of rotation 337, springs between the underside of the track 1 and the upper side of the corresponding lever sections, whereby the stop members are pressed upwards out of the track 1 through the openings 321 and 322 respectively, as is explained for example with reference to FIG. 58. If the slide is moved to the left, as shown in FIG. 67, then the inclined plane 334 pushes the lever 336 so that the stop member 323 withdraws from the track 1. If the lever 332 is moved in the other direction, then the stop member 323 springs out of the track 1 and it is prevented from being pressed down inadvertently by provision being made on the section of the slide 332 which is opposite the inclined plane 334 for a projection 338 which, in the other end position of the slide 332 shown in FIG. 66, engages over the lever 336 so that the stop member 323 cannot be pushed down from the track in any other way.

According to the forward direction of the vehicle 20 on the track as prescribed, one of the stop members 323, 324 acts on the pin 307, and the other stop member acts on the other pin 308 on the vehicle when the vehicle 20 drives into the corresponding station section 320. If the pin 307 moves against a stop member, then it is moved into the other end position inside the slot 303 respectively, thereby producing the reversal of travel direction. If the other 308 of the vehicle strikes a stop member, then it is moved out of its central position into one of its end positions, whereby the flow of current is interrupted and the vehicle is stopped. If the stop member which has acted upon the pin 307 now swings out of the area of engagement with the pin 307 by means of the associated operating knob, then the vehicle travels on with the travel direction which is now attained on condition that the pin 308 is located in the central position in the slot 306. If, by operating the appropriate operating knob, the stop member which co-operates with the pin 308 is disengaged from the pin 308, then, the returning action of the spring 318 causes the pin 308 to swing back into its neutral position, and the vehicle 20 travels on in a travel direction which is determined by the position of the pin 307 in its slot 305.

Both reversal measures can be carried out simultaneously or independently of each other.

Figure 68:
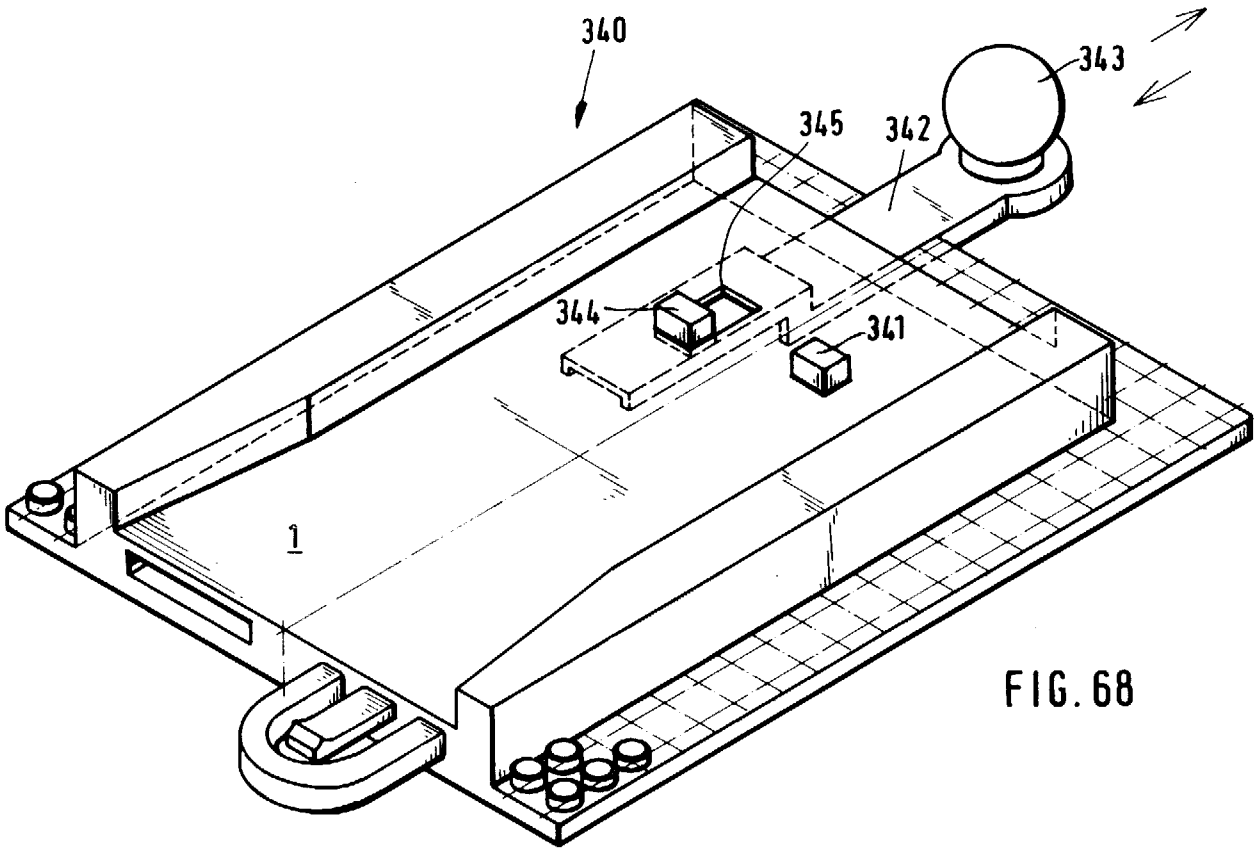

FIG. 68 shows a station section 340 which can be used as an end section of a track. These projects fixedly from the track 1 a first stop member 341 which is provided to act on the in/out pin 308 of the vehicle 20. In addition, there is mounted on a lever 342 with operating knob 343 which is displaceable in the longitudinal direction of a track a stop member 344 which is displaceable in an elongate slot 345 in the track 1 in the direction of travel. The stop member 344 is provided to act on the reversal pin 301 of the vehicle 20. Both end positions of the stop member 344 in the slot 345 are such that it lies in its end position at the same level as the stop member 341 in the transverse direction of the track 1, while in the other end position relative to the end of the track it is further removed than is the fixed stop member 341.

If the stop member 344 is in the first end position, and the vehicle 20 drives into the station section 340, then the pin 308 comes into contact with the fixed stop member 341, whereby the vehicle is stopped. If the lever 342 is now moved with the aid of the operating knob 343 so that the stop member 344 is moved into the other end position in the slot 345, then the latter acts on the pin 307 of the vehicle 20 with the result that the direction of travel is changed, that is, the flow of current is reversed. In this case, the travel of the lever 342 is rather greater than would be necessary for reversal so that when the pin 307 is moved by means of the stop member 344, the vehicle 20 is also pushed back slightly so that the pin 308 is released so far from the fixed stop member 341 that it reaches its central position in the slot 306 with the result that current flow is again possible, and the vehicle 20 drives out of the station section 340 again in the opposite direction of travel.

Figure 69:
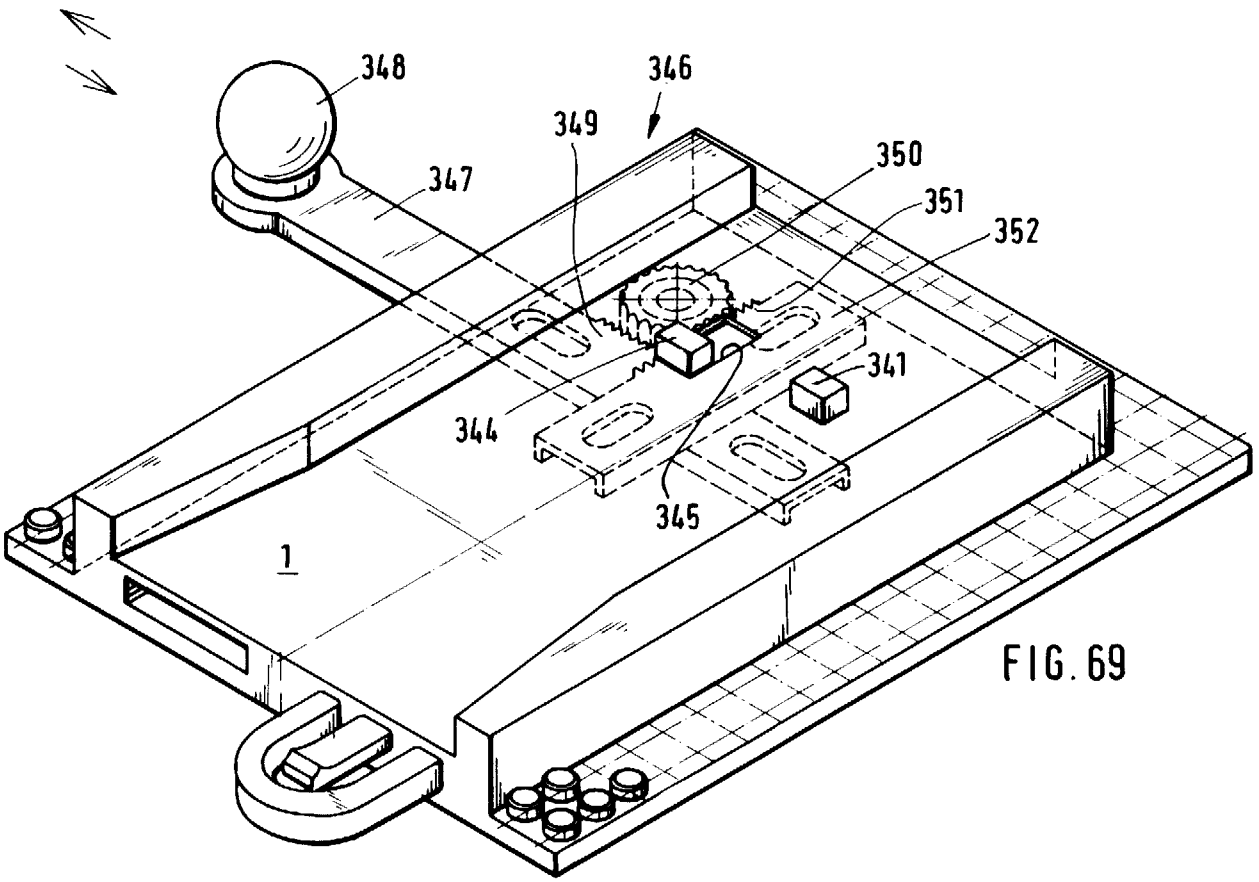

The station section 346 according to FIG. 69 is distinguished from the station section 340 described with reference to FIG. 68 in that the slide 347 is provided with the operating knob 348 at the side of the section 346. In order to move the stop member 344 in the longitudinal direction of the track 1, one side of the slide 347 is provided with toothing 349 which meshes with a toothed wheel 350 which is mounted in the station section 346 and which, in turn, engages with toothing 351 on a slide 352 which carries the stop member 344 and moves it in the longitudinal slot 345 when the slide 347 is also moved.

Of course, it is also possible to move the movable stop pins transversely relative to the track 1 so that the pins 307 and 308 on the vehicle do not strike the stop member. In the latter case, it is also possible for the vehicle 20 to travel through.

The station sections 340 and 346 are constructed as end sections so that vehicles can drive to and fro between two such end sections. These station sections 340 and 346 can also be formed as a garage or the like so that a new toy object is created. Station sections such as the station section 320 can also be used as parts of a crossing construction.

A further station section which is advantageous for the vehicle according to FIGS. 60 to 63 is described with reference to FIGS. 70 to 75.

Whereas the station section 320 according to FIGS. 64 to 67 requires two slides and two operating knobs for reversing the vehicle, the station section 355 described in the following is distinguished in that the vehicle 20 can be operated by means of a single operating device.

Figure 71:
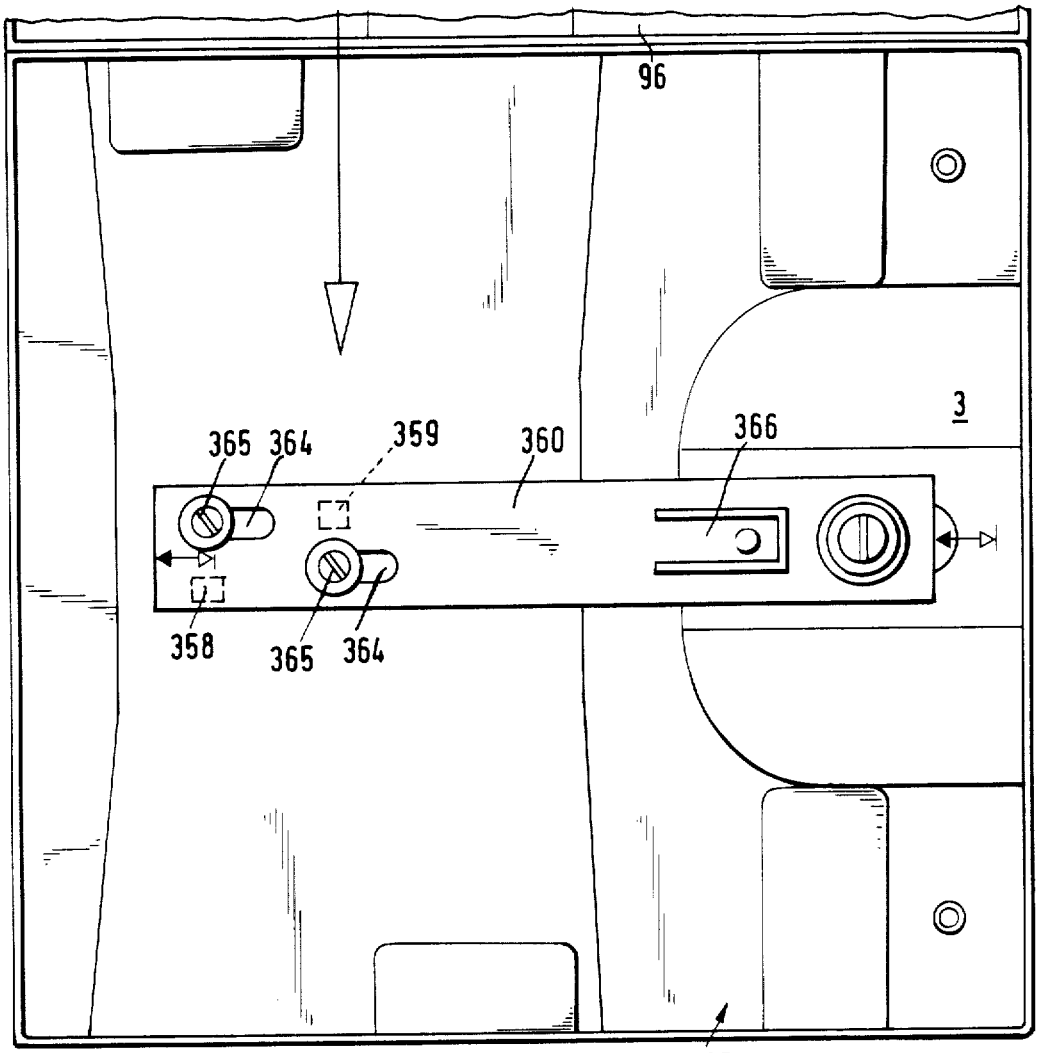
FIGS. 71 to 75 show another embodiment of a station section for a vehicle according to FIGS. 60 to 63.
Figure 72:
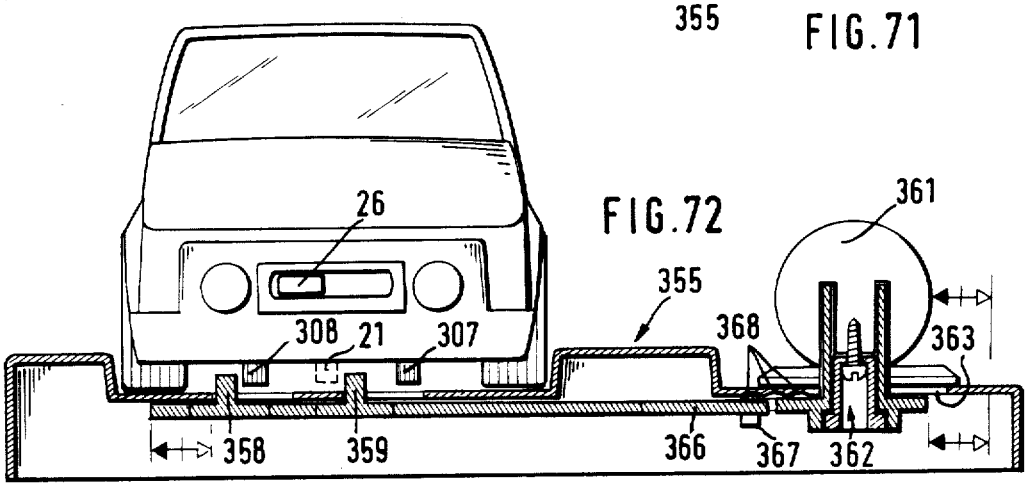
Figure 73:
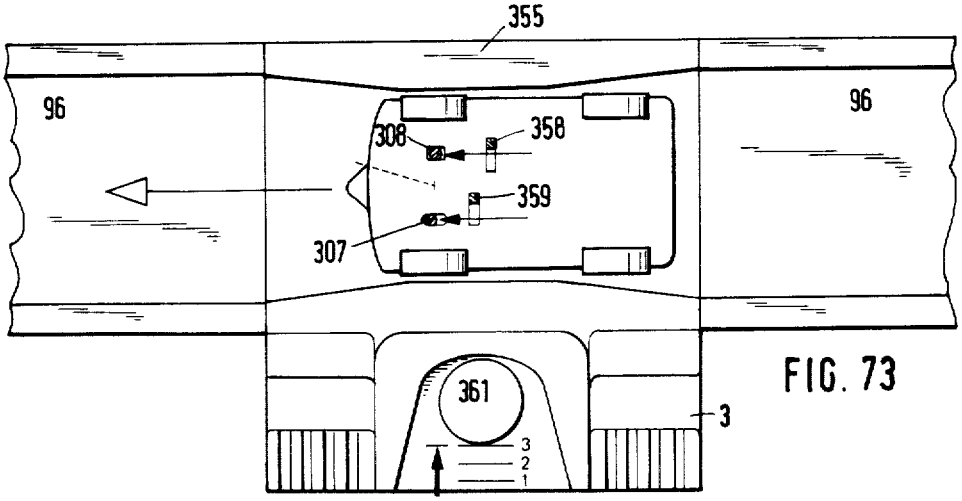

Stop members 358 and 359 respectively project out of the track through slots 356 and 357 in the track 1 of the station section 355, which said slots are mutually offset in the direction of travel and extend in a transverse manner relative to the direction of travel. Both stop members 358 and 359 are fixedly connected with a single slide 360 which, with the aid of an operating knob 361, can be moved in a transverse manner relative to the track section. As is shown in FIG. 72, the operating knob 361 and the slide 360 are interconnected by way of a screw connection 362 which is movable in a transverse manner relative to the direction of travel in an elongate blade 363 in the projection 3 of the station section 355. FIG. 71 shows guiding of the slide 360 at the other end. For this purpose the slide has at least one elongate hole 364, in the embodiment shown two such elongate holes 364. There engages through each elongate hole 364 a screw with a washer 365 which is secured in the station section. Guiding of the slide 360 is thereby ensured.

The slide is movable between three defined positions of which the location is advantageously determined by an arrangement of notches. The arrangement of notches shown has, formed in the slide, a tongue 366 from the free end of which these projects a projection 367 which can engage in a springy manner in one of three recesses 368 formed in the projection 3.

Figure 70:
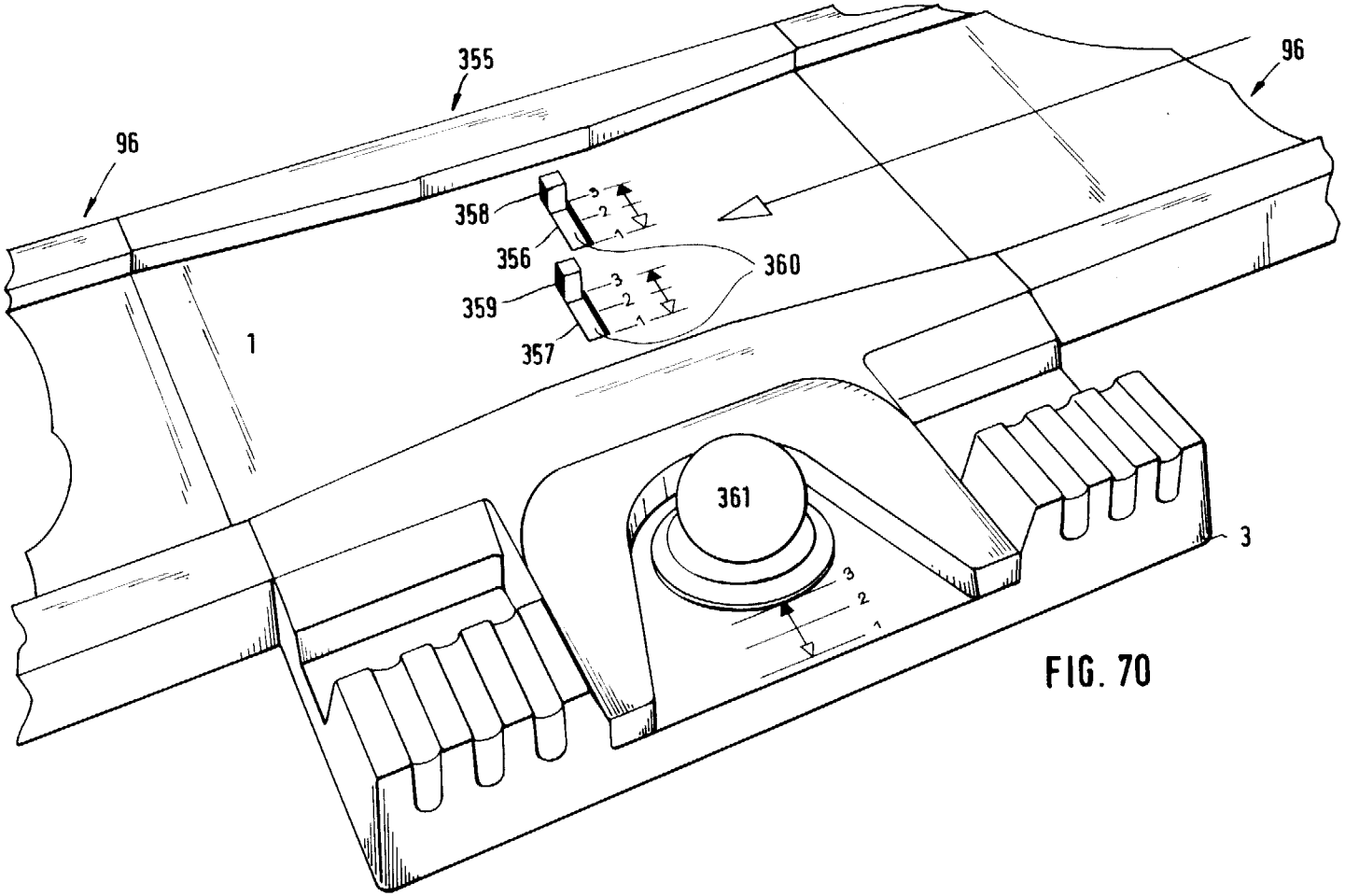

The three positions which can be adopted by the stop members 358 and 359 are denoted in FIG. 70 by 1, 2 and 3, corresponding markings being provided on the projection 3 in the region of the operating knobs 361 in order to produce in addition a visual display. Furthermore, in FIGS. 70, 71 and 73 the forward direction of travel is designated by a white arrow.

Figure 74:
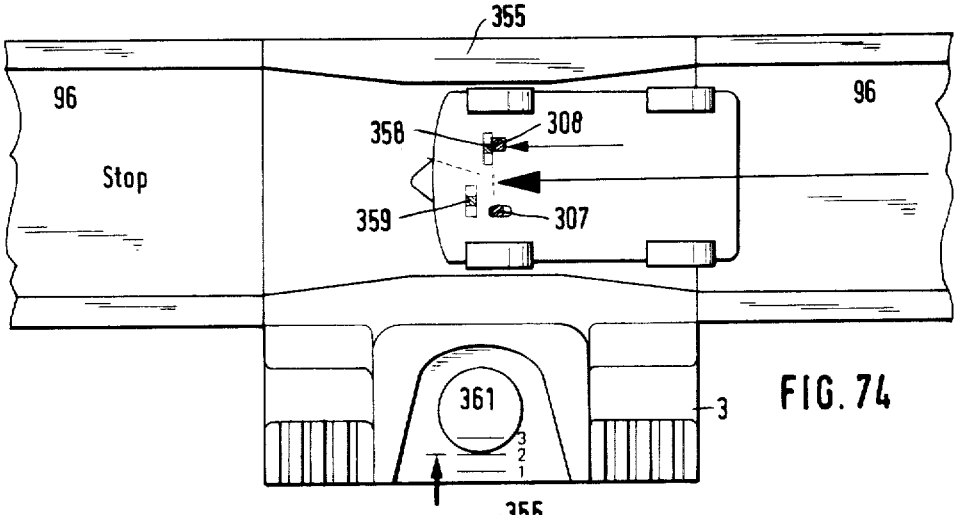

As mentioned, three switching positions are now possible. In the switching position 3 shown in FIGS. 70 to 73, the stop members 358, 359 are disposed in a position relative to the pins 308 and 307 on the vehicle 20 in which they are unable to strike one another. Furthermore, the arrangement is such that even the central stop pin 21 on the vehicle 20 is unable to come into contact with either of the stop members 358, 359. That is, a vehicle 20 driving into the station section 355 drives on unimpeded. In the switching position 2 which is shown in FIG. 74, the pin 308 on the vehicle 20 comes into contact with the stop member 358. The pin 308 now acts in the manner already described on the lever 314 so that the vehicle 20 is halted. In this case, it is of no consequence whether the vehicle drives into the station section 355 in a forwards travel direction or a backwards travel direction as the reversal pin 307 can pass by the stop member 359.

Figure 75:
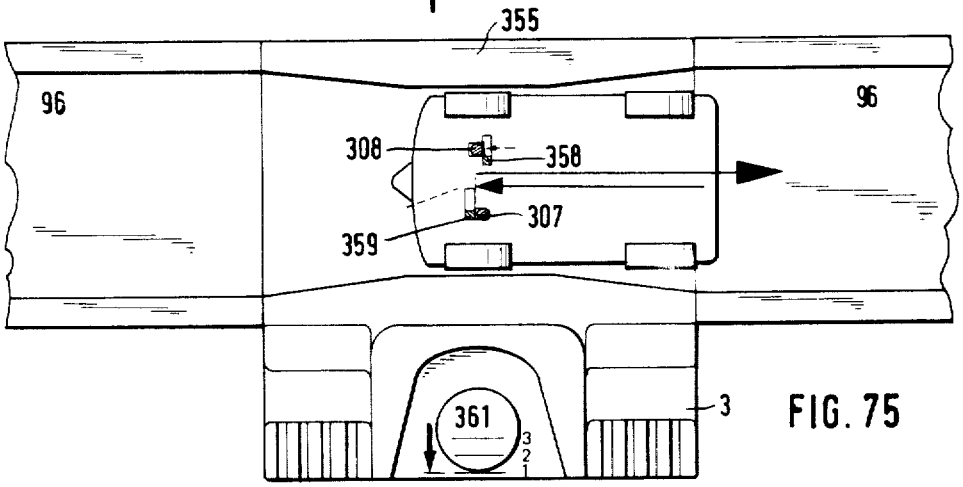

In the position 1 according to FIG. 75, the reversal pin 307 of the vehicle 20 comes into contact with the stop member 359, and namely again irrespective of whether the vehicle 20 drives into the station section 355 in the forwards travel direction or the backwards travel direction. As a result of contact with the stop member 359, the pin 307 is moved into the other end position, whereby the vehicle 20 leaves the station section 355 again in the other travel direction.

From the position 2 (stop position) shown in FIG. 74, in which the vehicle 20 is housed in the station section 355, the slide 360 can be moved with the aid of the operating knob 361 both into the position 3 (FIG. 73) and the position 1 according to FIG. 75. If it is moved out of position 2 into position 3 when the vehicle 20 has been stopped, then the latter is released and moves on, maintaining the travel direction. If the vehicle has driven in the forward travel direction into the station section 355 in the position 2 according to FIG. 74 and reversal to the position 1 according to FIG. 75 then takes place, then in the first instance the vehicle moves straight on a little way until the pin 307 stikes the stop member 359, whereby the travel direction is reversed, and the vehicle now leaves the station section 355 in the backwards travel direction.

However, the station section 355 can also be used with a reverse direction of travel (from left to right in FIG. 73), the switching processes then being practicable in the reverse manner. The switching processes are practicable likewise for the backwards travel direction of a vehicle 20. Therefore the essential feature of this embodiment of the station section is that with a single operating device, halting, driving through and change of direction of travel are possible.

The vehicles, station sections and objects described above, can be combined virtually at will, thereby producing a motorised toy which continues to provide fresh possibilities for design and play for the child, that is, it never becomes boring. However, the child's imagination is greatly stimulated, and educational effects relating to road safety can be achieved. Further, the individual component parts are of a very robust and simple construction and hence not very likely to be damaged. They can be manufactured essentially from injection-moulded parts with any colouring. Solely electrically conductive parts must consist of corresponding material.

As mentioned, play figures 94 can be used for the vehicles and the different toy objects, which can be constructed in a relatively simple manner, namely essentially of a trunk portion and a lower body portion which should swivel relative to each other, arms which, preferably, should swivel independently, being provided in the shoulder region of the trunk portion. The area of the hands is formed so that it is possible to clamp the play figure 94 as a whole to, for example, the steering wheel of a vehicle 20 and/or parts of the toy objects, as has been described, by way of snap-action. In this way it is also practicable for passengers to be put in and out of the vehicles and the toy objects.

Of course, the invention is not limited to the embodiments described in detail, numerous other arrangements lying within the scope of the invention also being possible.

More particularly, station sections 320, 355 and station sections 95, 275 can be structurally combined with one another. The term "start member" used throughout the specification, the claims and the abstract should be understood, as has been described in detail, as a check type member having at least two sloping stopping or checking faces formed as inclinations 15, against which runs the stop pin 21 to engage in the slot 16.

I claim:

1. A motorised toy comprising: at least one toy self-propelled vehicle having a pin mounted thereon which pin projects from the vehicle, said vehicle including driving means which acts on at least one pair of supporting wheels mounted on said vehicle; at least one station section including a track portion which can be installed in the course of a track, said station section having a stopping arrangement mounted thereon including a start member and lever means for moving said start member between at least two positions and whereby it can be brought into operative connection with the pin on the vehicle, causing the vehicle to stop in a defined position in the station section said station section having mounted thereon an axle arranged at right angles to the track portion and underneath the latter, with at least one rotary component which projects upwardly out of the track portion and which can be rotated by one of said driven wheels when the toy vehicle stops in the defined position, there being an engagement component at one end of the axle; and at least one toy object which has movable parts and which can be connected with said station section in a fixed but detachable manner so that, by way of an engagement component thereof, it is in contact with the engagement component of the station section whereby the movable parts can be moved via the engagement components when said toy vehicle has stopped in the station section in the defined position, wherein: the vehicle has a lever which can be moved between at least a forward and a reverse travel position and which acts accordingly on the vehicle's driving means; said start member having a slot corresponding to the dimensions of the pin on the vehicle extending transversely of the track portion, into which slot the pin of the vehicle engages in at least one of the positions of the start member in order to stop the vehicle, irrespective of the vehicle's travel direction, in the defined position, and wherein in at least one other position of the lever of the stopping arrangement, the pin on the vehicle and the slot in the start member are disengaged.

2. A motorised toy according to claim 1, wherein the start member can be displaced in the plane of the track portion.

3. A motorised toy according to claim 1, wherein the start member can be tilted into and out of the course of the track portion.

4. A motorised toy according to claim 2 or 3, wherein spring means bias the start member to the position in the track portion in which the pin of the vehicle engages in the slot of the start member.

5. A motorized toy according to claim 1, 2 or 3, wherein the start member is formed in two parts, each of said two start member parts moving between the two start member positions, and means are provided to bias each of the two parts to the position in the track portion in which the pin on the vehicle engages in the slot of the start member.

6. A motorised toy according to claim 1, 2, or 3, wherein said stopping arrangement includes a slide bar, which can be shifted at right angles to the track portion likewise between at least two positions.

7. A motorised toy according to claim 6, wherein there is a rotary driver and means for rotating the rotary driver from the upperside of the station section and which engages with the slide bar so that as the driver rotates the slide bar is shifted at right angles to the track portion.

8. A motorised boy according to claim 7 including a toy object adapted to be connected with the driver.

9. A motorised toy according to claim 1, 2 or 3, wherein a single pin projects from the vehicle, said single pin being movable at right angles to the travel direction of the vehicle and engagable with the stopping arrangement in the slot of the start member and a means is associated with said movable single pin to effect change in vehicle travel between forward and reverse travel directions.

10. A motorised toy according to claim 9, wherein sliding means including a slide bar, are associated with the start member, which slide bar is movable at right angles to the direction of travel of the vehicle independently of the movement of the start member, and associated with the pin to effect shifting the pin in order to reverse the travel direction of the vehicle.

11. A motorised toy according to claim 10, wherein the sliding means is formed as guide rails with inlet funnels and the start member is contained in a recess in the sliding means.

12. A motorised toy according to claim 1, 2 or 3, wherein from the vehicle there project two pins, means are provided to shift both the pins into or against the vehicle travel directions with reversal of the vehicle between at least the forward and the reverse travel directions possible through the shifting of the pins and two start members are associated with the track portion each said start member having a slot, said start members being shiftable in opposite directions into or against the travel directions of the vehicle, and being detachably engagable by the two pins.

13. A motorised toy according to claim 12, wherein the start members are arranged on bars, which are substantially parallel with one another and with the course of the track, said bars being held by a pivoted bolster, which bolster can be tilted around vertical axis of rotation centrally of the track.

14. A motorised toy according to claim 13, wherein there is provided a lever which is pivoted on the station section, said lever acting on one of the bars and displacing it in the direction of the course of the track.

15. A motorised toy according to claim 1, wherein from the vehicle there projects an additional pin, said additional pin being displaceable in the direction of the course of the track to effect a reversal between the forward and the reverse vehicle travel directions, and in the station section a stop member can be removably moved into the path of movement of this additional pin on the vehicle.

16. A motorised toy according to claim 1, wherein from the vehicle there projects an additional pin, said additional pin being displaceable in the direction of the course of the track to effect reversal between the stopped position and the travelling position, and in the station section a stop member can be removably moved into the path of movement of this additional pin on the vehicle.

17. A motorised toy according to claim 15 or 16, wherein the stop member can be selectively displaced into and out of the course of the track by displacing a slide bar.

18. A motorised toy according to claim 15 or 16, wherein the stop member can be shifted at right angles to the track in such a way that the additional pin on the vehicle abuts the stop member.

19. A motorised toy according to claims 15 or 16, wherein the start and stop members, which are associated with respective ones of the pins, can be moved independently of each other.

20. A motorised toy according to claims 15 or 16, wherein the start member, associated with the pin to be fixed, and the stop member, associated with the additional pin, can be moved against the travel direction.

21. A motorised toy according to claims 15 or 16, wherein the start and stop members, associated with respective ones of the pins, can be moved together between at least three positions whereby in the first position the pin comes to rest on the associated start member; in the second position the additional pin comes to rest on the associated stop member; and in the third position none of the pins comes to rest on the associated said member.

22. A motorised toy according to claim 15 or 16 wherein the stop members, associated with respective ones of the pins, can be moved together between at least three positions whereby in the first position the pin comes to rest on the associated start member; in the second position the additional pin comes to rest on the associated stop member; and in the third position none of the pins comes to rest on the associated said member, and wherein in the travel direction the start and stop members are arranged in a staggered manner so that first of all the stopping of the additional pin is possible.

23. A motorised toy according to claim 15, wherein the additional pin has a neutral mid-position and can be moved through abutting with a stop member according to the vehicle travel direction into an end position, in which end position the vehicle is stopped.

24. A motorised toy according to claim 9, wherein at least one of said pins can occupy a central, neutral, third position, in which third position the vehicle is stopped.

25. A motorised toy according to claim 1, 2 or 3, wherein the vehicle is driven by an electric motor and the reversal of the travel direction takes place through reversal of polarity of power supplied to the motor.

26. A motorised toy according to claim 1, 2 or 3, wherein the vehicle is driven by an electric motor and the stopping takes place through interruption of current flow to the electric motor.

27. A motorised toy according to claim 1, 2 or 3, wherein the engagement component on the station section and the engagement component on the toy object are formed so that, when the engagement components couple together rotation can take place when the motor drives the wheels both in a forwards vehicle travel direction as well as a reverse vehicle travel direction with the vehicle in the defined position.

28. A motorised toy according to claim 27, wherein between the engagement component of the toy object and at least one of its movable parts there is provision for a drive means comprising a friction wheel and a disc, and lever means are provided for shifting the friction wheel in approximately the radial direction of the disc for the purposes of continuously changing the rotational speed.

29. A motorised toy according to claim 27, wherein two different said toy objects having movable parts are provided and the movement of the parts can be set and stopped selectively by way of a friction wheel and disc drive, and lever means are provided for moving the friction wheel.

30. A motorised toy according to claim 28 wherein the disc carries cross-pieces and can be stopped by a blocking element acting against said cross-pieces on the disc.

31. A motorised toy according to claim 27, wherein a rotary portion of the toy object operates a bell by way of clapper.

32. A motorised toy according to claim 22 wherein in the case of said at least one toy object the engagement component thereof is torsionally strong, and further said toy objects can be coupled by engagement with said torsionally strong component.

33. A motorised toy according to claim 27, wherein the toy object is formed as a chair merry-go-round.

34. A motorised toy according to claim 27, wherein the toy object is formed as a small merry-go-round for a children's play-ground.

35. A motorised toy according to claim 27, wherein the toy object is formed as a seesaw, and a lever, which is connected with a disc, which rotates about a vertical axis and is pivoted on the toy object, tilts a pin on the seesaw to and fro, causing the seesaw to tilt about a horizontal axis.

36. A motorised toy according to claim 35, characterised in that the pin on the seesaw is tilted to and fro in a rocker arm between stops, which are prestressed in a springy flexible manner.

37. A motorised toy according to claim 27, wherein the toy object is formed as a musical clock.

38. A motorised toy according to claim 27, wherein the toy object is formed as a petrol station.

39. A motorised toy according to claim 27, wherein the toy object is formed as an emergency call stand with a rotating blue light.

40. A motorised toy according to claim 27, wherein the toy object is formed as a tree merry-go-round with portions which can be fixed on top of each other.

41. A motorised toy according to claim 40, wherein in a base portion a peg can be directly rotated, a peg portion can be mounted on the peg with a cross shaft which moves a swivelling portion panel, at least one further peg portion can be mounted having bars which intersect, in the case of which movement of the swivelling portion takes place in the direction of rotation by way of friction, and at least one toy figure can be mounted on at least one of said panel and bars.

42. A motorised toy according to claim 41, wherein a further peg portion with milling is provided on an end of the peg portion.

43. A motorised toy according to claim 40, wherein there is arranged and means are provided upon the peg portion at least one trapeze, on which toy figures can also be mounted.

44. A motorised toy according to claim 27, wherein the toy object is formed as a gymnastic apparatus.

45. A motorised toy according to claim 44, wherein there are two vertical posts on a base portion, between which posts there is provision for a rotating shaft which can be rotated by way of the engagement component and intermediary components which are adjoined, such as shafts and cog wheels, whereby a toy figure can be mounted on the rotating shaft itself or on components connected with the rotating shaft.

46. A motorised toy according to claim 45, wherein there is a push button on one said post which acts on a toothed rack, said push button, when pushed, meshing with a cog wheel in order to turn the rotating shaft, said button, when released, being disengaged from the cog wheel and spring means are provided to bias the push button to reset position.

47. A motorised toy according to claim 45, wherein there is a friction coupling, one part of which is connected with the rotating shaft so that it is torsionally strong.

48. A motorised toy according to claim 27, wherein at least one toy object contains an element which produces noises through rotation.

49. A motorised toy according to claim 48, wherein there is a part which is prestressed in a springy manner and which butts against projections of a rotating part.

50. A motorised toy according to claim 48, wherein there is a musical clock, which can be rotated by way of driving components.

51. A motorised toy according to claim 46, wherein there is a siren rotor and a siren stator, and the siren rotor can be rotated by way of engagement components which are engaged with one another.

52. A motorised toy according to claim 48, wherein there is a lever through which the noise producing element can be switched on or off.

53. A motorised toy according to claims 1, 2, or 3 wherein the engagement component on the station section and the engagement component on the toy object are formed so that, when the engagement components couple together and there is mutual engagement, rotation takes place in the case of not only a forwards travel direction, but also a reverse travel direction of the vehicle in the defined position, wherein at least one toy object contains an element which produces noises through rotation, wherein there is a musical clock which can be rotated by way of engagement components which are engaged with one another, and wherein the coupling takes place between the siren rotor and the engagement component of the toy object by shifting a double gear wheel, which can be engaged with other cog wheels or can be disengaged.

54. A motorised toy according to claim 1, 2 or 3, wherein there are coupling members, for which there is provision on the toy object and which engage with corresponding, complementary coupling openings in the station section or another toy object in a locking manner.

55. A motorised toy according to claim 54, wherein the coupling member for the toy object is formed as a bow-shaped peg and a projection in the form of a tongue with a hook, which engage with a complementary coupling opening in a locking manner.

56. A motorised toy according to claim 27, wherein on the toy object, external driving apparatus can be coupled which has an engaging component which corresponds to that of the station section and which engages with the toy object's engagement component, to that, in order to rotate the parts of the toy object.

57. A motorised toy according to claim 56, wherin the driving apparatus is a crank handle-driving apparatus.

58. A motorised toy acording to claim 56, wherein the driving apparatus is an electric motor-driving apparatus.

59. A motorised toy according to claims 1, 2 or 3 wherein the engagement component on the station section and the engagement component on the toy object are formed so that, when the engagement components couple together and there is mutual engagement, rotation takes place in the case of not only a forwards travel direction, but also a reverse travel direction of the vehicle in the defined position, wherein at least one toy object contains an element which produces noises through rotation, wherein there is a siren rotor and a siren stator, in the case of which the siren rotor can be rotated by way of engagement components which are engaged with one another, and wherein the coupling takes place between the siren rotor and the engagement component of the toy object by shifting a double gear wheel, which can be engaged with other cog wheels or can be disengaged.

* * * * *